US006200717B1

(12) United States Patent
Takeuchi et al.

(10) Patent No.: US 6,200,717 B1
(45) Date of Patent: Mar. 13, 2001

(54) ELECTROPHOTOGRAPHIC PHOTOCONDUCTOR AND ELECTROPHOTOGRAPHIC APPARATUS

(75) Inventors: Masaru Takeuchi; Kenichi Ohkura; Shinichi Omokawa, all of Kawasaki (JP)

(73) Assignee: Fuji Electric Imaging Device Co., Ltd., Matsumoto (JP)

( * ) Notice: Subject to any disclaimer, the term of this patent is extended or adjusted under 35 U.S.C. 154(b) by 0 days.

(21) Appl. No.: 09/558,625

(22) Filed: Apr. 26, 2000

(30) Foreign Application Priority Data

Apr. 30, 1999 (JP) ..... 11-125206

(51) Int. Cl.[7] ..... G03G 5/09; G03G 15/00
(52) U.S. Cl. ..... 430/83; 399/159
(58) Field of Search ..... 430/83; 399/159

(56) References Cited

U.S. PATENT DOCUMENTS 5,449,580 * 9/1995 Nakamori et al. ..... 430/83
5,492,784 * 2/1996 Yoshikawa et al. ..... 430/83

FOREIGN PATENT DOCUMENTS 1-206349 8/1989 (JP) .
3-757754 3/1991 (JP) .
3-290666 12/1991 (JP) .
4-360148 12/1992 (JP) .
5-92936 4/1993 (JP) .
5-150481 6/1993 (JP) .
5-279582 10/1993 (JP) .
6-130688 5/1994 (JP) .
7-179775 7/1995 (JP) .
8-209023 8/1996 (JP) .
8-211636 8/1996 (JP) .
9-151157 6/1997 (JP) .
9-281728 10/1997 (JP) .
9-281729 10/1997 (JP) .
10-73937 3/1998 (JP) .
10-239874 9/1998 (JP) .

OTHER PUBLICATIONS

The Society Journal of Electrophotography, 30, 266–273 (Feb. 1991), Application of Unsymmetrical Diphenoquinone Derivatives to Xerography (1)—Molecular Design of a Novel Class of Polymer–dispersible Electron–transport–active Compounds, Yamaguchi et al.

Preprints for Pan–Pacific Imaging Conference/Japan Hardcopy '98 Jul. 15–17, 1998 at JA Hall, Tokyo, Japan, pp. 207–210, Synthesis and Properties of a Novel Electron Transporting Compound, 3,3'–dialkyl–4,4'–bisnaphthylquinone.

Collection of papers of Japan Hardcopy '97, Jul. 9, 10, and 11, 1997, JA Hall (Otemachi, Tokyo), pp. 21–24, Synthesis and Xerographic Properties of Novel Naphthoquinone.

Collection of papers of Japan Hardcopy '92, Jul. 6, 7 and 8, 1992, JA Hall (Otemachi, Tokyo), pp. 173–176, Development of Organic Electron Transport Materials.

* cited by examiner

*Primary Examiner*—Roland Martin
(74) *Attorney, Agent, or Firm*—Venable; Robert J. Frank

(57) ABSTRACT

In a electrophotographic photoconductor having a single layer type photosensitive layer 3 laminated directly or through an undercoat layer 2 on an electroconductive substrate 1, the single layer type photosensitive layer 3 contains at least a resin binder, a charge generating substance, a hole transfer substance and an electron transfer substance, wherein the hole transfer substance is a compound represented by the general formula (HT1) shown below and an electrophotographic apparatus comprise this photoconductor. This electrophotographic photoconductor has good electric property in positive charge and good stability in repeated use.

(HT1)

18 Claims, 1 Drawing Sheet

ELECTROPHOTOGRAPHIC PHOTOCONDUCTOR AND ELECTROPHOTOGRAPHIC APPARATUS

This application is based on Patent Application No. 11-125206 (1999) field Apr. 30, 1999 in Japan, the content of which is incorporated hereinto by reference.

BACKGROUND OF THE INVENTION

1. Field of the Invention

The present invention relates to electrophotographic photoconductors and electrophotographic apparatuses utilizing the electrophotographic photoconductor.

2. Description of Related Arts

In recent years many electrophotographic photoconductors are proposed and put to practical use, as photosensitive characteristics of organic electrophotographic photoconductors using organic photosensitive materials are free of pollution, less costly, and flexibility of designing electrophotographic characteristics provided by wide variety in material selection.

Photosensitive layers of organic electrophotographic photoconductors have been proposed, which mainly consist of layers dispersing organic photosensitive materials in resin. The photosensitive layers are, for example, laminated structures formed by laminating layers dispersing charge generating substances in resin (charge generating layers) and layers dispersing charge transfer substances in resin (charge transfer layers), and single layer structures formed of single layers dispersing charge generating substances and charge transfer substances in resin.

Particularly photoconductors using photosensitive layers of function separated type which charge transfer layers are laminated on charge generating layers are widely put to practical use, since they have good photoconductor characteristics and durability. These laminated photoconductors of function separated type are used in negative charging processes, since hole transfer substances are mainly used in the charge transfer layers utilized for the laminated photoconductors of function separated type. However, as negative polar corona discharge used in negative charging processes is less stable and generates more ozone than positive polar corona discharge, harmful effects to photoconductors and operation environments have been problems.

As organic electrophotographic photoconductors usable with positive charge are effective in solving these problems, positively charged photoconductors with high sensitivity are required. A great number of positively charged photoconductors have been proposed, which are function separated type photoconductors with a charge generating layer laminated on a hole transfer layer or an electron transfer layer laminated on a charge generating layer as photosensitive layers, or single layer type photoconductors which charge generating and charge transfer substances are contained in a single layer. However, many of them have fallen behind negatively charged function separated type photoconductors in electric properties such as sensitivity.

Therefore in recent years, many electron transfer substances and electrophotographic photoconductors using them have been proposed, published, and attracted attention, for example in Japanese Patent Application Laid-open No. 1989-206349; Japanese Patent Application Laid-open No. 1992-360148; The Society Journal of Electrophotography, 30, 266–273 (1991); Japanese Patent Application Laid-open No. 1991-290666; Japanese Patent Application Laid-open No. 1993-92936; Preprints for Pan-Pacific Imaging Conference/Japan Hardcopy '98 Jul. 15–17, 1998 at JA Hall, Tokyo, Japan, p. 207–210; Japanese Patent Application Laid-open No. 1997-151157; Collection of papers of Japan Hardcopy '97, Jul. 9, 10, and 11, 1997, JA Hall (Otemachi, Tokyo), p. 21–24; Japanese Patent Application Laid-open No. 1993-279582, Japanese Patent Application Laid-open No. 1995-179775; Collection of papers of Japan Hardcopy '92, Jul. 6, 7, and 8, 1992, JA Hall (Otemachi, Tokyo), p. 173–176; and Japanese Patent Application Laid-open No. 1998-73937. Further, photoconductors using single layer type photosensitive layers in combination of hole transfer substances and electron transfer substances such as described in Japanese Patent Application Laid-open No. 1993-150481; Japanese Patent Application Laid-open No. 1994-130688; Japanese Patent Application Laid-open No. 1997-281728; Japanese Patent Application Laid-open No. 1997-281729; and Japanese Patent Application Laid-open No. 1998-239874 attract attention because of high sensitivity, and some of them have been put to practical use.

In single layer type of electrophotographic photoconductors described above, however, though electric properties such as initial sensitivity and residual potential are good, there still remain problems such as change in electric properties due to repeated use. In a word, satisfactory products have not been obtained at present. While photoconductors containing hole transfer substances of the present invention have been described in Japanese Patent Application Laid-open No. 1996-211636. However, there is no description of photoconductors containing electron transfer substance in the Application.

Therefore, the purpose of the present invention is to provide electrophotographic photoconductors having single layer type photosensitive layer containing electron transfer substances and electrophotographic apparatuses comprising them. The electrophotographic photoconductors eliminate the drawbacks described above and, have good electric properties in positive charge and good stability in repeated use.

SUMMARY OF THE INVENTION

As a result of repeated wholehearted research for solving the problems described above, the present inventors found out that electrophotographic photoconductors having single layer type photosensitive layer comprising at least resin binders, charge generating substances, hole transfer substances, and electron transfer substances (acceptor compounds) have improved stability in repeated use of electric properties in positive charge by using particular compounds as the hole transfer substance, and completed the present invention.

The present invention is provided an electrophotographic photoconductor comprising:

a single layer type photosensitive layer laminated directly or through an undercoat on an electroconductive substrate, wherein the single layer type photosensitive layer contains at least a resin binder, a charge generating substance, a hole transfer substance and an electron transfer substance, the hole transfer substance containing at least one selected from the group consisting of compounds represented by the following general formula (HT1)

(HT1)

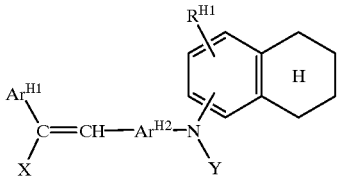

wherein, $Ar^{H1}$ is aryl group optionally having substituents, $Ar^{H2}$ is phenylene group optionally having substituents, naphthylene group, biphenylene group or anthrylene group, $R^{H1}$ is hydrogen atom, lower alkyl group or lower alkoxy group, X is hydrogen atom, alkyl group optionally having substituents, or aryl group optionally having substituents, and Y is aryl group optionally having substituents, the following general formula (HT1a)

(HT1a)

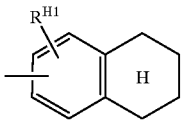

wherein, $R^{H1}$ is the same meaning as the above, or the following general formula (HT1b)

(HT1b)

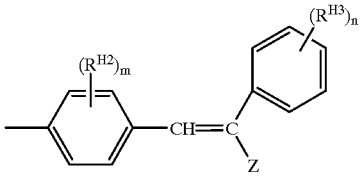

wherein, $R^{H2}$ is hydrogen atom, lower alkyl group or lower alkoxy group, $R^{H3}$ is hydrogen atom, halogen atom, or lower alkoxy group or lower alkyl group, Z is hydrogen atom, or aryl group optionally having substituents, and m and n are 0 or integers of 1 to 4.

Here, the electron transfer substance may contain at least one selected from the group consisting of compounds represented by the following general formula (ET1)

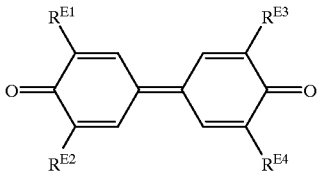

wherein, $R^{E1}$–$R^{E4}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, the substituents being halogen atom, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET2)

(ET2)

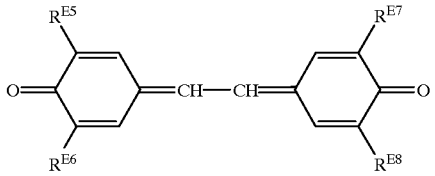

wherein $R^{E5}$–$R^{E8}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance contains at least one selected from the group consisting of compounds represented by the following general formula (ET3)

(ET3)

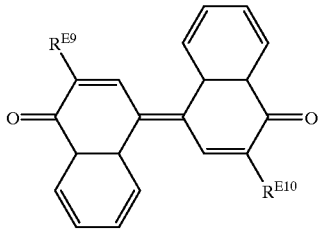

wherein $R^{E9}$ and $R^{E10}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET4)

(ET4)

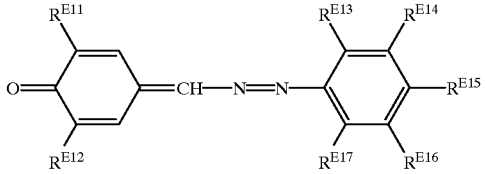

wherein $R^{E11}$ and $R^{E12}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, and $R^{E13}$–$R^{E17}$ are each independently hydrogen atom, halogen atom, alkyl group having 1 to 12 carbon atoms, alkoxy group having 1 to 12 carbon atoms, aryl group optionally having substituents, aralkyl group optionally having substituents, phenoxy group optionally having substituents or halogenated alkyl group, or two or more groups of $R^{E13}$–$R^{E17}$ may combine to form rings, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET5)

(ET5)

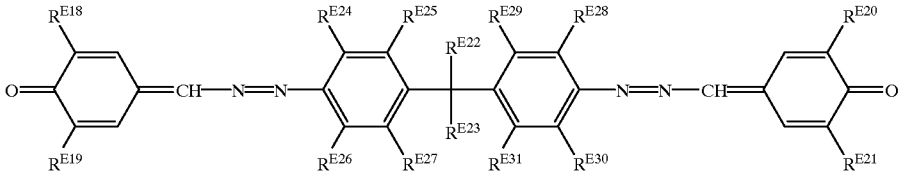

wherein $R^{E18}$–$R^{E21}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, $R^{E22}$ and $R^{E23}$ are each independently hydrogen atom, alkyl group having 1 to 12 carbon atoms or aryl group, and $E^{E24}$–$R^{E31}$ are each independently hydrogen atom, halogen atom, alkyl group having 1 to 12 carbon atoms, alkoxy group having 1 to 12 carbon atoms, aryl group optionally having substituents, or halogenated alkyl group, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET6)

(ET6)

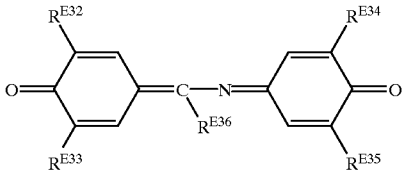

wherein, $R^{E32}$–$R^{E35}$ are each independently hydrogen atom, halogenatoms, cyanogroup, aminogroup, nitrogroup, alkyl group having 1 to 12 carbon atoms, alkoxy group having 1 to 12 carbon atoms, aryl group optionally having substituents, cycloalkyl group, aralkyl group optionally having substituents, or halogenated alkyl group, and $R^{E36}$ is a hydrogen atom, halogen atoms, cyano group, amino group, nitro group, benzoquinoneimine optionally having substituents, alkyl group having 1 to 12 carbon atoms, alkoxy group having 1 to 12 carbon atoms, aryl group optionally having substituents, cycloalkyl group, aralkyl group optionally having substituents, or halogenated alkyl group, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET7)

(ET7)

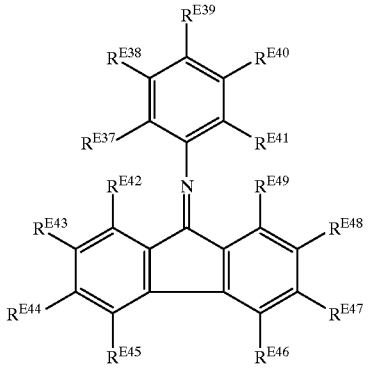

wherein $R^{E37}$–$R^{E41}$ are each independently hydrogen atom, halogen atoms, cyano group, nitro group, alkyl group having 1 to 12 carbon atoms, alkoxy group having 1 to 12 carbon atoms, aryl group optionally having substituents, an aralkyl group optionally having substituents, phenoxy group optionally having substituents, or halogenated alkyl group, and $R^{E42}$–$R^{E49}$ are hydrogen atom or nitro group, and at least three of them are nitro groups, the substituents being halogen atoms, alkyl group having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET8)

(ET8)

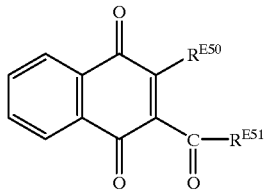

wherein $R^{E50}$ is alkyl group optionally having substituents or aryl group optionally having substituents, and $R^{E51}$ is alkyl group optionally having substituents, aryl group optionally having substituents, or the following formula (ET8a)

$$—O—R^{E52} \quad \text{(ET8a)}$$

wherein $R^{E52}$ is alkyl group optionally having substituents, or aryl group optionally having substituents, the substituents being halogen atoms, alkyl groups having 1 to 6 carbon atoms, alkoxy group having 1 to 6 carbon atoms, hydroxyl group, cyano group, amino group, nitro group, or halogenated alkyl group.

The electron transfer substance may contain at least one selected from the group consisting of compounds represented by the following general formula (ET9)

(ET9)

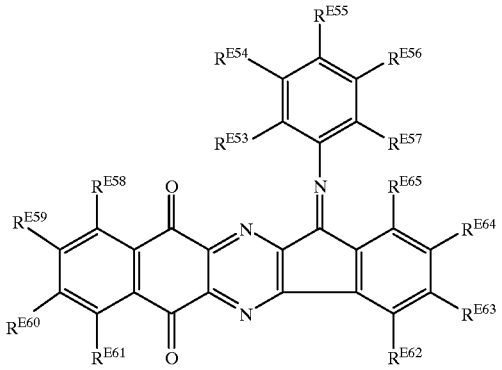

wherein $R^{E53}$–$R^{E65}$ are each independently hydrogen atom, alkyl group having 1 to 6 carbon atoms, alkoxy group having 1 to 6 carbon atoms, aryl group, aralkyl group, halogen atoms, or halogenated alkyl group.

The electron transfer substance may contain at least one selected from the group consisting of compounds represented by the following general formula (ET10)

(ET10)

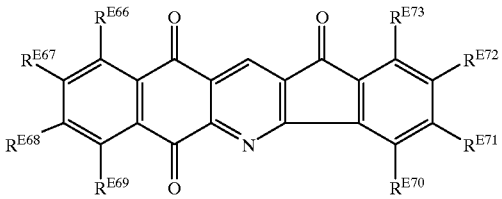

wherein $R^{E66}$–$R^{E73}$ are each independently hydrogen atom, alkyl group having 1 to 6 carbon atoms, alkoxy group having 1 to 6 carbon atoms, aryl group, aralkyl group, halogen atoms, or halogenated alkyl group.

The electron transfer substance may contain at least one selected from the group consisting of compounds represented by the following general formula (ET11)

(ET11)

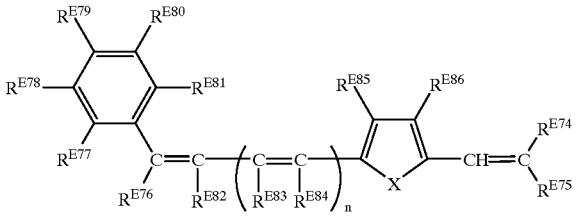

wherein $R^{E74}$and $R^{E75}$ are each independently cyano group, or alkoxycarbonyl group, $R^{E76}$ is hydrogen atom, alkyl group having 1 to 12 carbon atoms or aryl group optionally having substituents, $R^{E77}$–$R^{81}$ are each independently hydrogen atom, halogen atoms, alkyl group having 1 to 12 carbon atoms, alkoxy group, aryl group optionally having substituents, halogenated alkyl group, or alkylated amino group, $R^{E82}$–$R^{E84}$ are each independently hydrogen atom or alkyl group having 1 to 12 carbon atoms, $R^{E85}$ and $R^{E86}$ are each independently hydrogen atom, halogen atoms, alkyl group having 1 to 12 carbon atoms, or aryl group optionally having substituents, X is sulfur atom or oxygen atom, and n is 0 or 1, the substituents being halogen atoms, alkyl group having 1 to 6 carbon atoms, alkoxy group having 1 to 6 carbon atoms, hydroxyl group, cyano group, amino group, alkylated amino group, nitro group, or halogenated alkyl group.

The electron transfer substance may contain at least one selected from the group consisting of compounds represented by the following general formulas (ET12), (ET13) and (ET14)

(ET12)

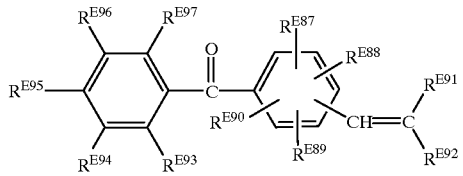

(ET13)

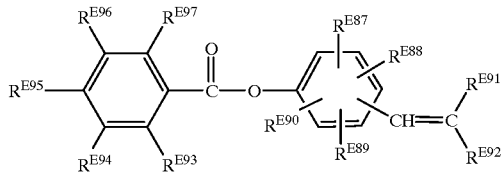

(ET14)

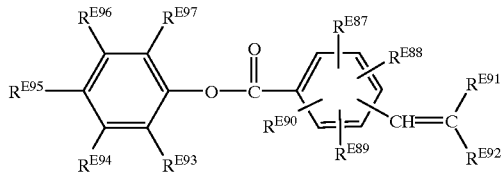

wherein $R^{E87}$–$R^{E90}$ are each independently hydrogen atom or halogen atoms, $R^{E91}$ and $R^{E92}$ are each independently cyano group, or alkoxycarbonyl group, and $R^{E93}$–$R^{E97}$ are each independently hydrogen atom, halogen atoms, alkyl group having 1 to 6 carbon atoms, nitro group, or cyano group.

The electron transfer substance may contain at least one selected from the group consisting of compounds represented by the following general formulas (ET15) and (ET16)

(ET15)

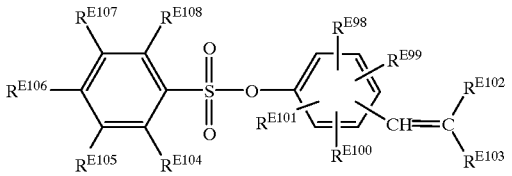

(ET16)

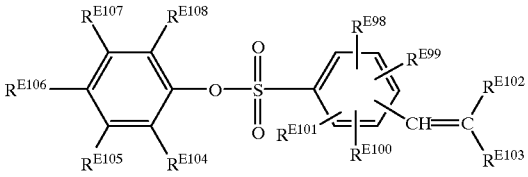

wherein $R^{E98}$ –$R^{E101}$ are each independently hydrogen atom or halogen atoms, $R^{E102}$ and $R^{E103}$ are each independently cyano group, or alkoxycarbonyl group, and $R^{104}$–$R^{E108}$ are each independently hydrogen atom, halogen atoms, alkyl group having 1 to 6 carbon atoms, nitro group, or cyano group.

The charge generating substance may be an X type metal-less phthalocyanine.

The binder resin may be polycarbonate containing as a repeating unit at least one selected from a group of consisting of compounds represented by the following general formula (BD1)

(BD1)

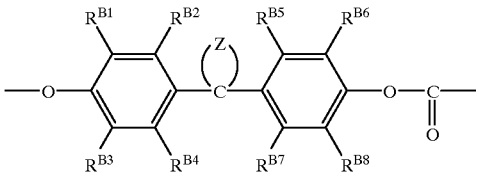

wherein $R^{B1}$–$R^{B8}$ is each independently hydrogen atom, alkyl group having 1 to 6 carbon atoms, aryl group optionally having substituents, cycloalkyl group, or halogen atoms, and Z is group of atoms required to form carbocycles optionally having substituents, the substituents being alkyl group having 1 to 6 carbon atoms, or halogen atoms.

The electrophotographic apparatus may carry out the charging process by a positive charging process.

Being used in an electrophotographic apparatus that may carry out the charging process by a positive charging process.

Though the precise mechanism of improvement of stability in repeated use of electric properties in positive charge is not known, the present invention was found to result in improvement of electrical characteristics and stability in repeated use from comparison of examples with comparative examples described later.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

Embodiments of electrophotographic photoconductors of the present invention are described below with reference to drawings.

Layer Construction

Figure 1:
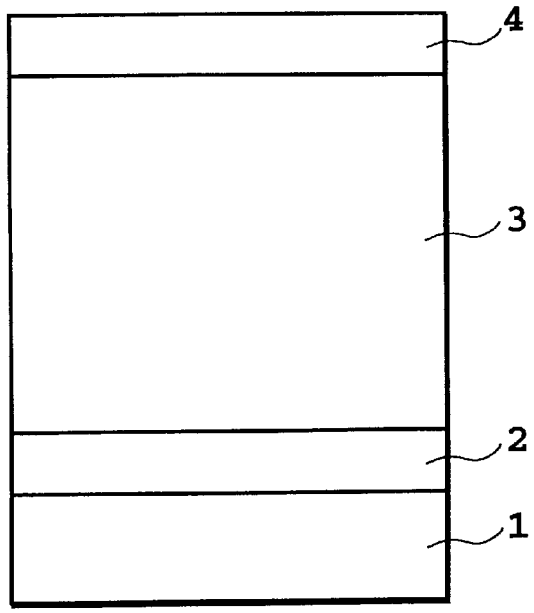
FIG. 1 is a schematic cross sectional view showing an example of the electrophotographic photoconductor of the present invention.

FIG. 1 is a schematic cross sectional view of an example of the electrophotographic photoconductor of the present invention, wherein 1 is an electroconductive substrate, 2 is an undercoat layer, 3 is a photosensitive layer, 4 is a protective layer. The undercoat layer 2 and the protective layer 4 may be provided if necessary. The photosensitive layer 3 in the present invention is a single layer type photosensitive layer having both charge generating and charge transfer functions in a layer.

Electroconductive Substrate 1

The electroconductive substrate 1 acts as an electrode for the photoconductor and at the same time as a supporter for other layers. The electroconductive substrate 1 may be in the form of cylinder, plate, or film. The material of the electroconductive substrate 1 may be metal such as aluminum, stainless steel, and nickel, or glass or resins surface-treated for electroconductivity.

Undercoat Layer 2

The undercoat layer 2 may be comprised if necessary and is a layer consisting mainly of resins or a film against oxidation such as alumite. This undercoat layer 2 may be comprised if necessary in order to the purpose such as prevention of unnecessary charge injection from electroconductive substrate 1 to photosensitive lays 3, coating of defects on the substrate surface, and improvement of adhesive property of the photosensitive layer 3.

The resin binder contained in the undercoat layer 2 can include, for example, polycarbonate resin, polyester resin, polyvinyl acetal resin, polyvinyl butyral resin, polyvinyl alcohol resin, vinyl chloride resin, vinyl acetate resin, polyethylene, polypropylene, polystyrene, acrylic resin, polyurethane resin, epoxy resin, melamine resin, silicon resin, silicone resin, polyamide resin, polystyrene resin, polyacetal resin, polyarylate resin, polysulfone resin, methacrylic acid ester polymer and their copolymers, and mixture of them. Also, mixtures of same group of resin with different molecular weights may be used.

The resin binder may contain metal oxides such as silicon oxide (silica), titanium oxide, zinc oxide, calcium oxide, aluminum oxide (alumina), and zirconium oxide, metal sulfates such as barium sulfate and calcium sulfate, fine particles of metal nitrides such as silicon nitride and aluminum nitride, organometallic compounds, silane coupling agents, and substances formed from organometallic compounds and silane coupling agents. Their content may be determined arbitrarily as far as formation of layers is possible.

In the case of undercoat layer 2 with resins as its main ingredients, hole transfer substances or electron transfer substances may be contained in undercoat layer 2 for the purpose of giving charge transfer property or reduction of charge trap. Contents of such hole transfer substances and electron transfer substances are 0.1–60% by weight, and preferably 5–40% by weight based on the solid contents of the undercoat layer 2. Further, other known additives may be contained optionally as far as they do not significantly damage the electrophotographic property.

The undercoat layer 2 may be used as a single layer or as a laminate of two or more of different kind of layers. The thickness of the undercoat layer 2 depends on the combination of ingredients, and it may be determined arbitrarily as far as detrimental effects such as increase in residual potential due to repeated continuous use may not occur. Preferably, the thickness of the under layer 2 is 0.1–10 $\mu$m.

Photosensitive Layer 3

The photosensitive layer 3 has a single layer structure comprised of a resin binder, a charge generating substance, a hole transfer substance and an electron transfer substance.

In the present invention, compounds of structural formula represented by the general formula (HT1) are used as hole transfer substances. Further, other hole transfer substances may be used together with the compounds (HT1), such as hydrazone compounds, pyrazoline compounds, pyrazolone compounds, oxadiazole compounds, oxazole compounds, arylamine compounds, benzidine compounds, stilbene compounds, styryl compounds, polyvinylcarbazole, and polysilane. These hole transfer substances may be used alone or in combination of two or more. Particular examples of compounds of structural formula represented by the general formula (HT1) include compounds of structural formula shown in (HT1-1)–(HT1-70) below. Further, particular examples of other hole transfer substances may include compounds of structural formula represented by (HT-1)–(HT-61) below, but the present invention is not limited by them. Furthermore, the content of hole transfer substances is 5–80% by weight, and preferably 10–60% by weight based on solid contents of the photosensitive layer 3. More than half of the hole transfer substances used are preferably compounds of structural formula represented by the general formula (HT1).

(HT1-1)

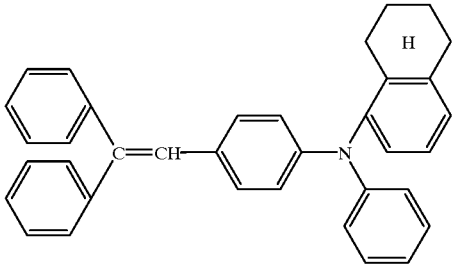

(HT1-2)

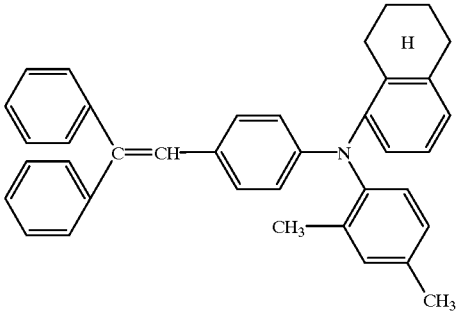

(HT1-3)

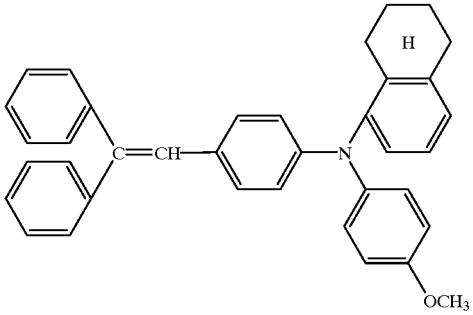

(HT1-4)

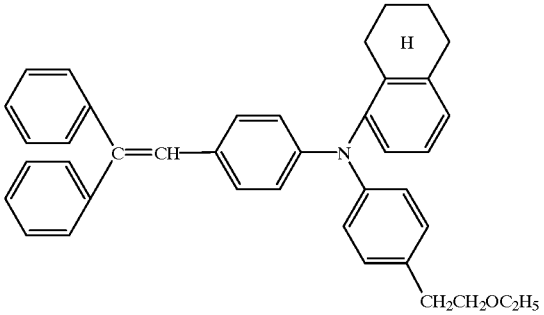

-continued
(HT1-5)
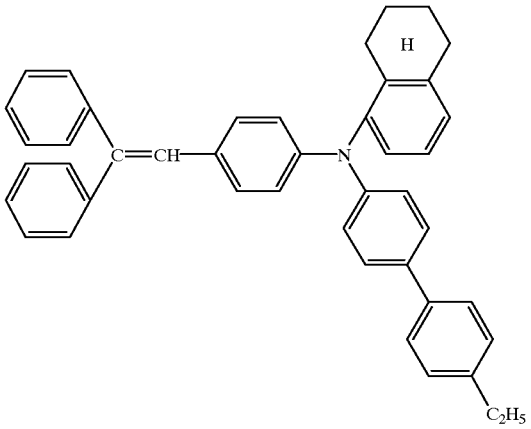
(HT1-6)
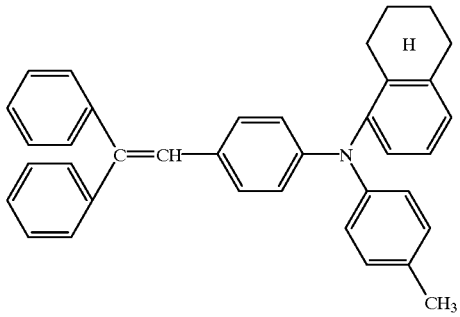
(HT1-7)
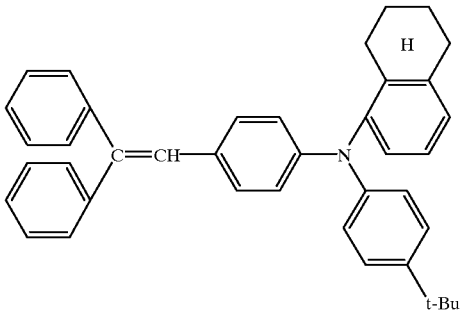
(HT1-8)
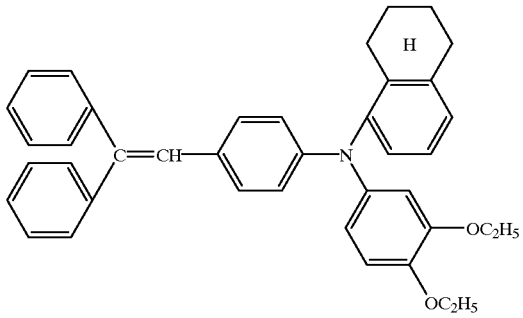
(HT1-9)
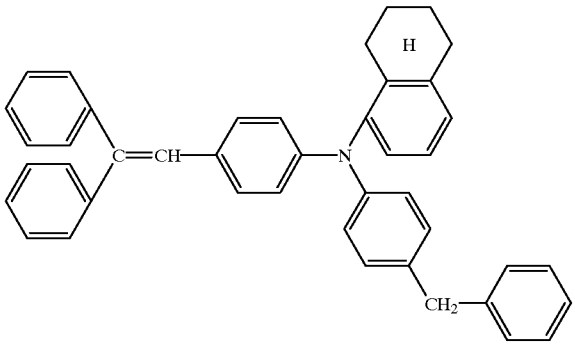
(HT1-10)
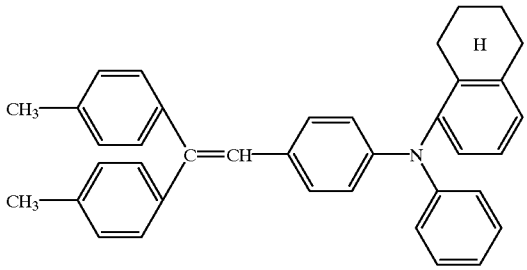
(HT1-11)
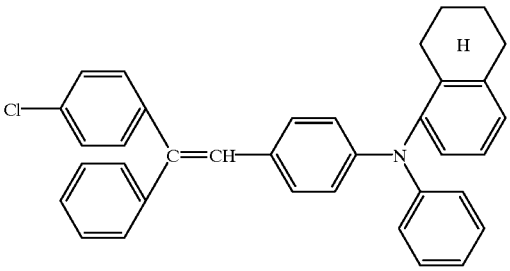

-continued
(HT1-12)
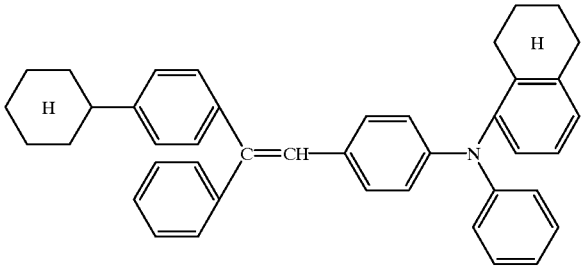
(HT1-13)
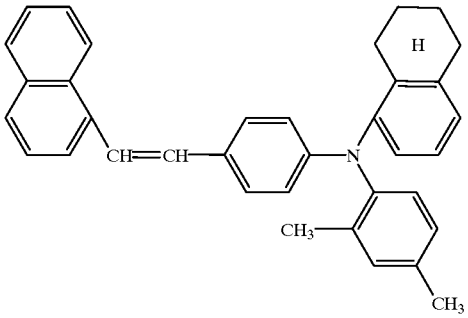
(HT1-14)
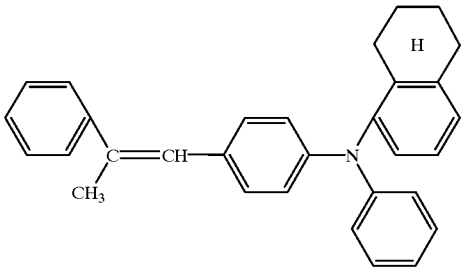
(HT1-15)
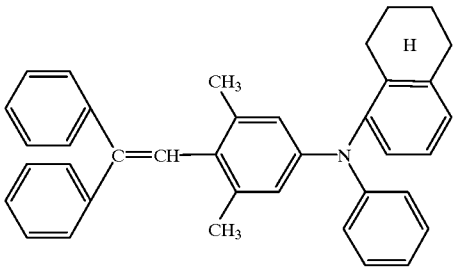
(HT1-16)
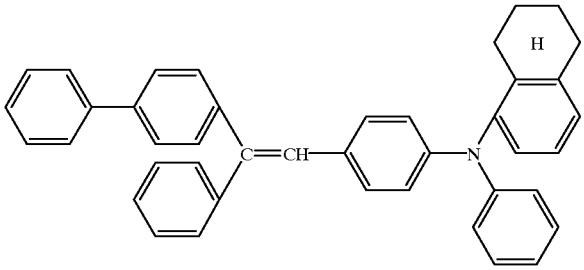
(HT1-17)
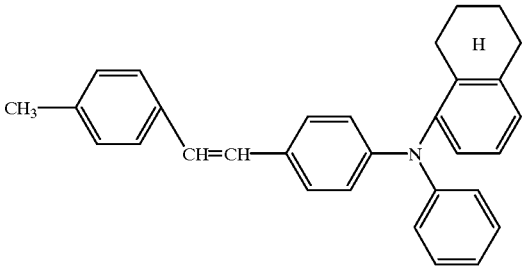

-continued
(HT1-18)
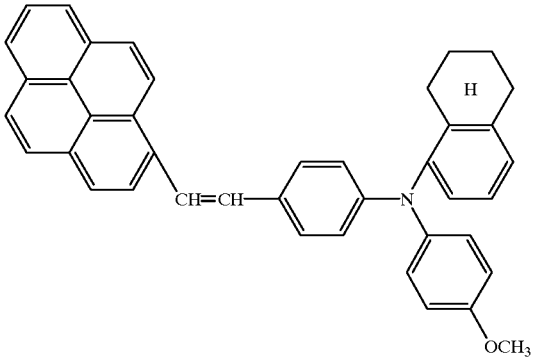
(HT1-19)
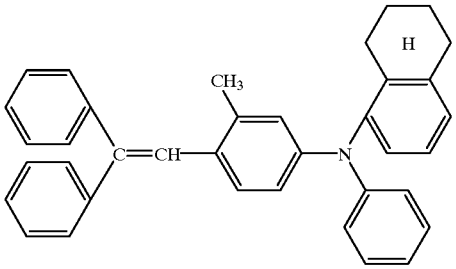
(HT1-20)
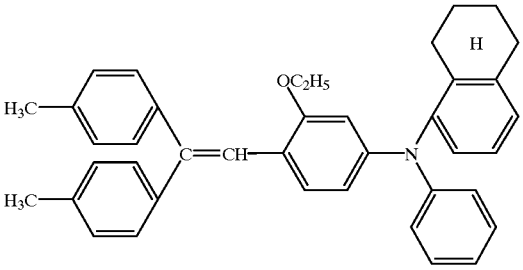
(HT1-21)
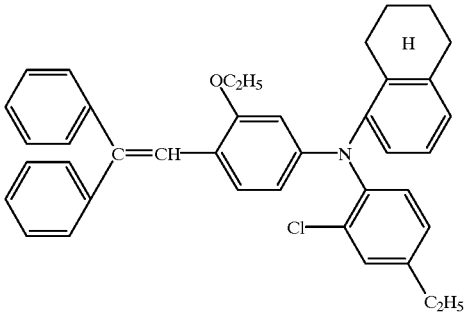
(HT1-22)
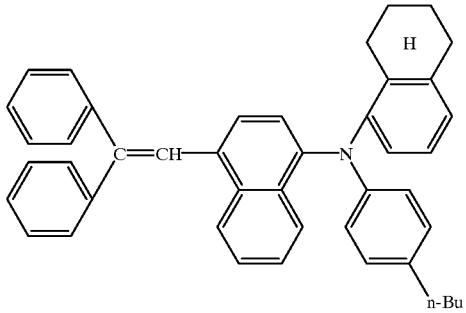
(HT1-23)
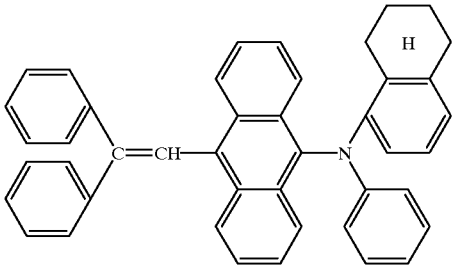
(HT1-24)
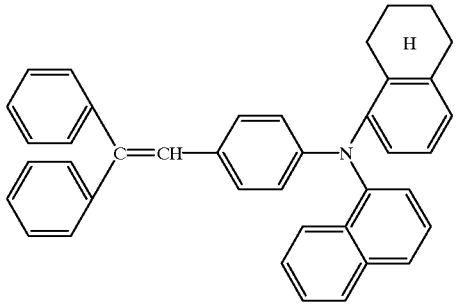

-continued
(HT1-25)
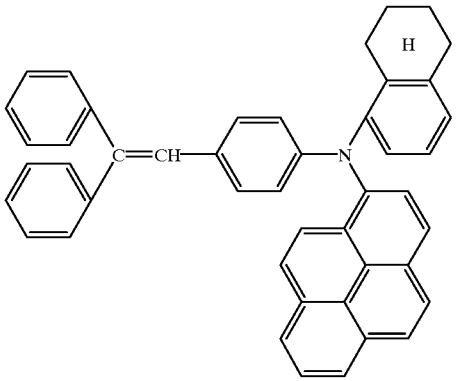
(HT1-26)
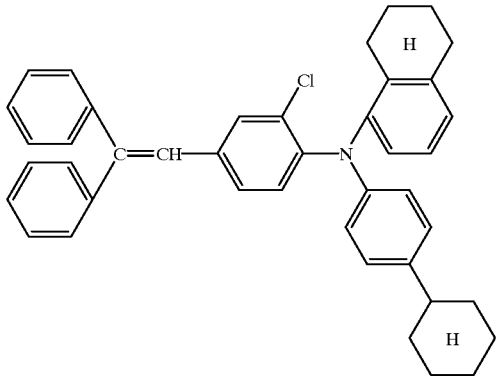
(HT1-27)
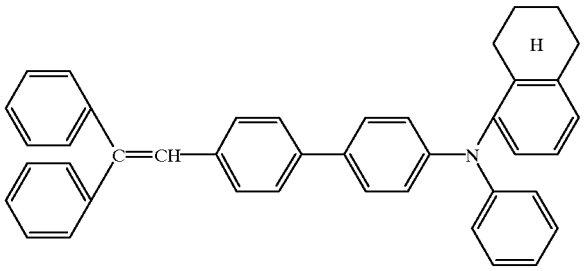
(HT1-28)
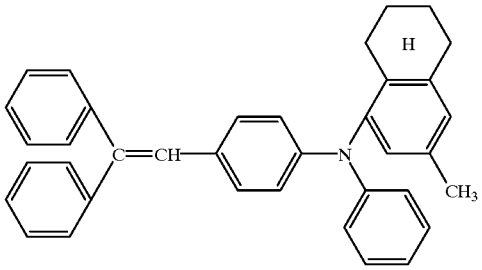
(HT1-29)
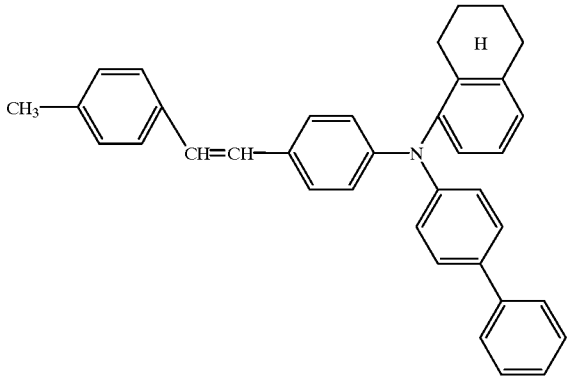
(HT1-30)
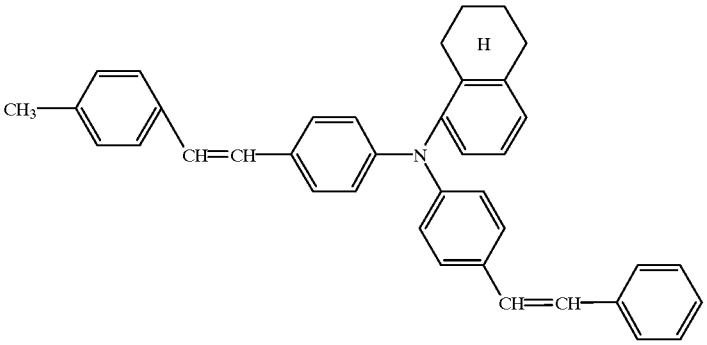

-continued
(HT1-31)
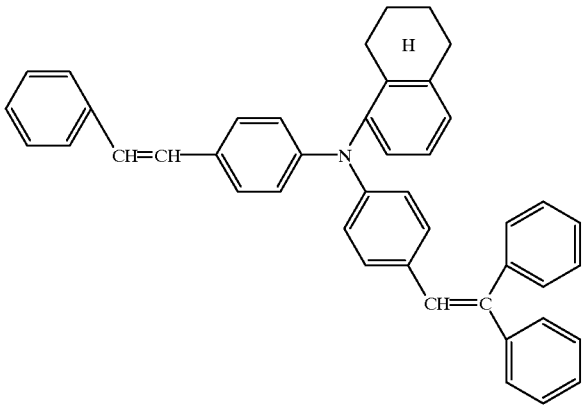
(HT1-32)
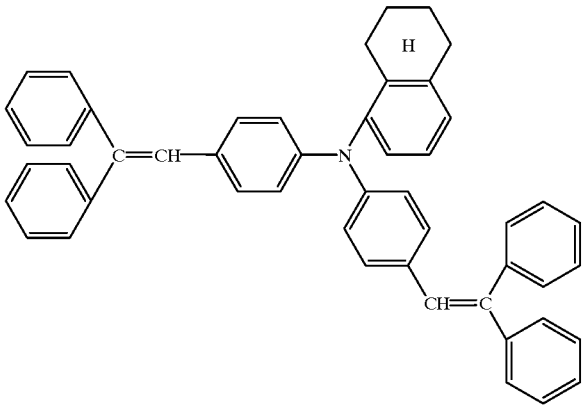
(HT1-33)
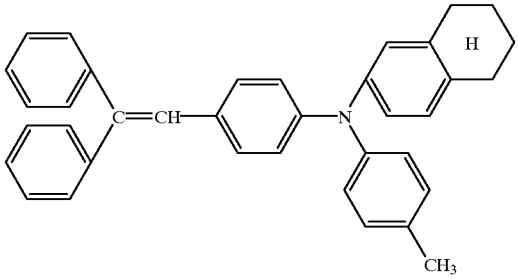
(HT1-34)
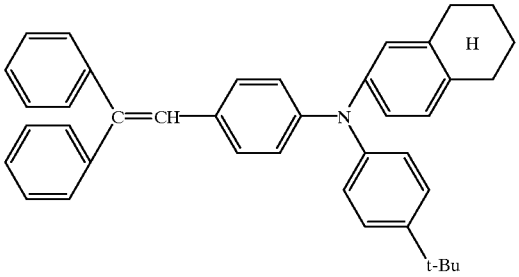
(HT1-35)
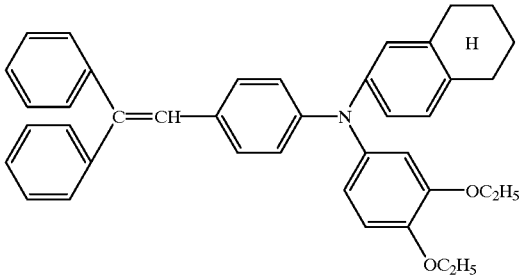

-continued
(HT1-36)
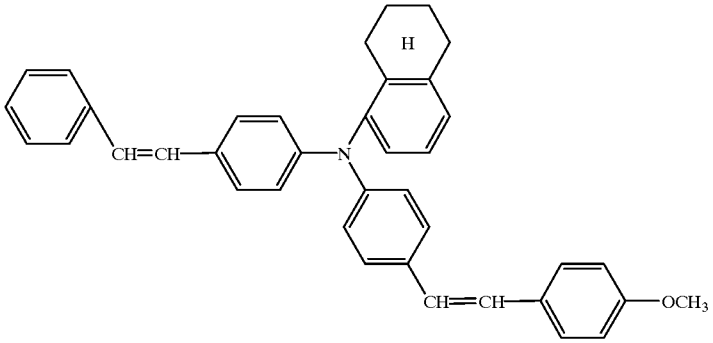
(HT1-37)
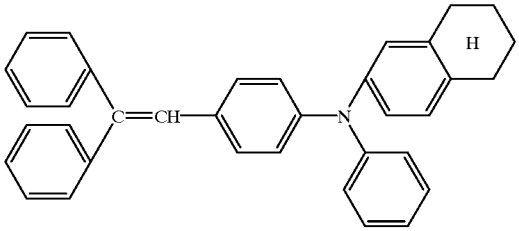
(HT1-38)
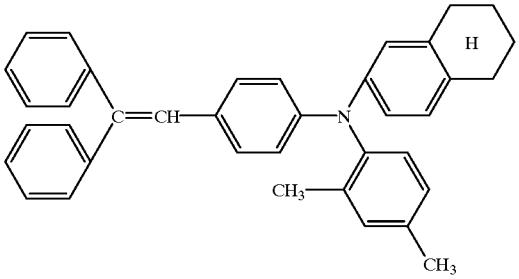
(HT1-39)
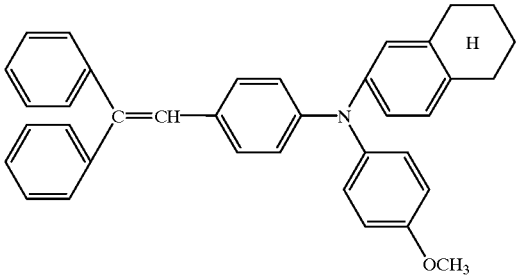
(HT1-40)
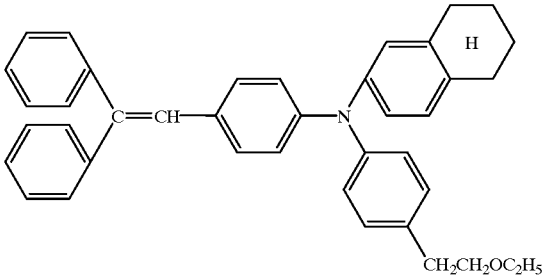
(HT1-41)
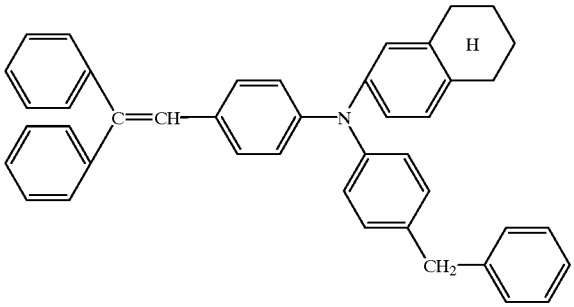
(HT1-42)
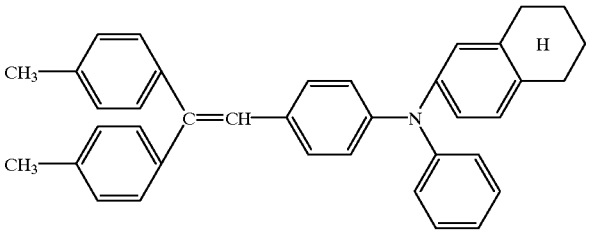

-continued
(HT1-43)
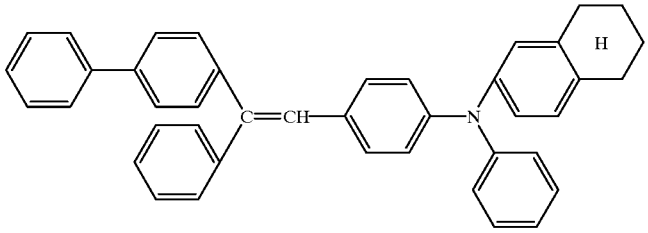
(HT1-44)
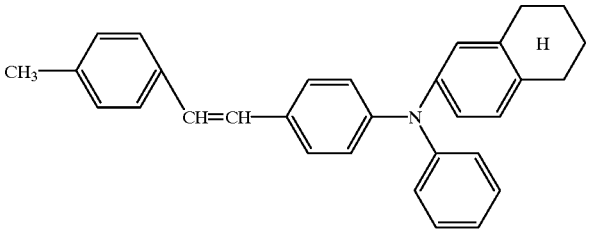
(HT1-45)
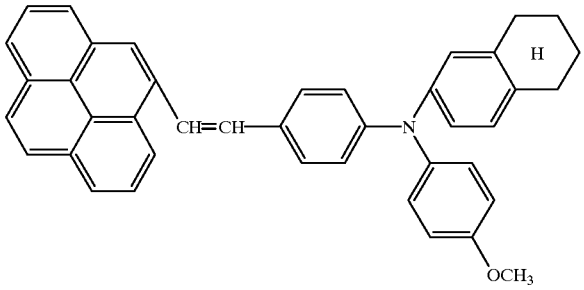
(HT1-46)
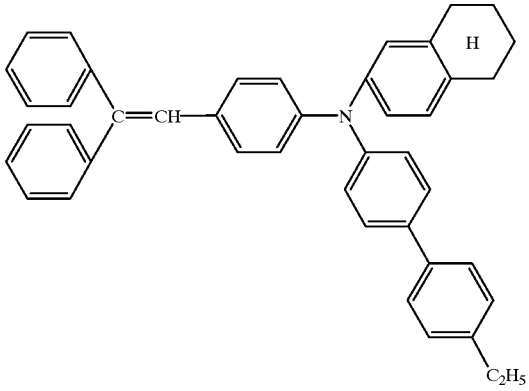
(HT1-47)
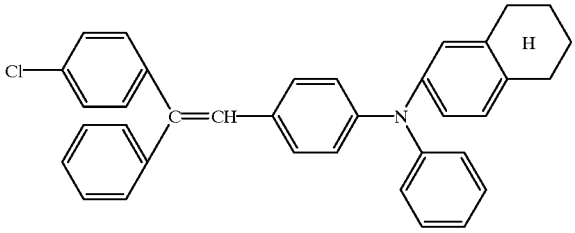

-continued
(HT1-48)
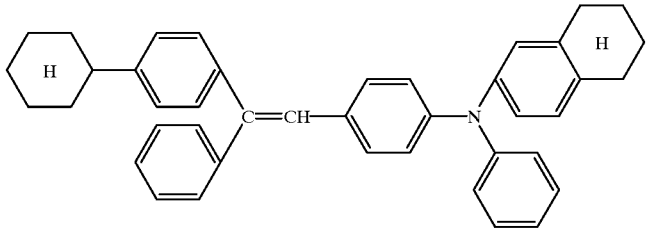
(HT1-49)
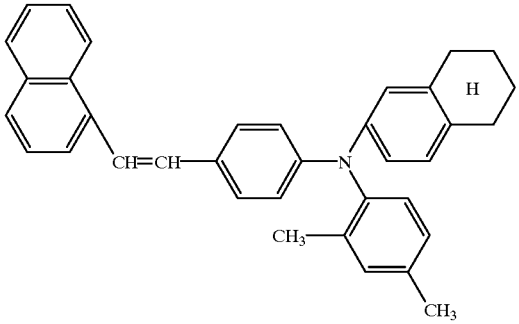
(HT1-50)
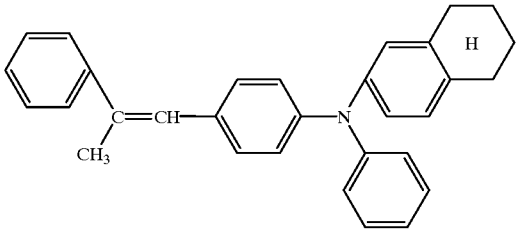
(HT1-51)
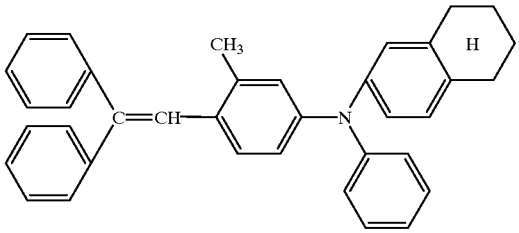
(HT1-52)
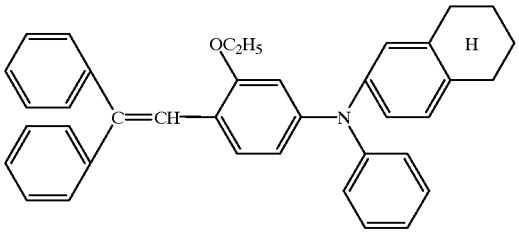
(HT1-53)
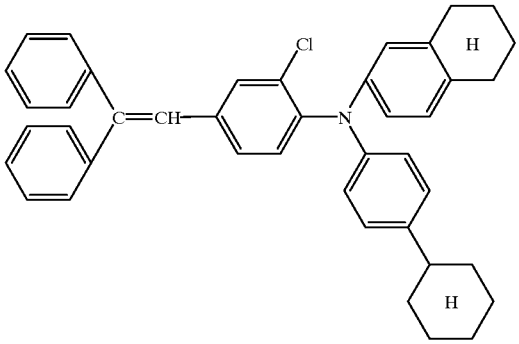
(HT1-54)
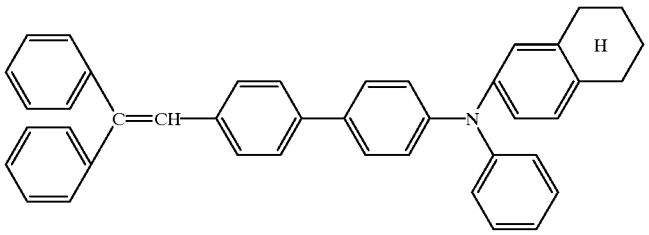

-continued
(HT1-55)
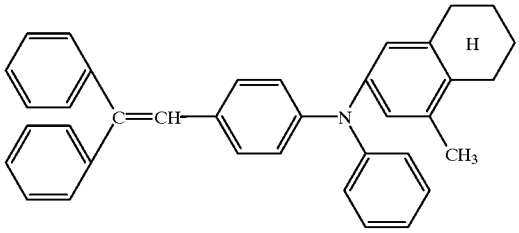
(HT1-56)
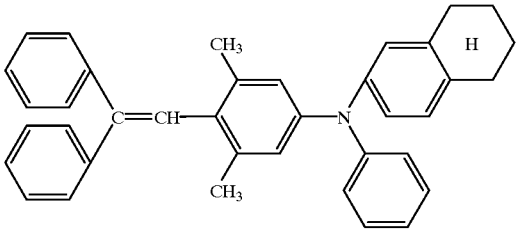
(HT1-57)
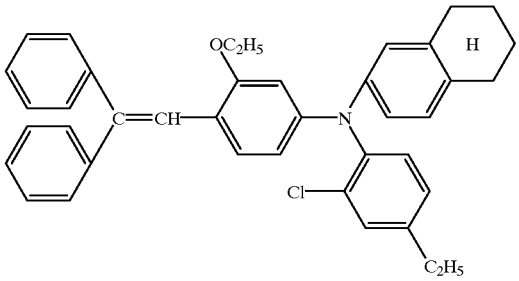
(HT1-58)
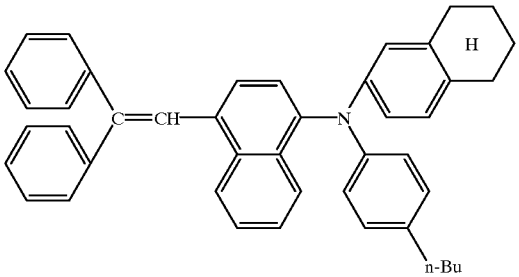
(HT1-59)
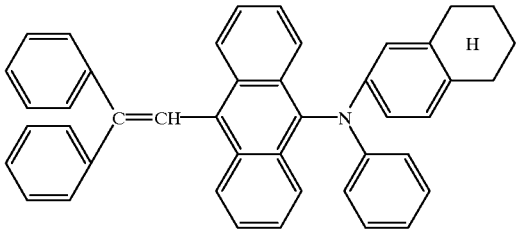
(HT1-60)
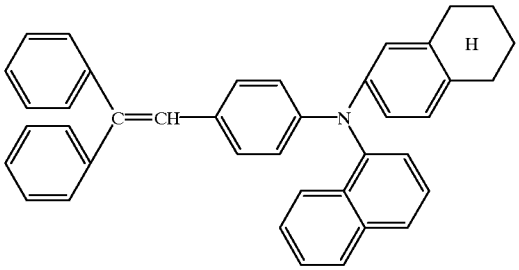
(HT1-61)
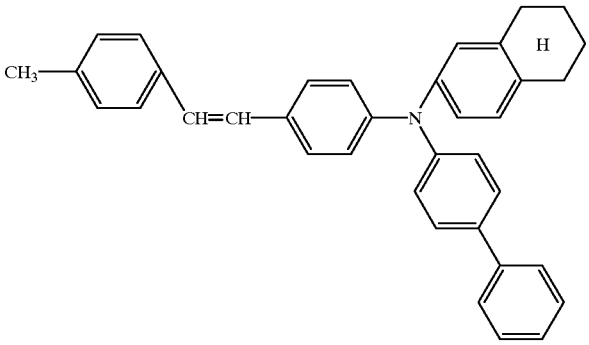
(HT1-62)
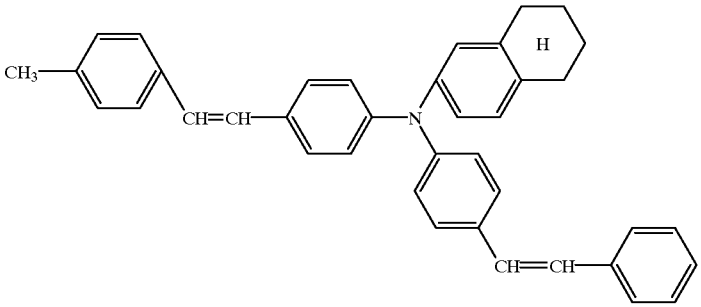

-continued
(HT1-63)
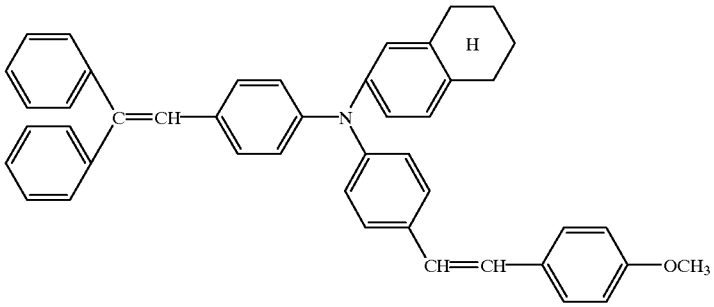
(HT1-64)
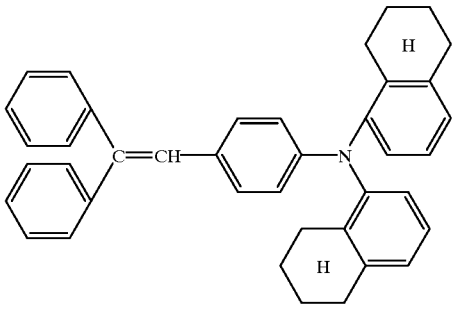
(HT1-65)
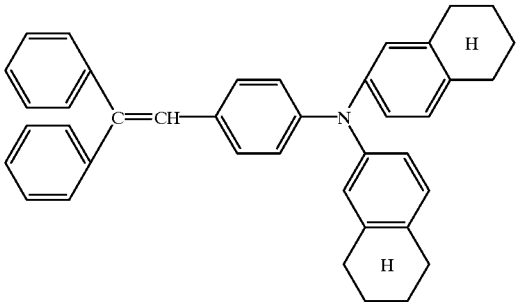
(HT1-66)
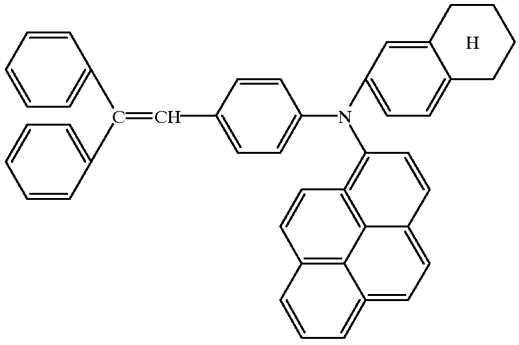
(HT1-67)
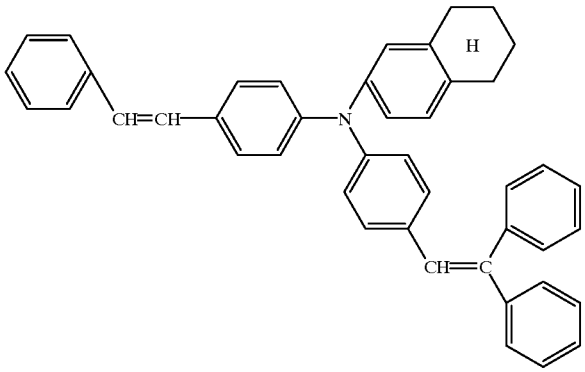

-continued
(HT1-68)
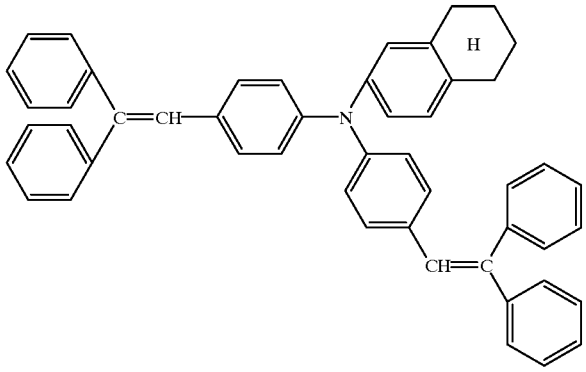
(HT1-69)
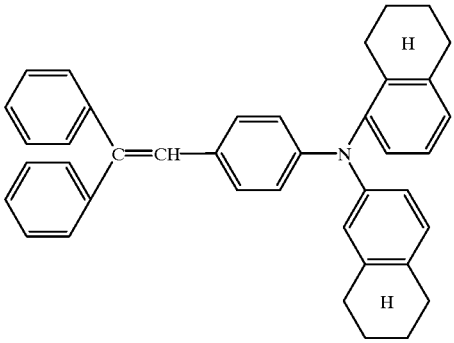
(HT1-70)
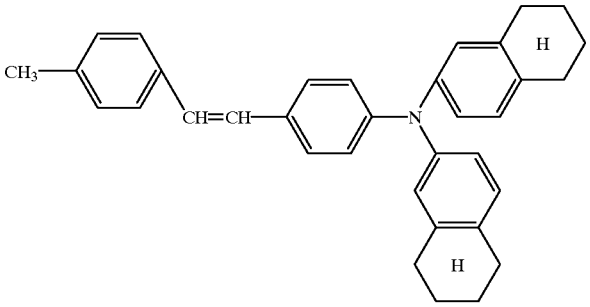
(HT-1)
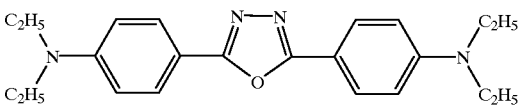
(HT-2)
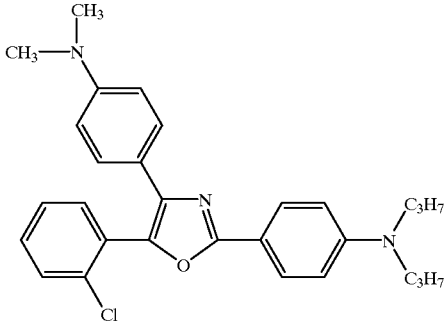
(HT-3)
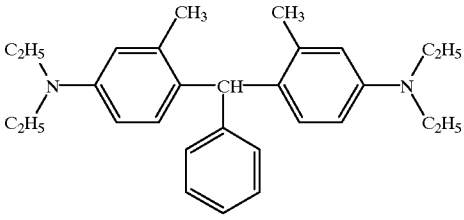
(HT-4)
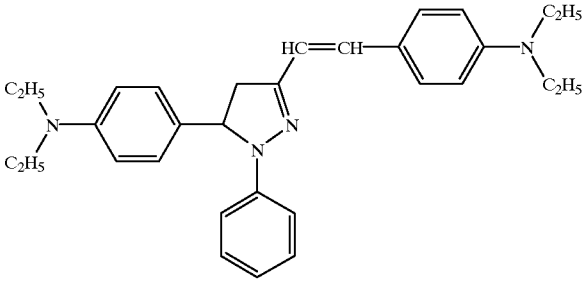
(HT-5)
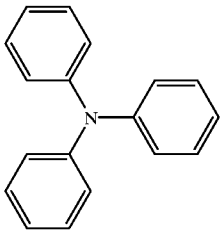

-continued
(HT-6)
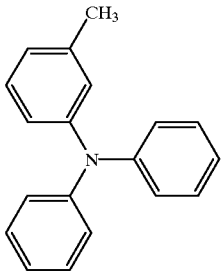
(HT-7)
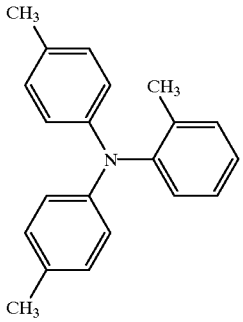
(HT-8)
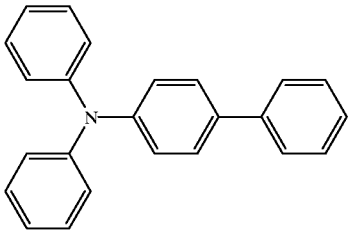
(HT-9)
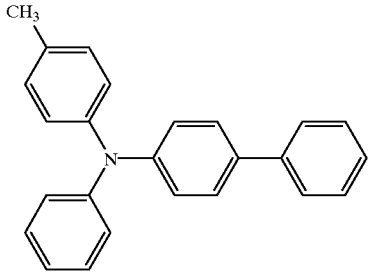
(HT-10)
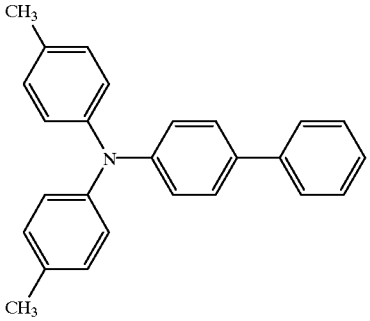
(HT-11)
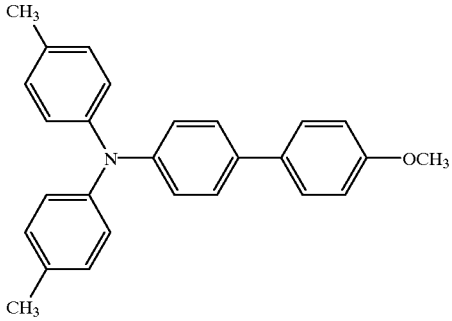
(HT-12)
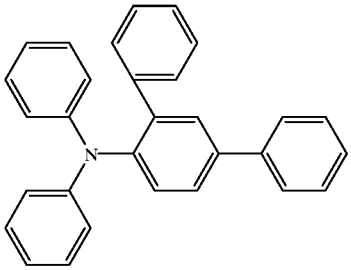
(HT-13)
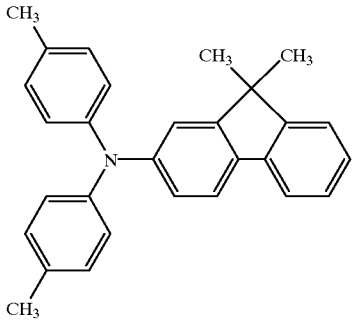
(HT-14)
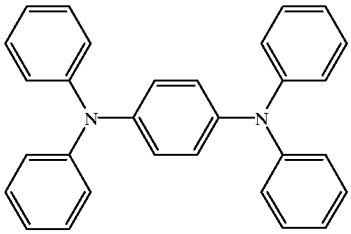
(HT-15)
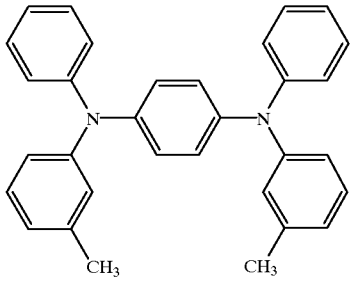

-continued
(HT-16)
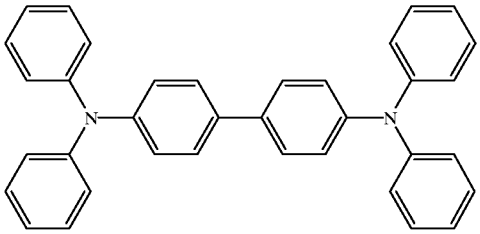
(HT-17)
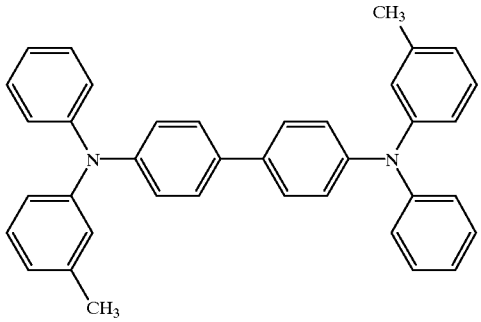
(HT-18)
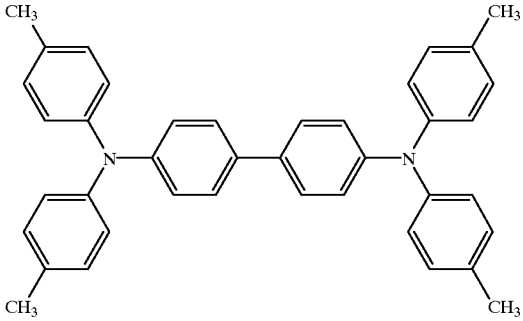
(HT-19)
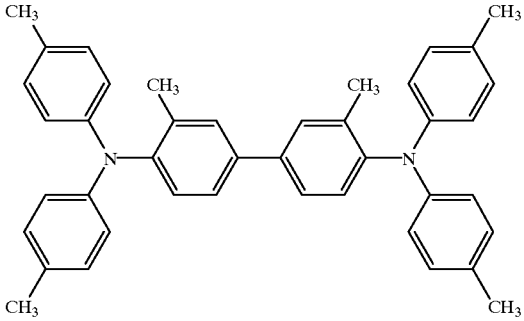
(HT-20)
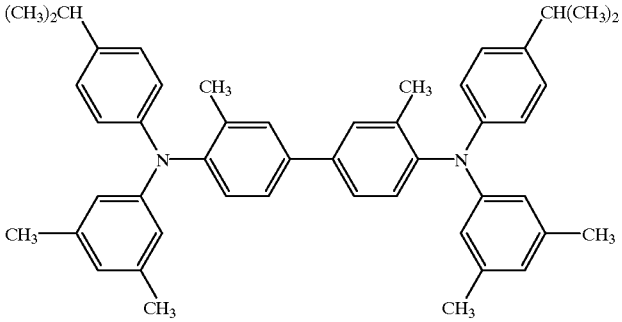
(HT-21)
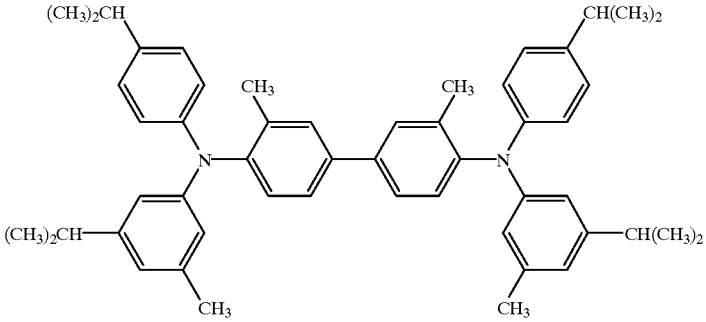

-continued
(HT-22)
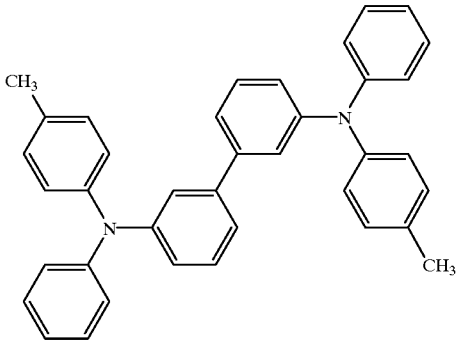
(HT-23)
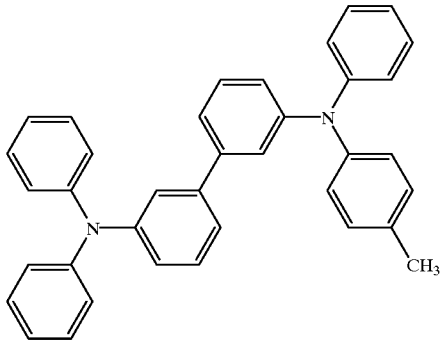
(HT-24)
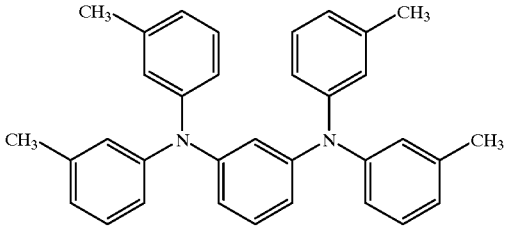
(HT-25)
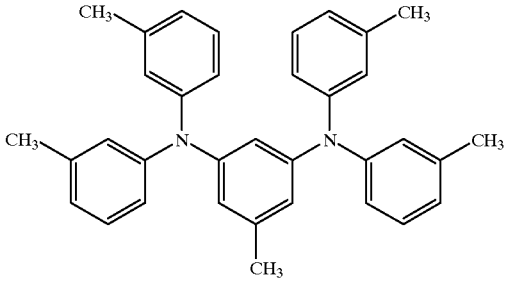
(HT-26)
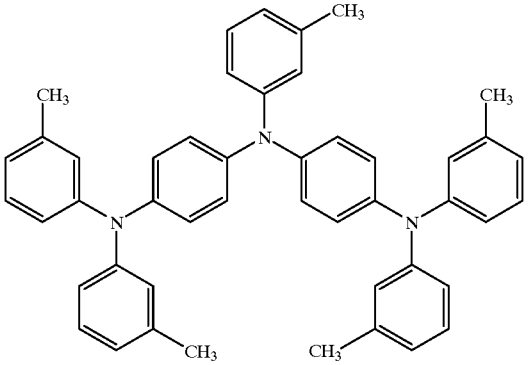
(HT-27)
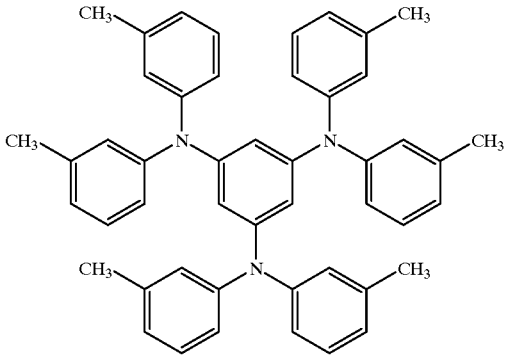
(HT-28)
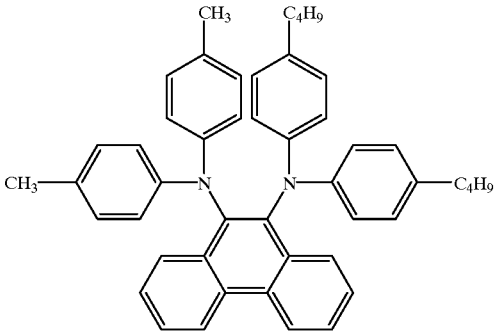
(HT-29)
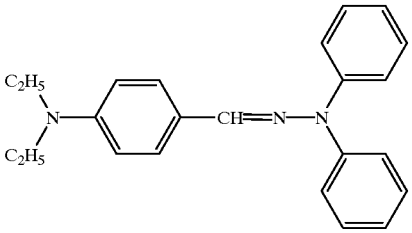

-continued
(HT-30)
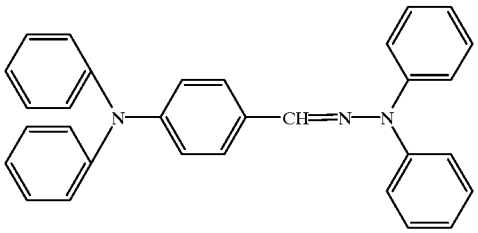
(HT-31)
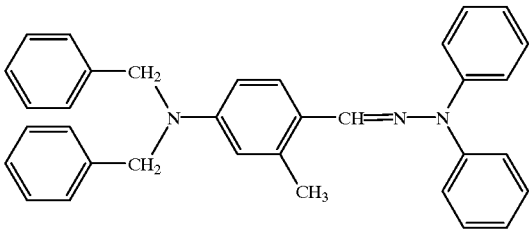
(HT-32)
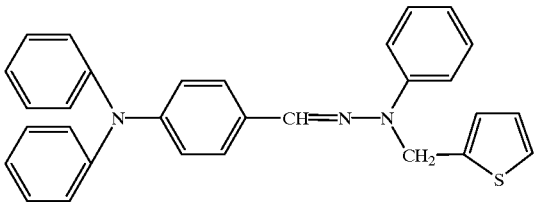
(HT-33)
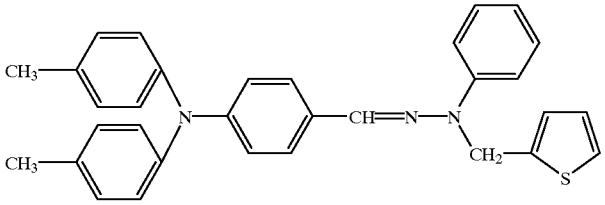
(HT-34)
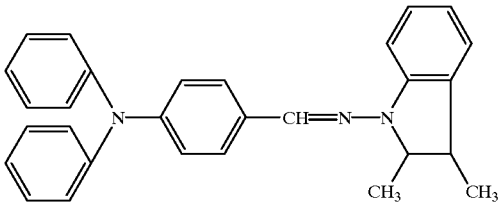
(HT-35)
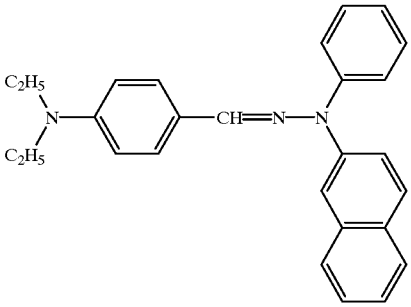
(HT-36)
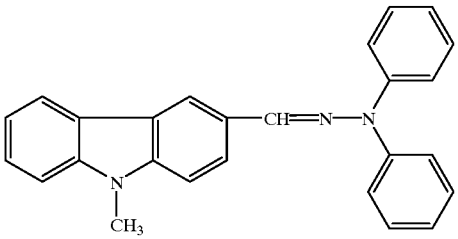
(HT-37)
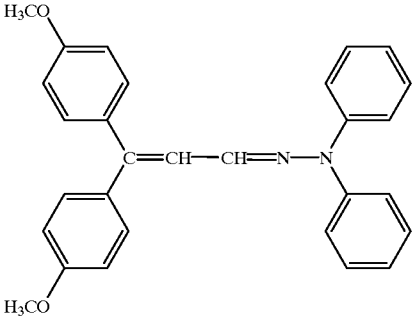

-continued
(HT-38)
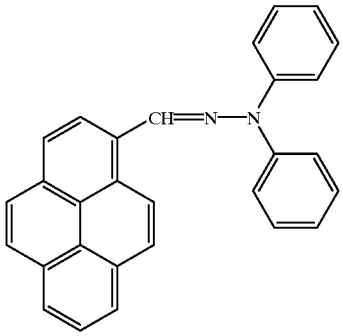
(HT-39)
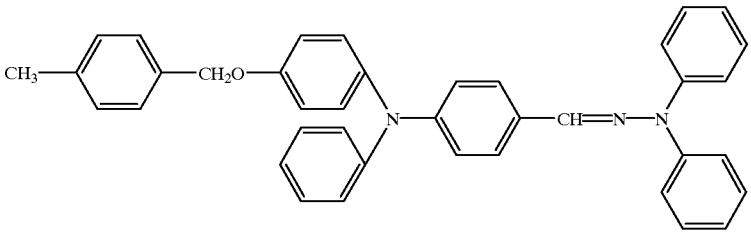
(HT-40)
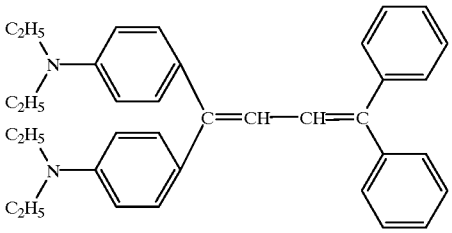
(HT-41)
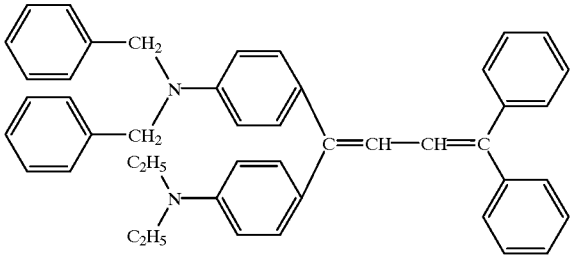
(HT-42)
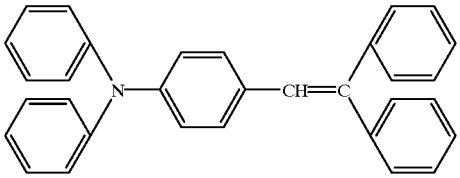
(HT-43)
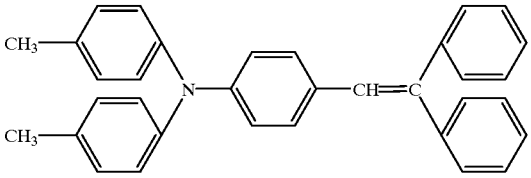
(HT-44)
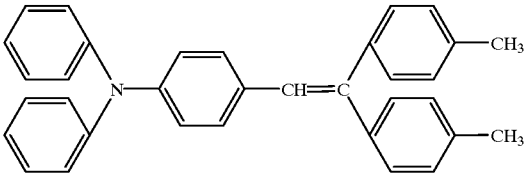
(HT-45)
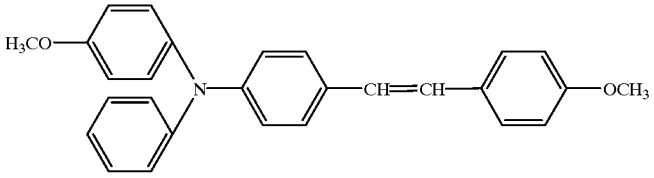

-continued
(HT-46)
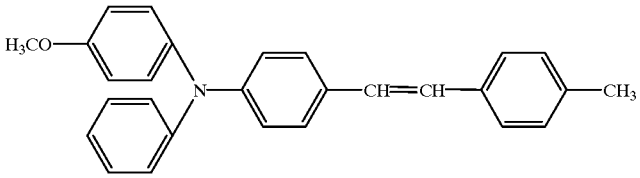
(HT-47)
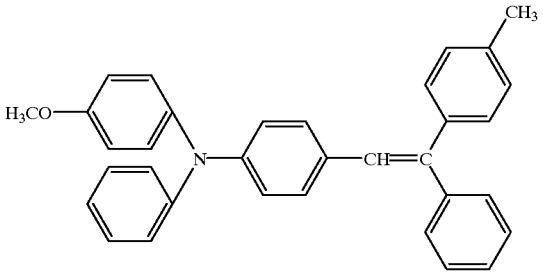
(HT-48)
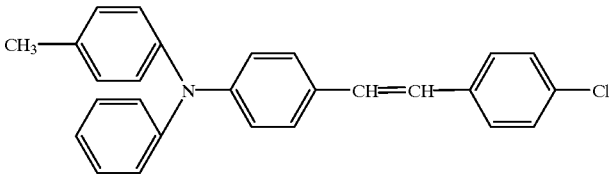
(HT-49)
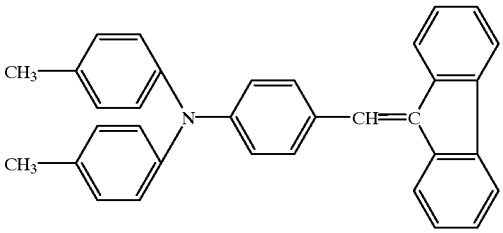
(HT-50)
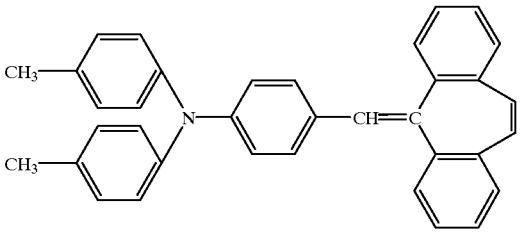
(HT-51)
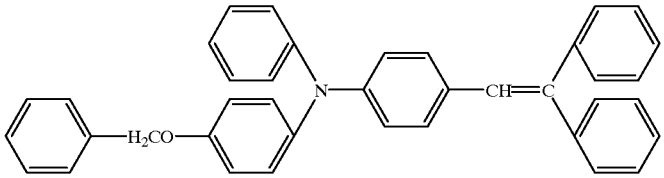
(HT-52)
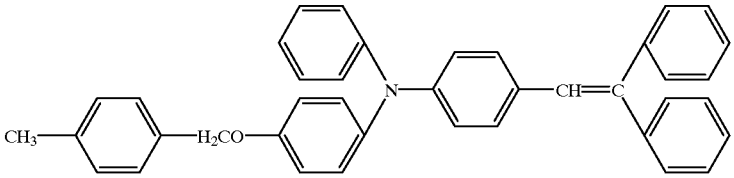

-continued
(HT-53)
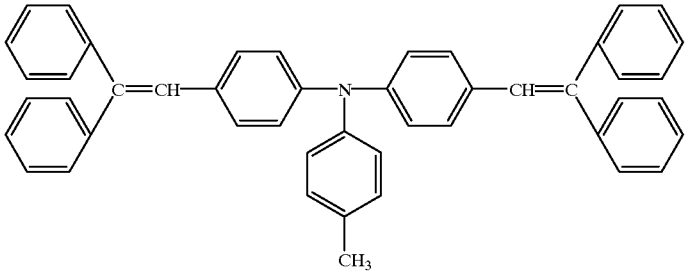
(HT-54)
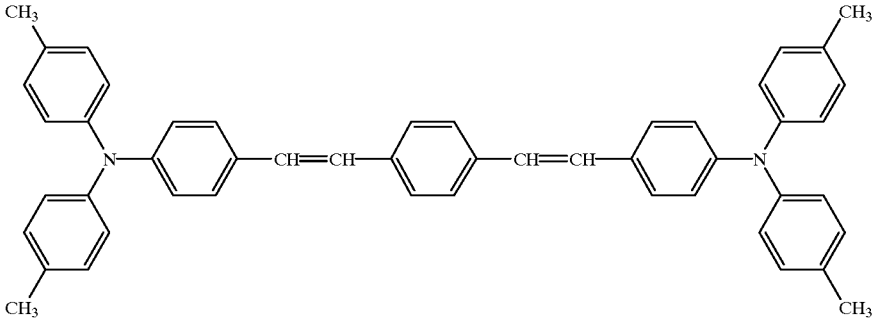
(HT-55)
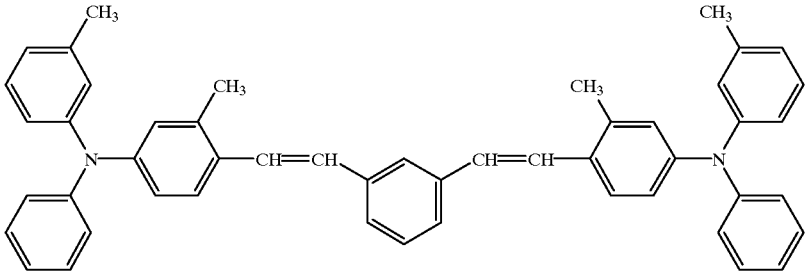
(HT-56)
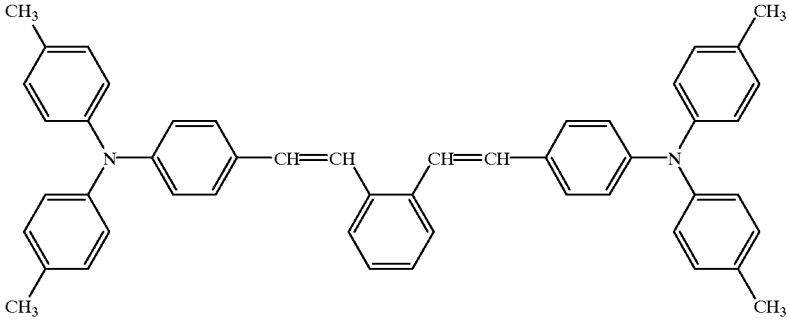

-continued (HT-57)

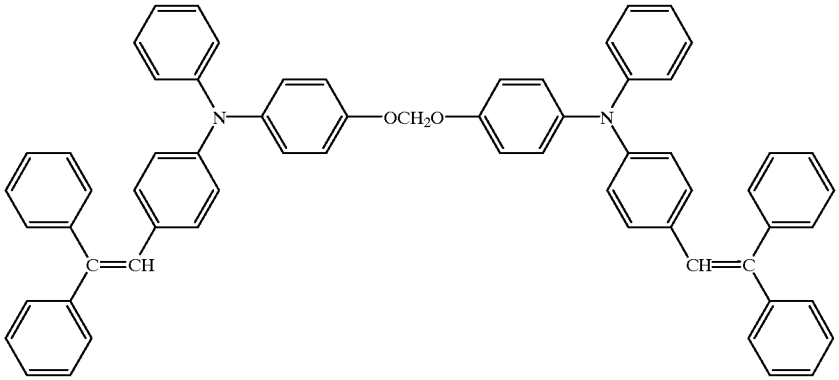

(HT-58)

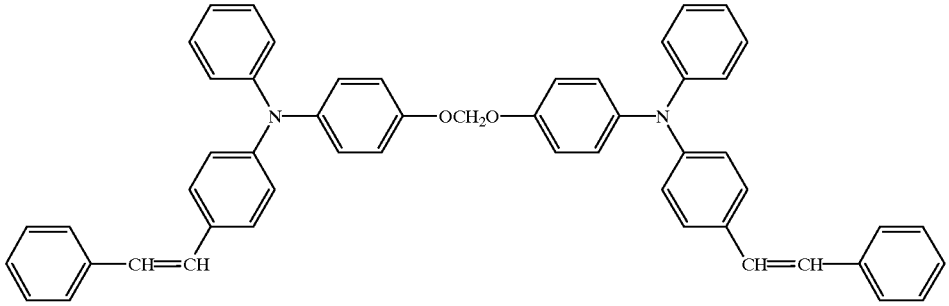

(HT-59)

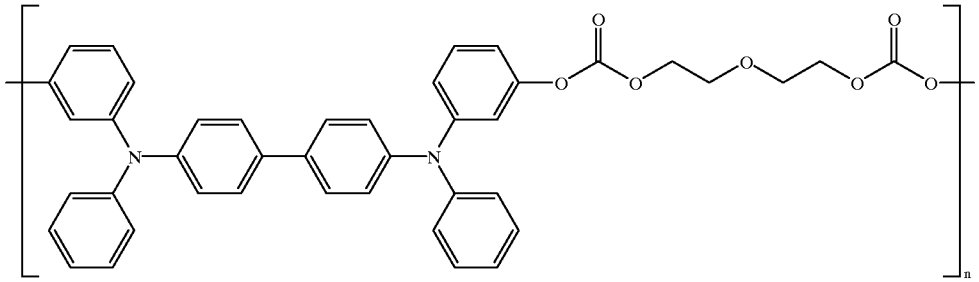

(HT-60)

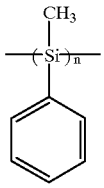

(HT-61)

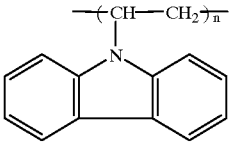

Compounds represented by the general formula (ET1)–(ET16) are suitable as electron transfer substances. Besides, electron transfer substances (acceptor compounds) may be used, such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyrane compounds, quinone compounds, benzoquinone compounds, diphenoquinone compounds, naphthoquinone compounds, anthraquinone compounds, diiminoquinone compounds and stilbenequinone compounds. These electron transfer substances may be used alone or in combination of two or more of them. Particular examples of compounds represented by the general formula (ET1)–(ET16) may include compounds of structural formula represented by following (ET1-1)–(ET16-16). Other particular examples of electron transfer substances may include compounds of structural formula represented by following (ET-1)–(ET-42), but they do not limit the present invention. The content of the electron transfer substances is 1–50% by weight, and preferably 5–40% by weight based on solid contents of the photosensitive layer 3.

(ET1-1)
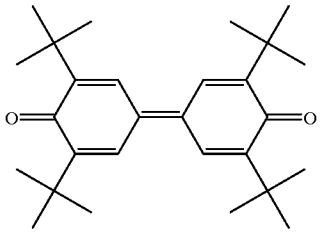
(ET1-2)
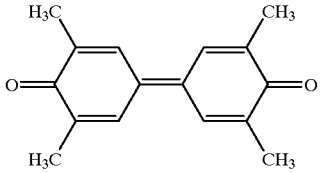
(ET1-3)
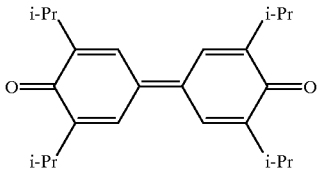
(ET1-4)
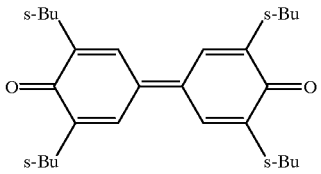
(ET1-5)
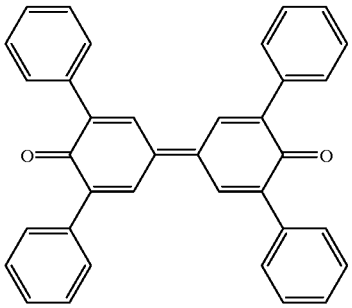
(ET1-6)
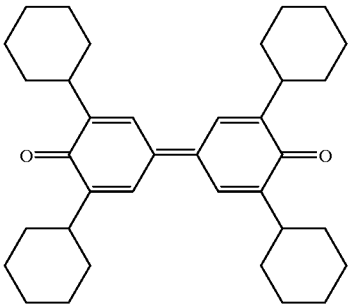
(ET1-7)
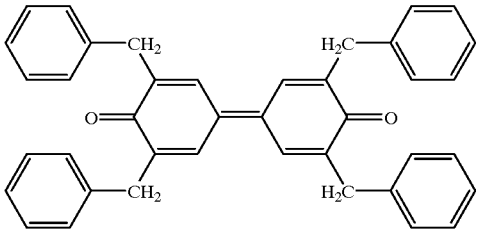
(ET1-8)
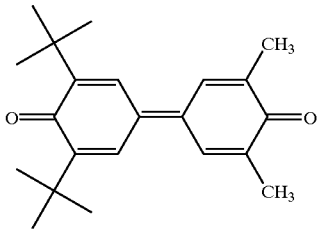
(ET1-9)
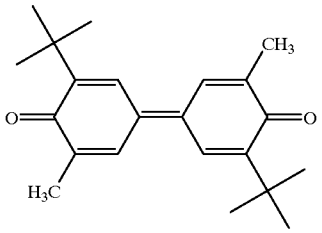
(ET1-10)
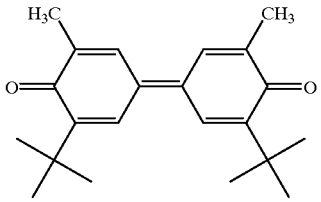
(ET1-11)
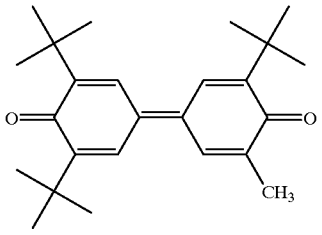
(ET1-12)
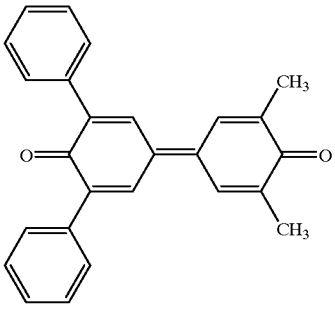

-continued
(ET1-13)
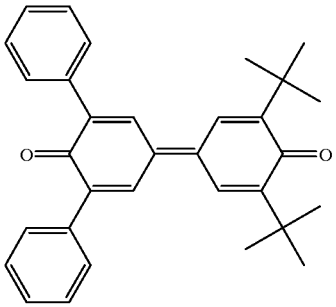
(ET1-14)
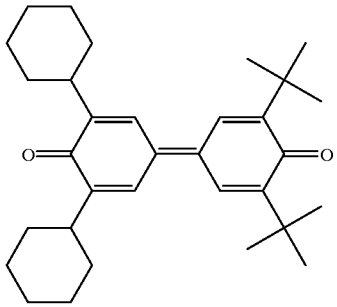
(ET1-15)
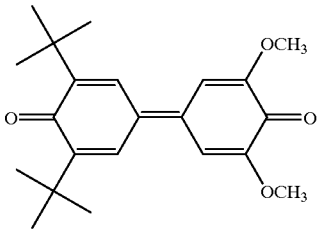
(ET1-16)
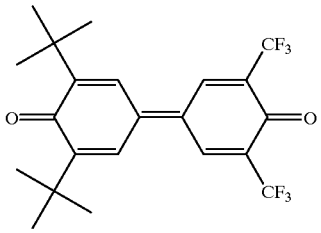
(ET2-1)
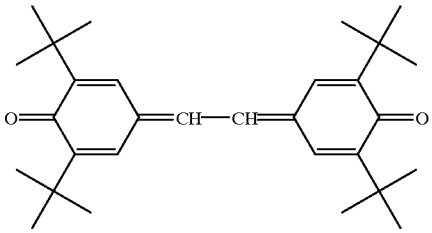
(ET2-2)
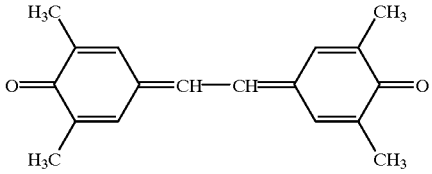
(ET2-3)
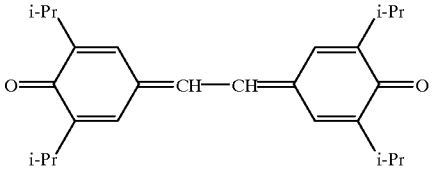
(ET2-4)
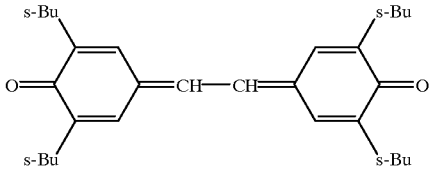
(ET2-5)
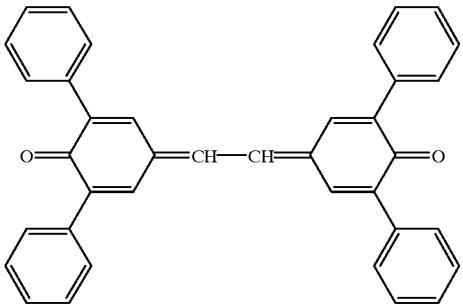
(ET2-6)
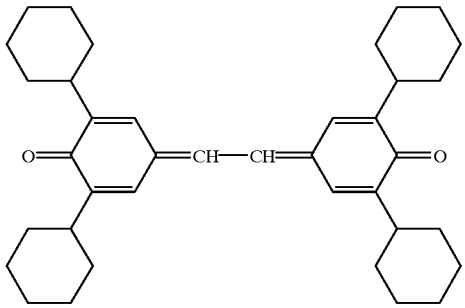
(ET2-7)
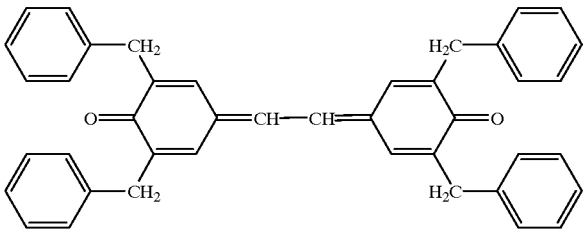
(ET2-8)
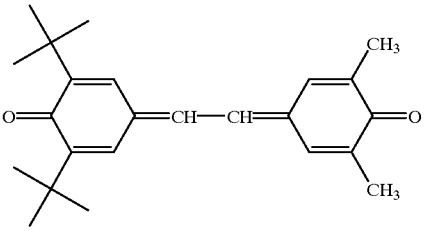

-continued
(ET2-9)
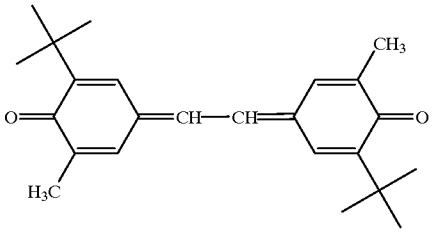
(ET2-10)
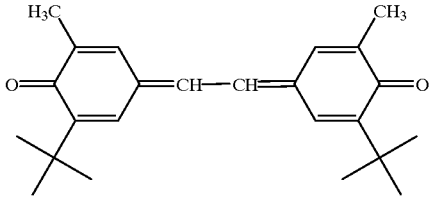
(ET2-11)
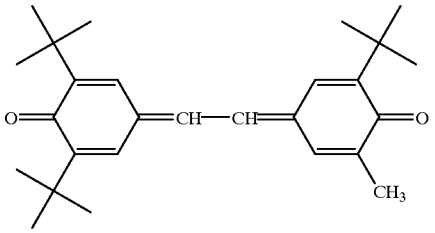
(ET2-12)
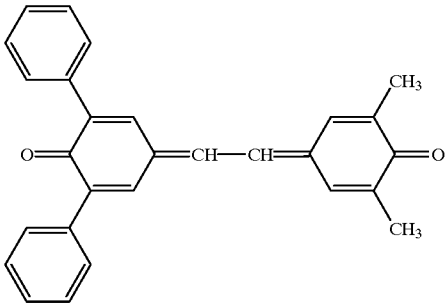
(ET2-13)
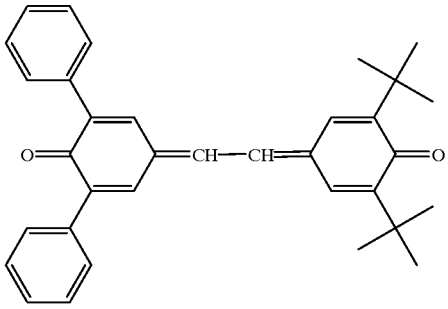
(ET2-14)
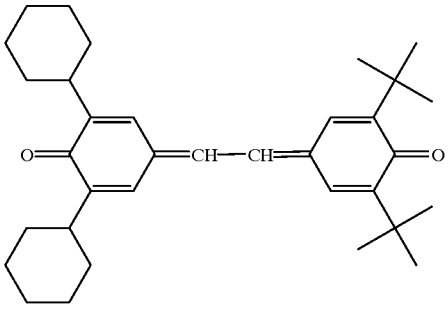
(ET2-15)
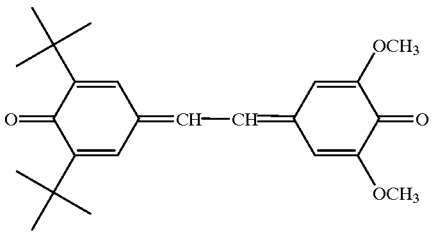
(ET2-16)
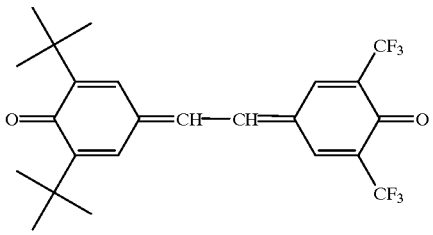
(ET3-1)
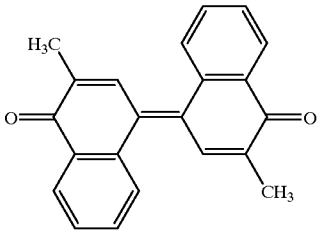
(ET3-2)
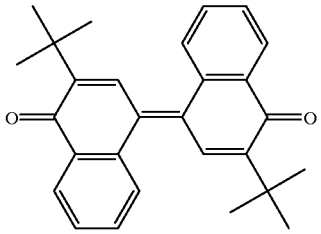

-continued
(ET3-3)
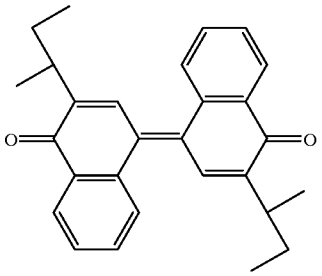
(ET3-4)
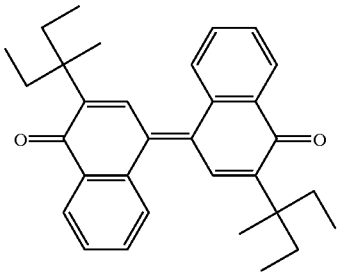
(ET3-5)
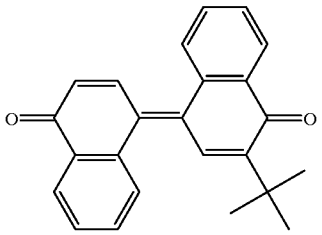
(ET3-6)
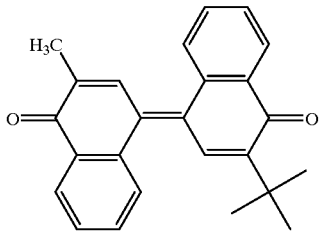
(ET3-7)
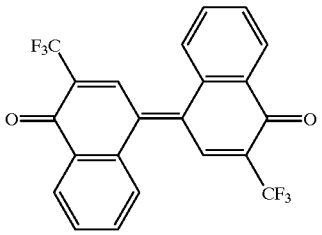
(ET3-8)
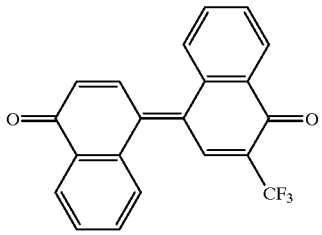
(ET3-9)
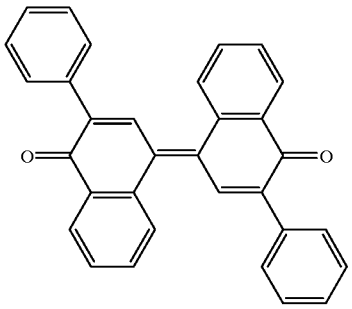
(ET3-10)
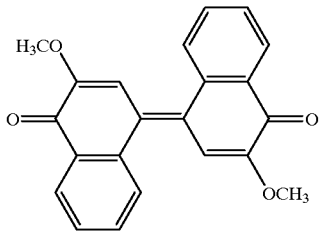
(ET3-11)
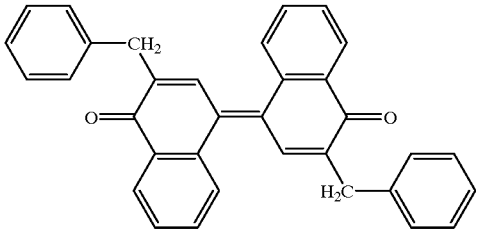
(ET3-12)
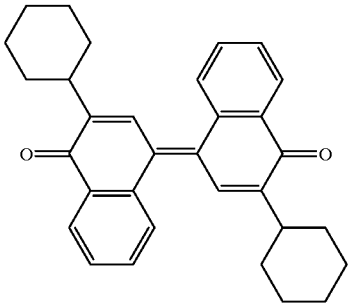

-continued
(ET4-1)
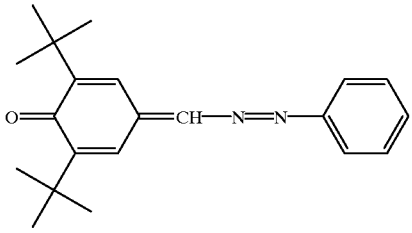
(ET4-2)
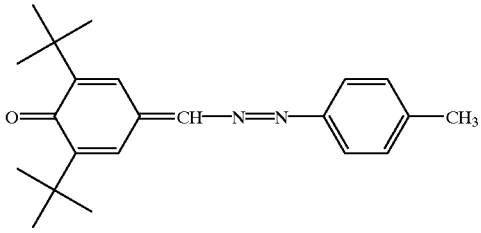
(ET4-3)
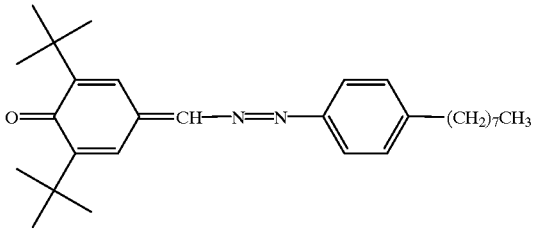
(ET4-4)
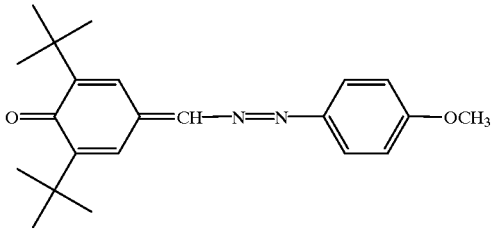
(ET4-5)
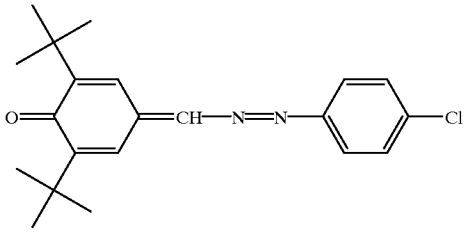
(ET4-6)
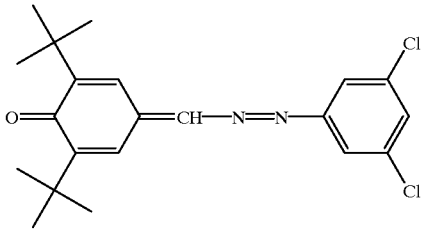
(ET4-7)
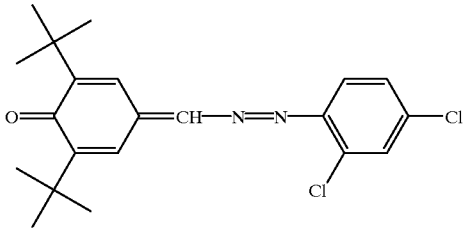
(ET4-8)
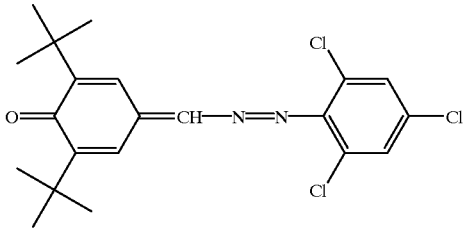
(ET4-9)
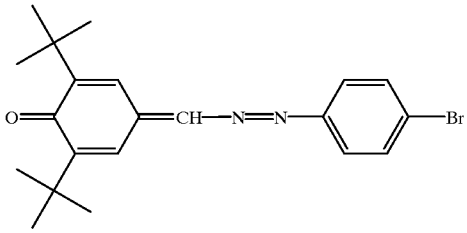
(ET4-10)
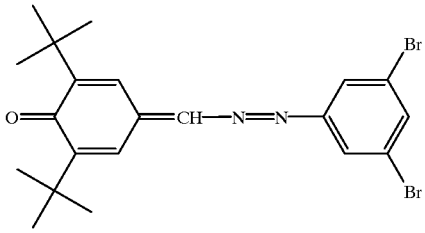
(ET4-11)
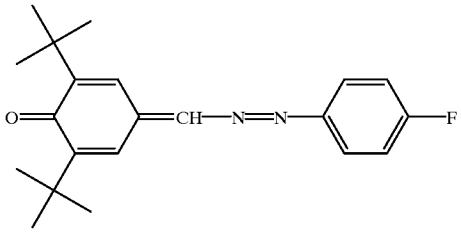
(ET4-12)
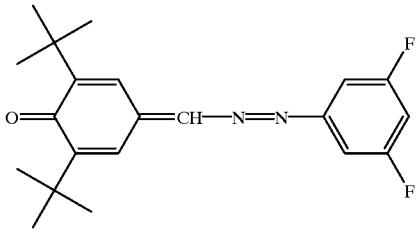

-continued
(ET4-13)
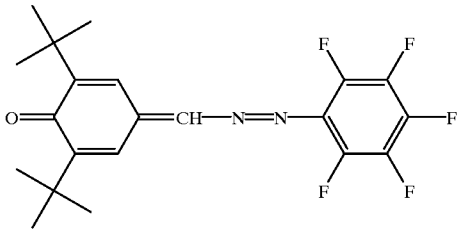
(ET4-14)
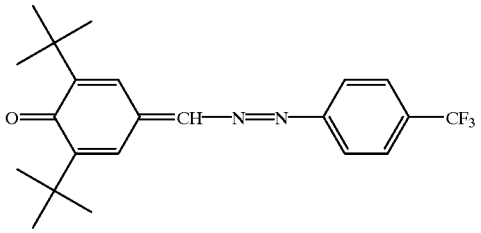
(ET4-15)
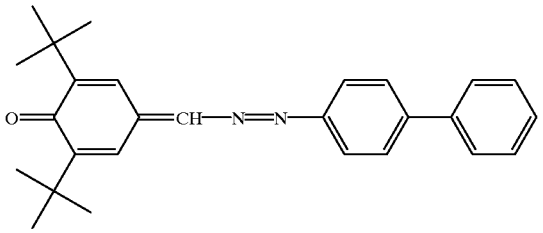
(ET4-16)
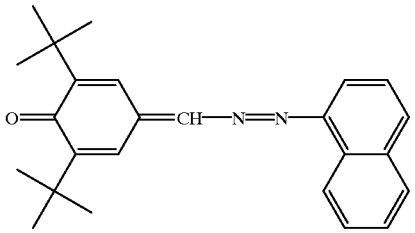
(ET4-17)
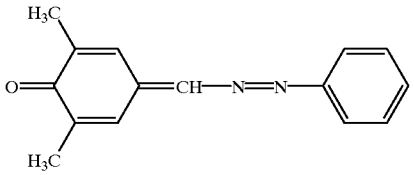
(ET4-18)
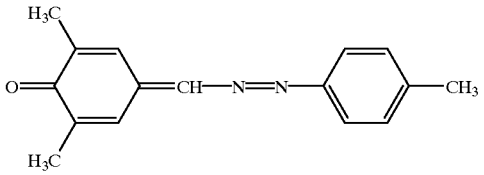
(ET4-19)
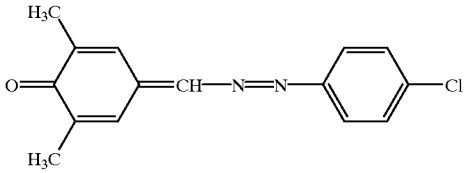
(ET4-20)
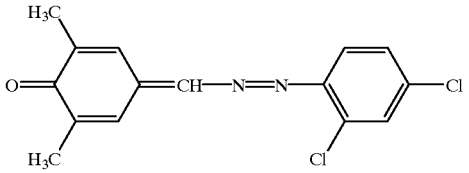
(ET4-21)
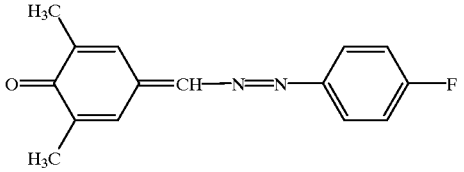
(ET4-22)
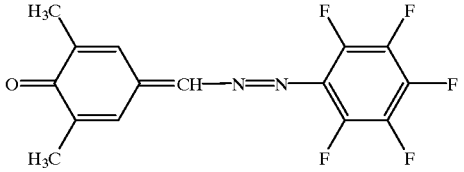
(ET4-23)
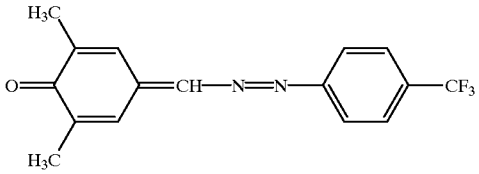
(ET4-24)
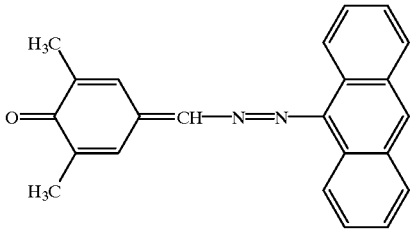
(ET4-25)
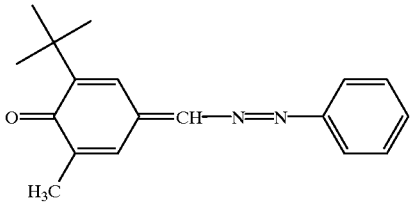
(ET4-26)
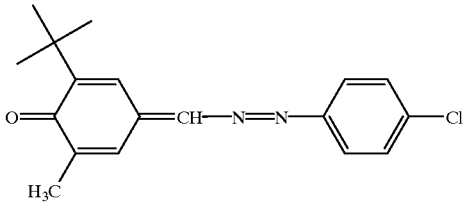

-continued
(ET4-27)
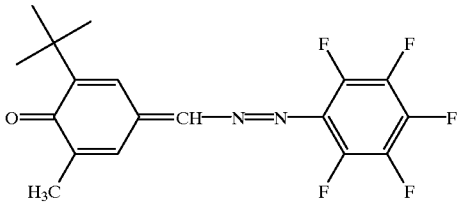
(ET4-28)
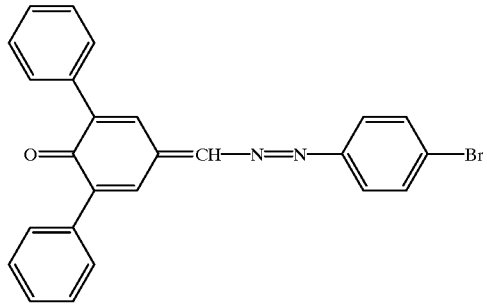
(ET4-29)
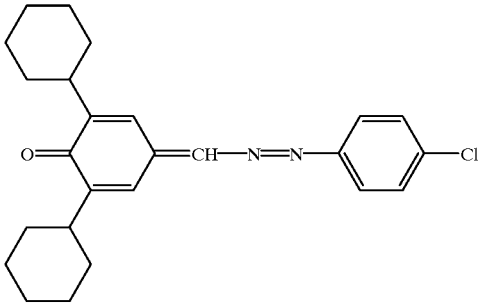
(ET4-30)
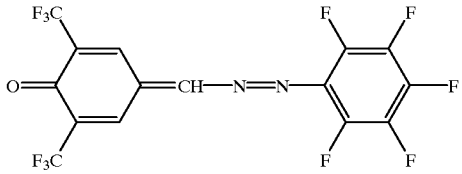
(ET4-31)
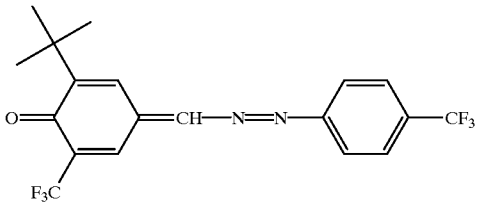
(ET4-32)
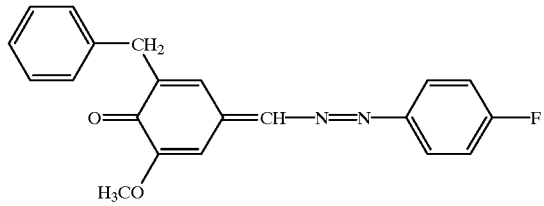
(ET5-1)
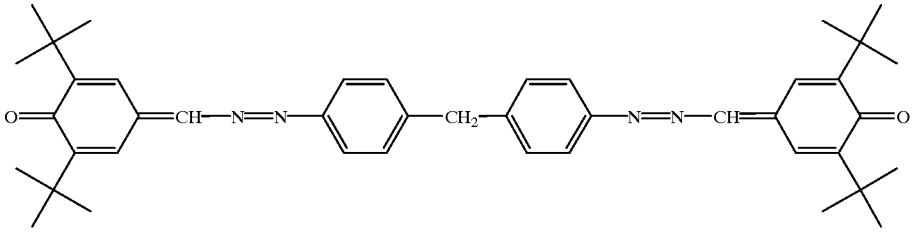
(ET5-2)
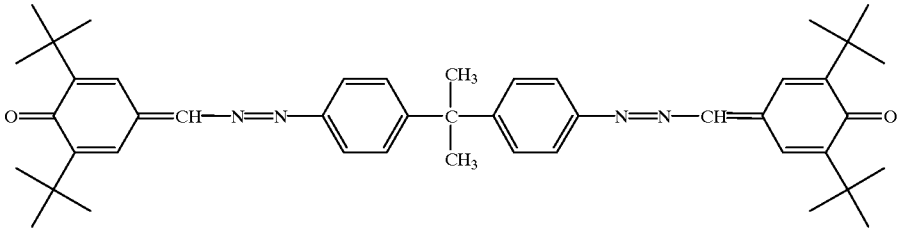

-continued
(ET5-3)
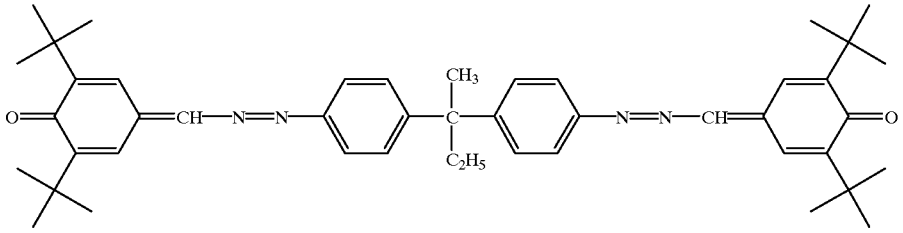
(ET5-4)
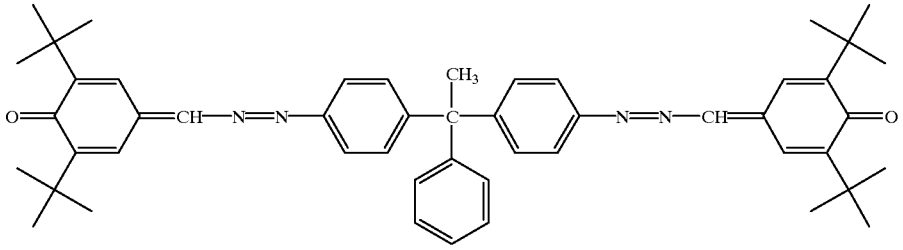
(ET5-5)
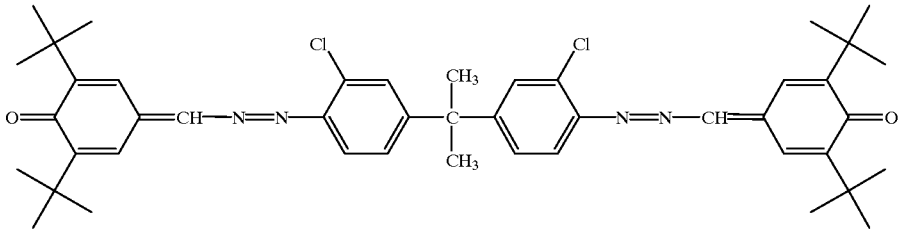
(ET5-6)
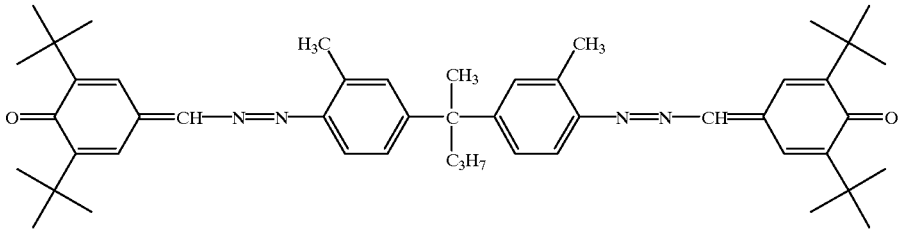
(ET5-7)
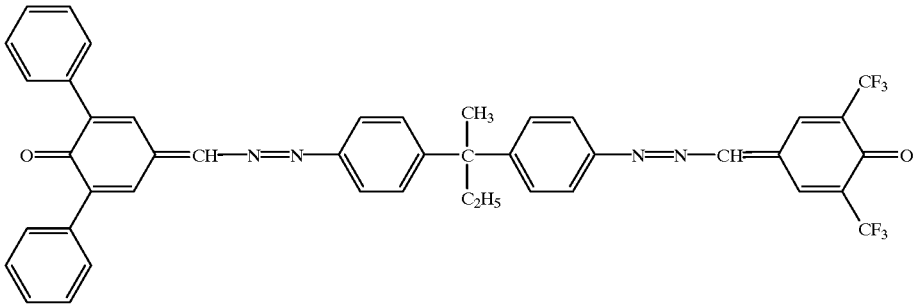

-continued
(ET5-7)
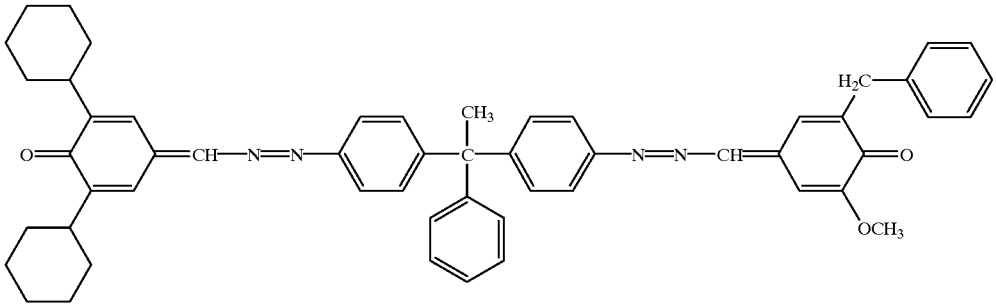
(ET6-1)
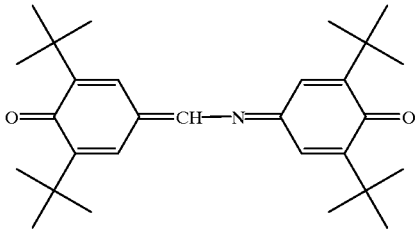
(ET6-2)
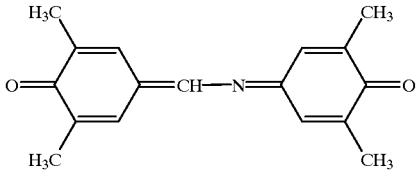
(ET6-3)
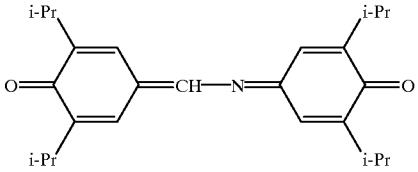
(ET6-4)
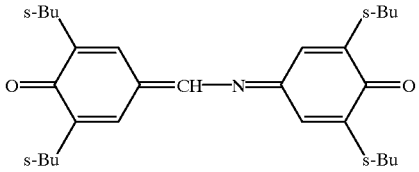
(ET6-5)
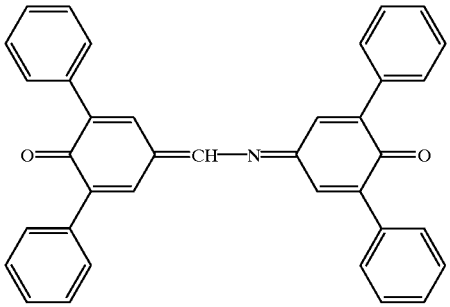
(ET6-6)
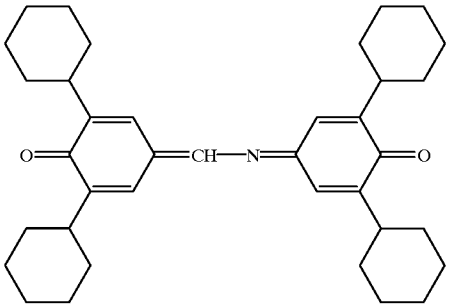
(ET6-7)
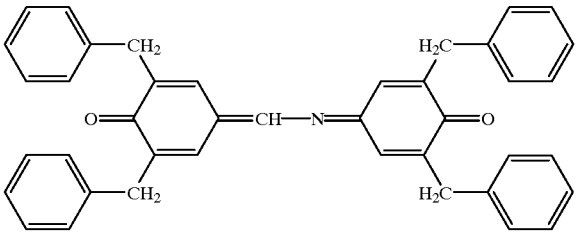
(ET6-8)
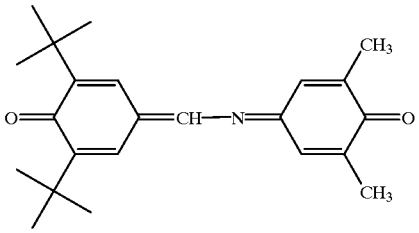
(ET6-9)
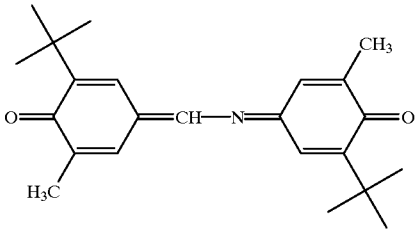
(ET6-10)
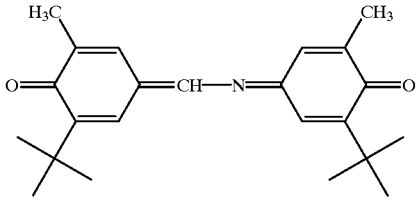

-continued
(ET6-11)
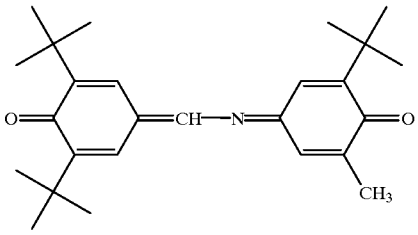
(ET6-12)
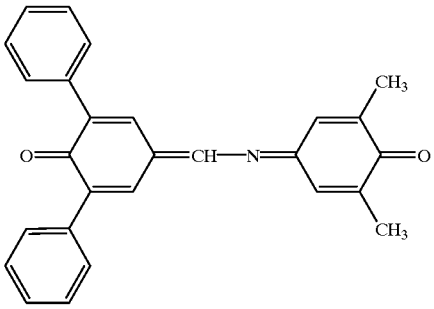
(ET6-13)
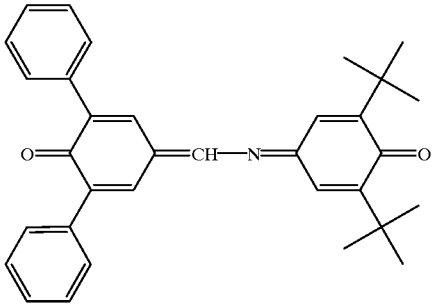
(ET6-14)
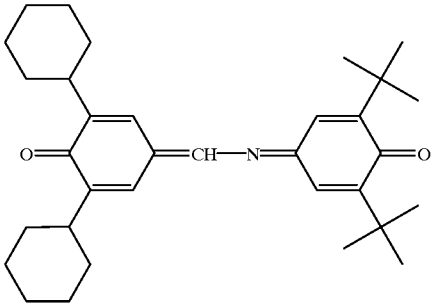
(ET6-15)
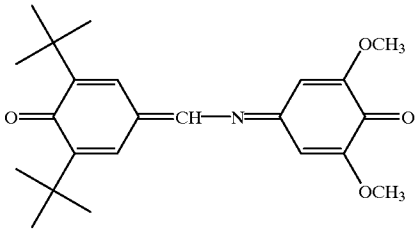
(ET6-16)
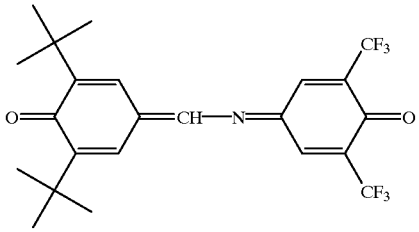
(ET6-17)
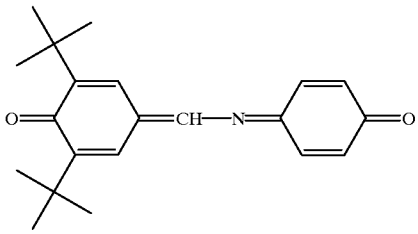
(ET6-18)
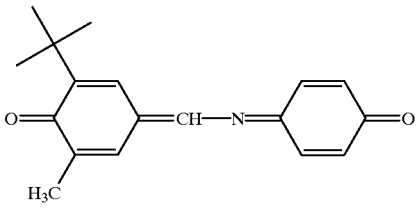
(ET6-19)
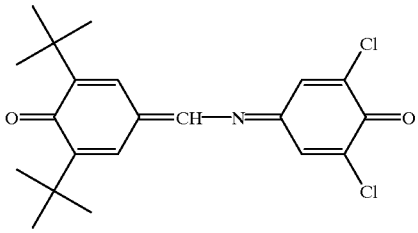
(ET6-20)
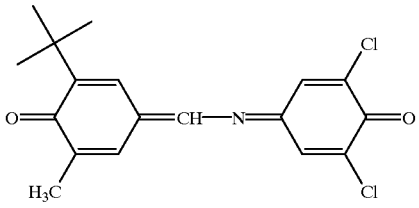

-continued
(ET6-21)
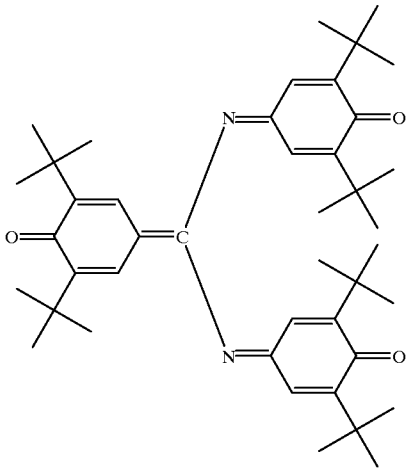
(ET7-1)
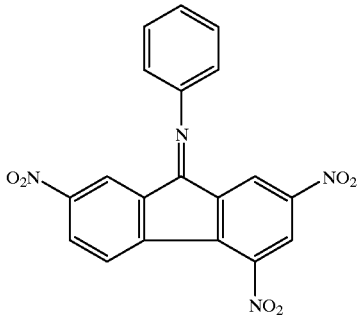
(ET7-2)
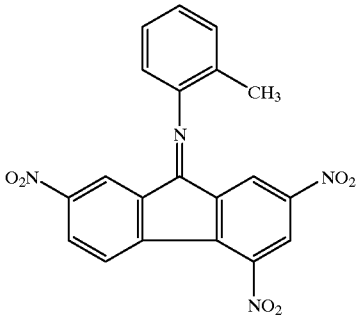
(ET7-3)
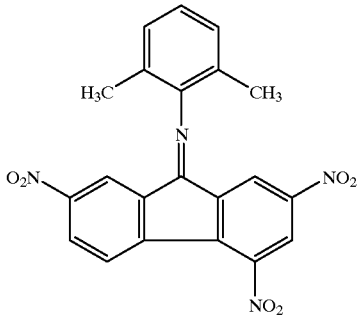
(ET7-4)
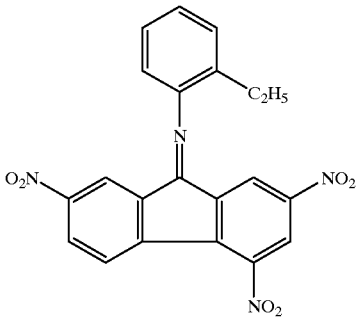
(ET7-5)
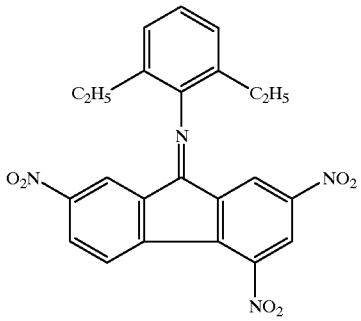
(ET7-6)
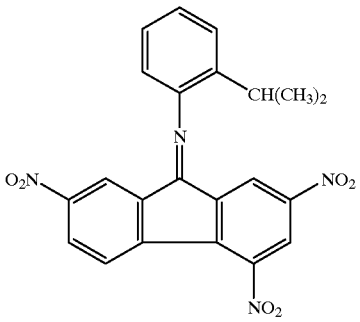
(ET7-7)
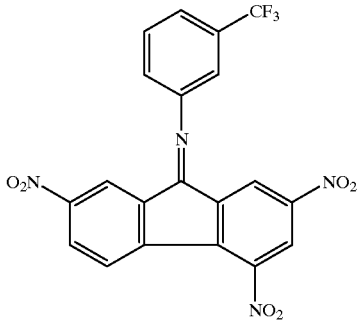

-continued
(ET7-8)
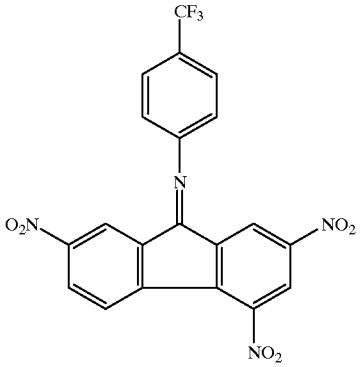
(ET7-9)
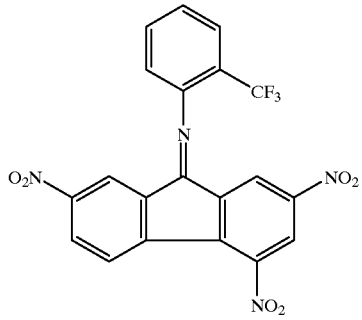
(ET7-10)
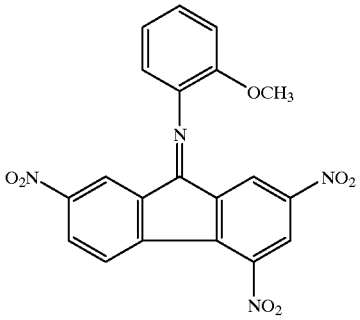
(ET7-11)
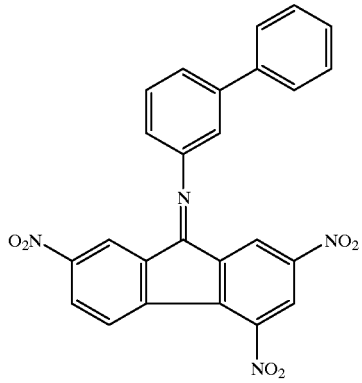
(ET7-12)
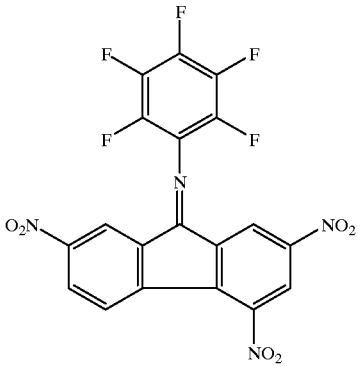
(ET7-13)
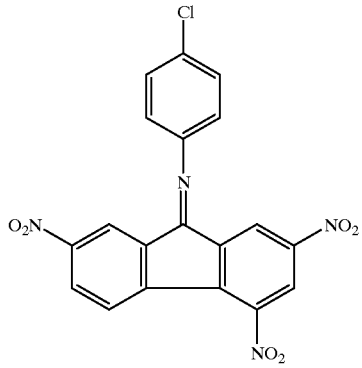
(ET7-14)
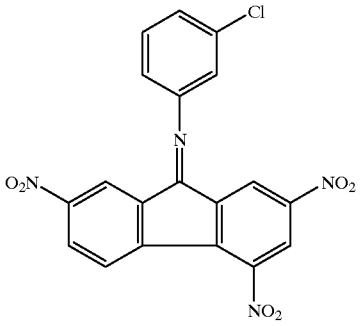
(ET7-15)
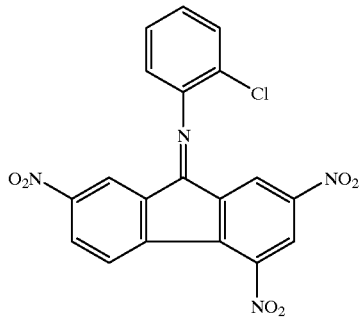

-continued
(ET7-16)
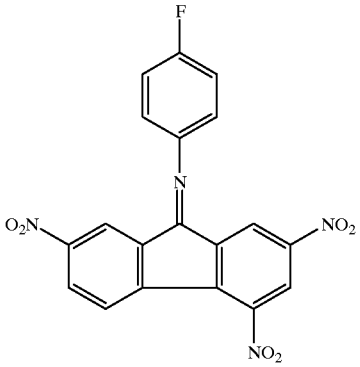
(ET7-17)
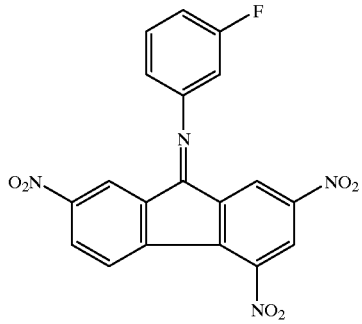
(ET7-18)
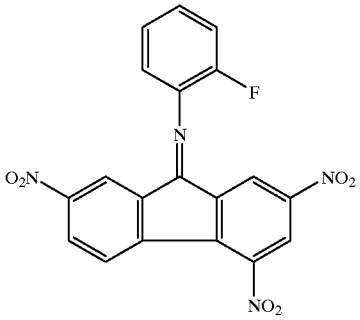
(ET7-19)
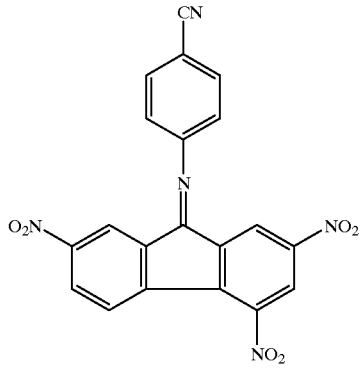
(ET7-20)
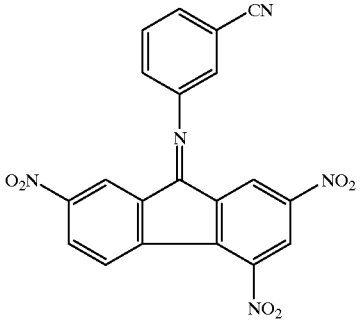
(ET7-21)
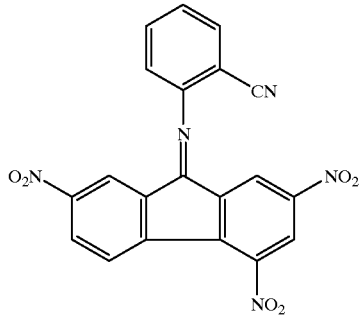
(ET7-22)
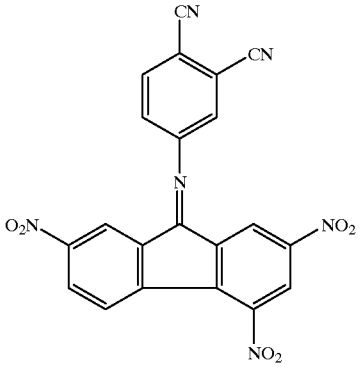
(ET7-23)
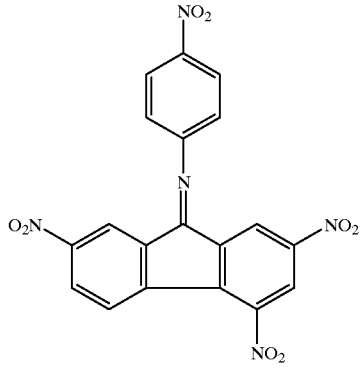

-continued
(ET7-24)
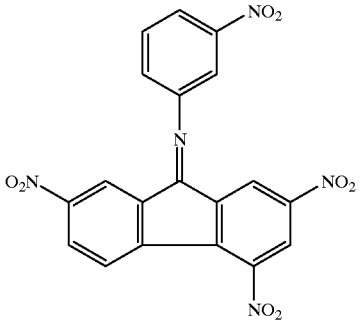
(ET7-25)
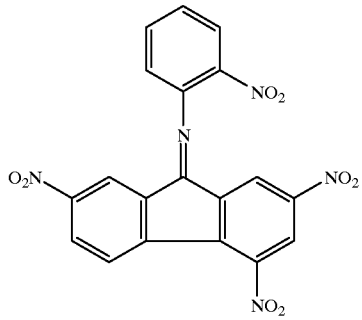
(ET7-26)
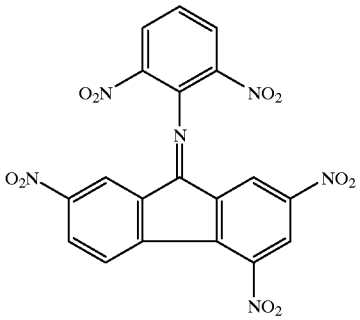
(ET7-27)
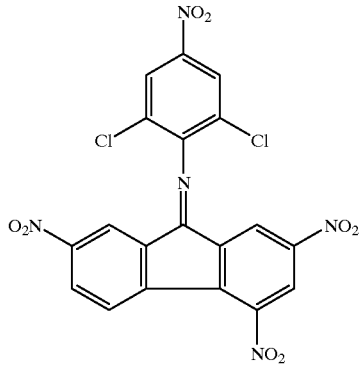
(ET7-28)
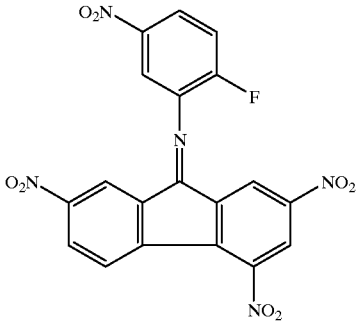
(ET7-29)
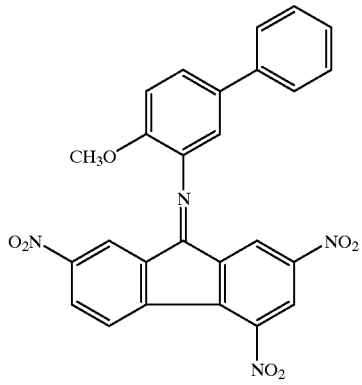
(ET7-30)
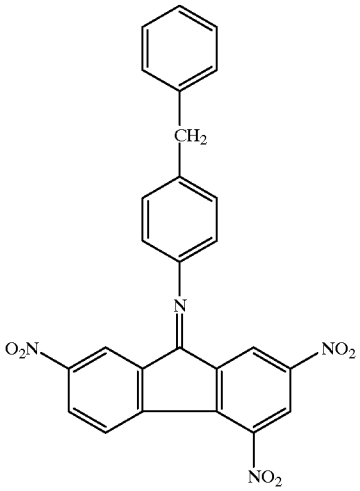
(ET7-31)
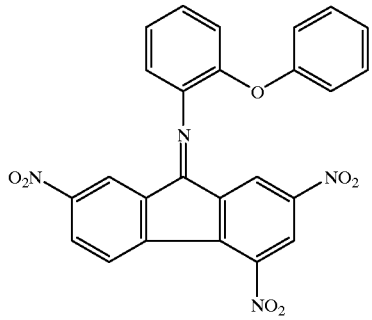

-continued
(ET7-32)
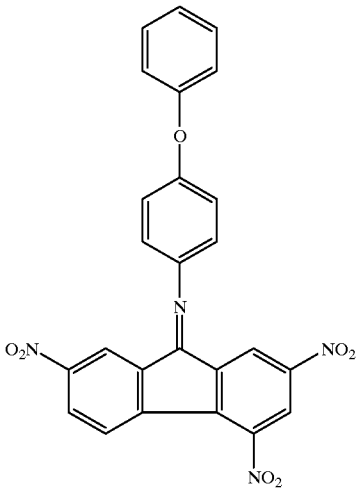
(ET7-33)
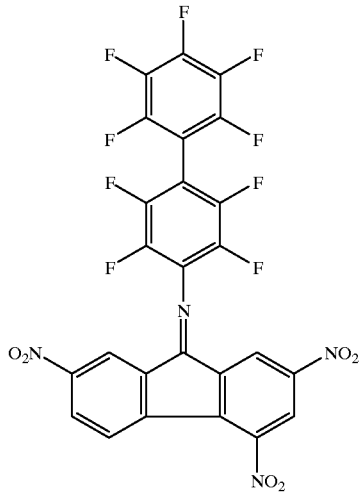
(ET7-34)
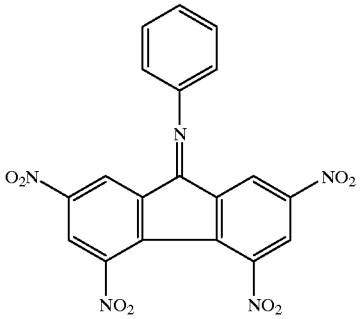
(ET7-35)
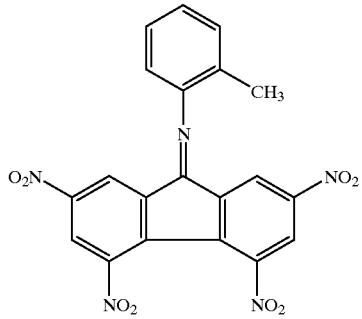
(ET7-36)
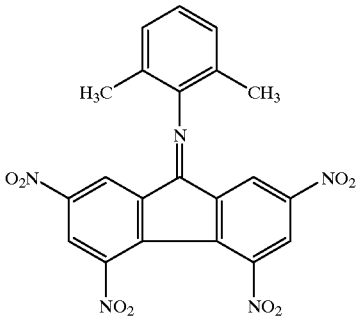
(ET7-37)
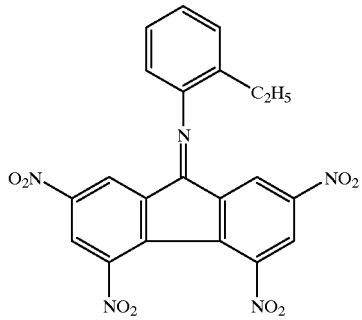
(ET7-38)
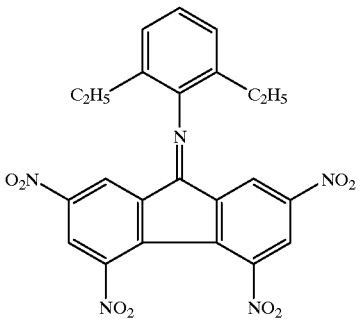
(ET7-39)
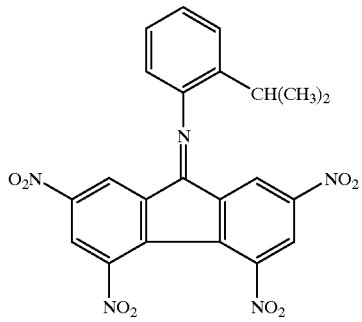

-continued
(ET7-40)
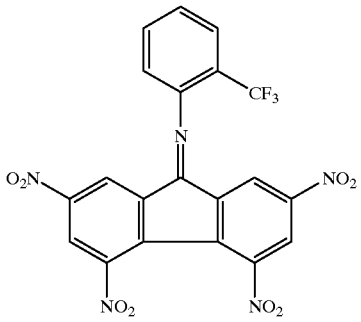
(ET7-41)
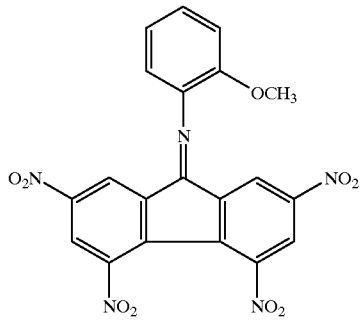
(ET7-42)
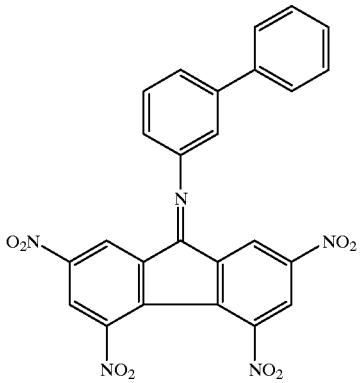
(ET7-43)
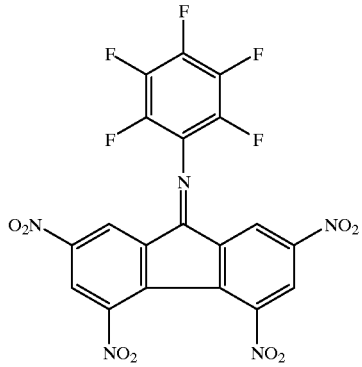
(ET7-44)
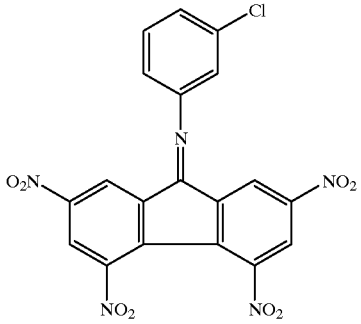
(ET7-45)
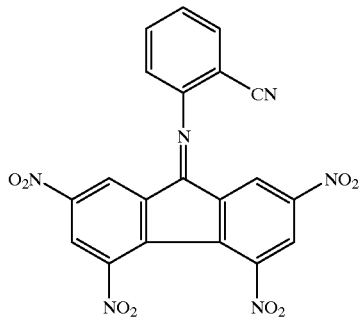
(ET7-46)
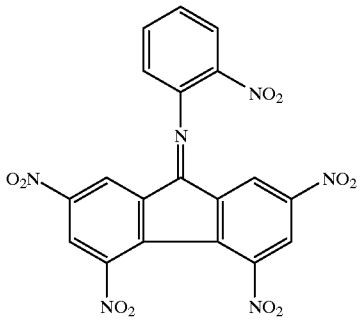
(ET7-47)
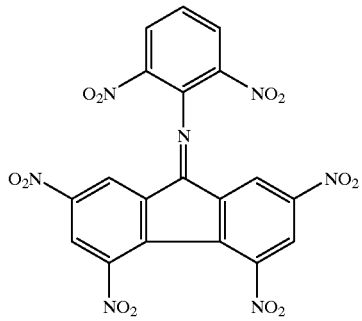

-continued
(ET7-48)
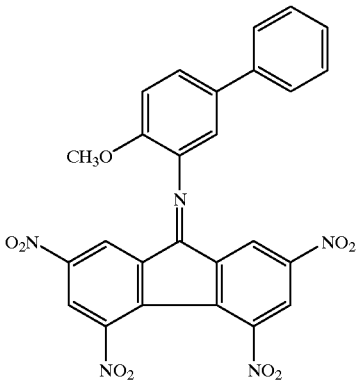
(ET7-49)
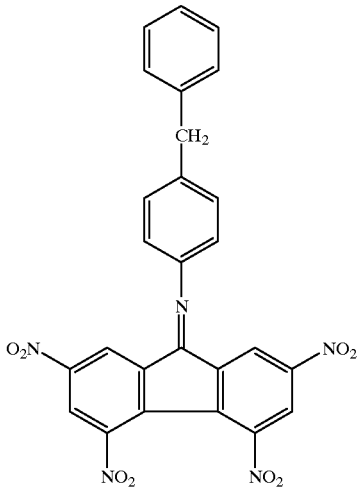
(ET7-50)
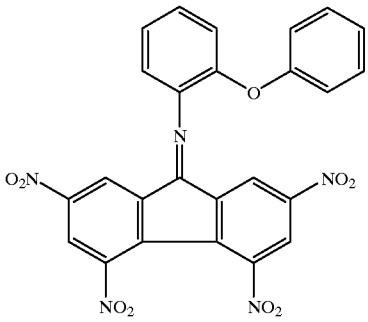
(ET8-1)
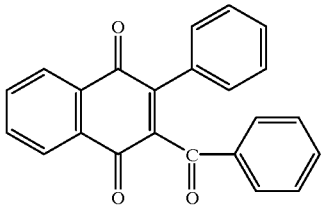
(ET8-2)
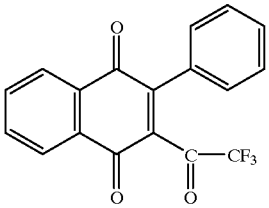
(ET8-3)
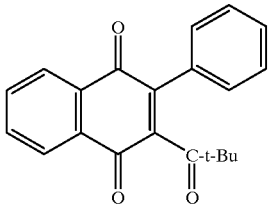
(ET8-4)
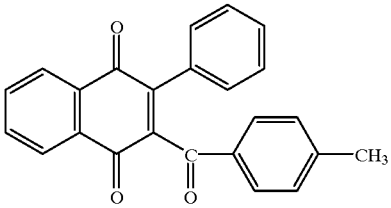
(ET8-5)
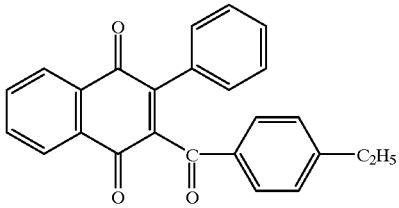
(ET8-6)
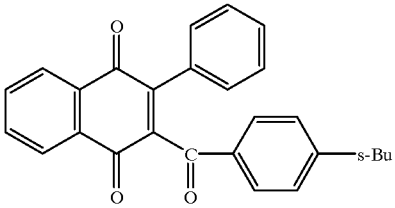
(ET8-7)
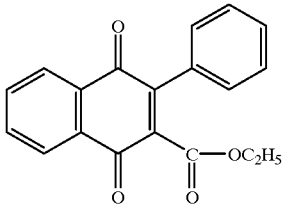

-continued
(ET8-8)
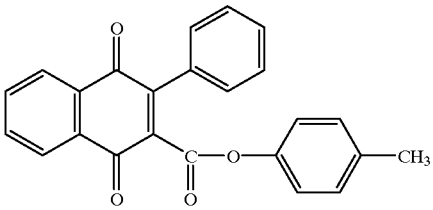
(ET8-9)
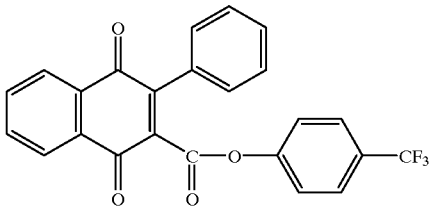
(ET8-10)
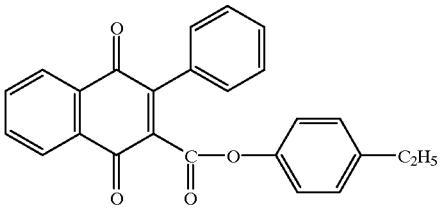
(ET8-11)
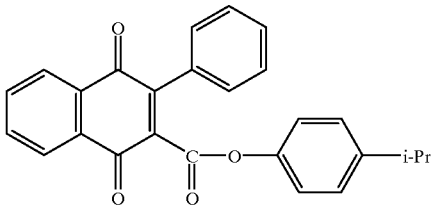
(ET8-12)
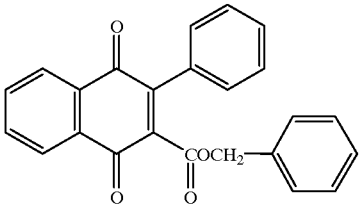
(ET8-13)
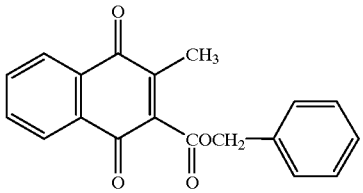
(ET8-14)
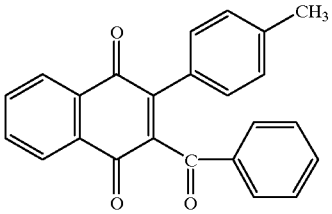
(ET9-1)
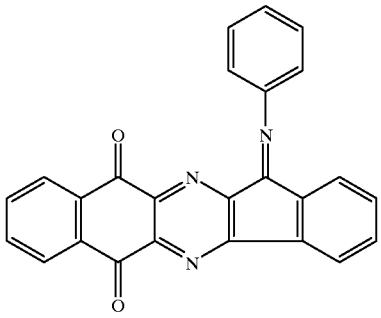
(ET9-2)
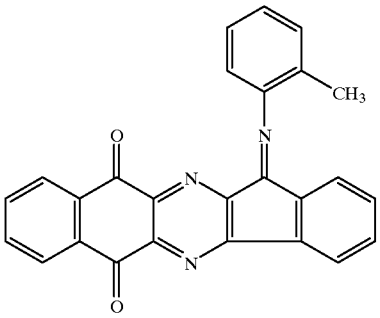
(ET9-3)
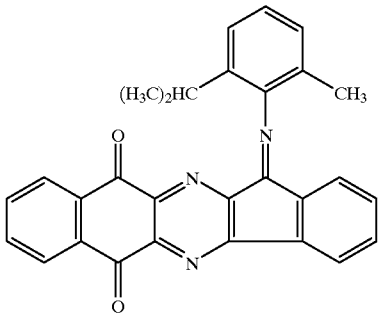

-continued
(ET9-4)
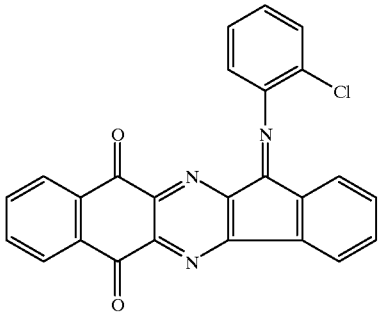
(ET9-5)
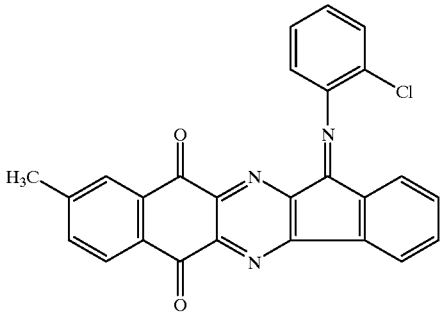
(ET9-6)
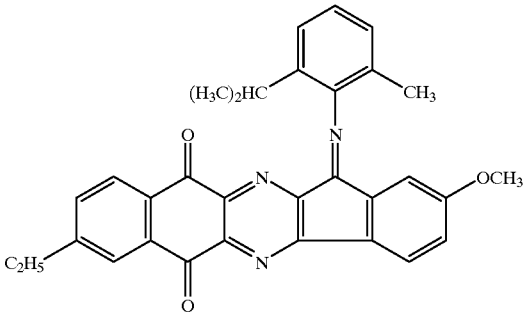
(ET10-1)
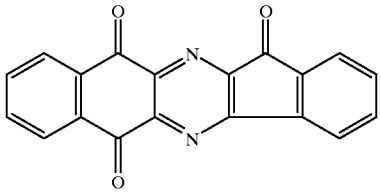
(ET10-2)
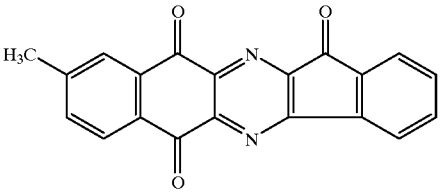
(ET10-3)
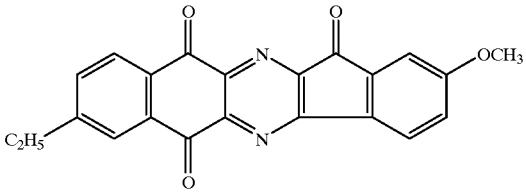
(ET10-4)
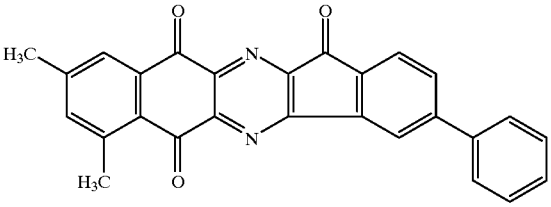
(ET11-1)
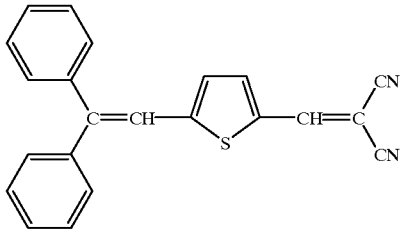
(ET11-2)
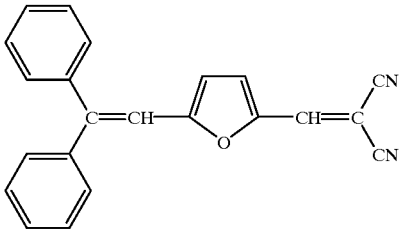
(ET11-3)
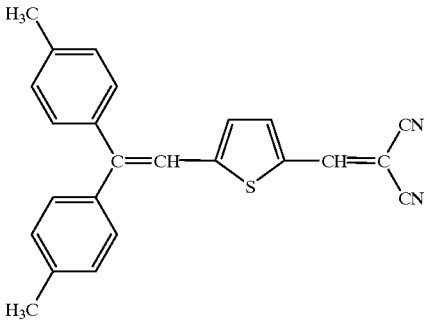

-continued
(ET11-4)
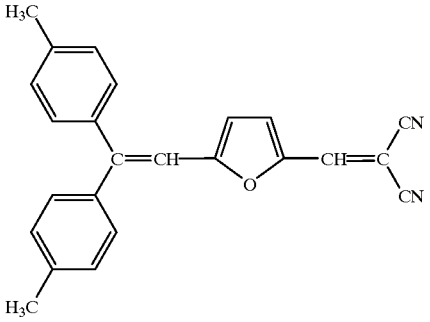
(ET11-5)
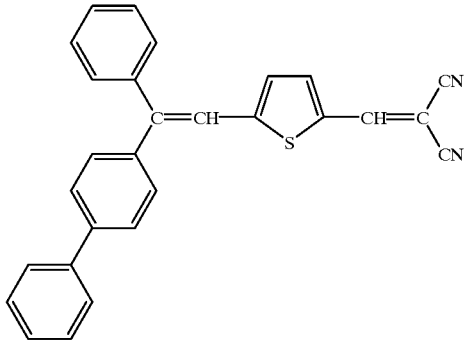
(ET11-6)
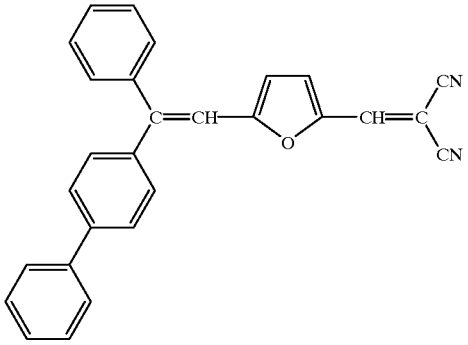
(ET11-7)
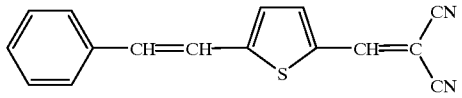
(ET11-8)
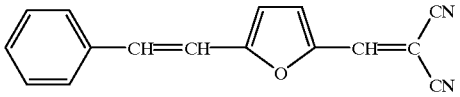
(ET11-9)
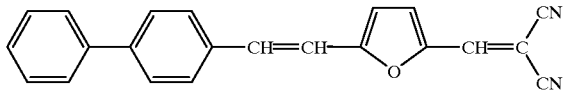
(ET11-10)
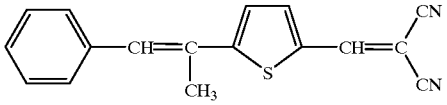
(ET11-11)
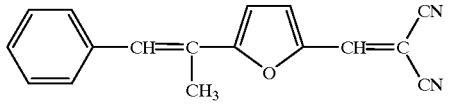
(ET11-12)
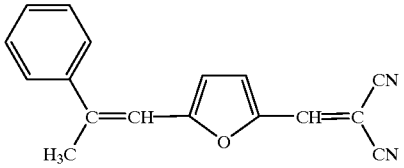
(ET11-13)
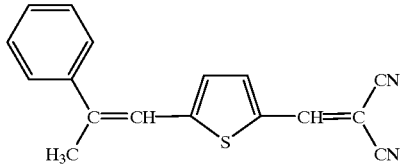
(ET11-14)
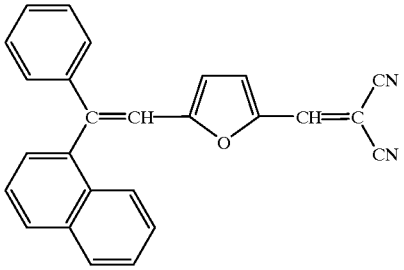
(ET11-15)
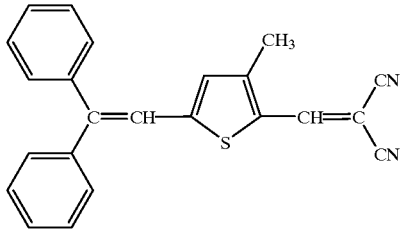

-continued
(ET11-16)
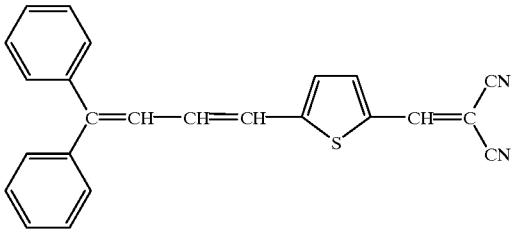
(ET11-17)
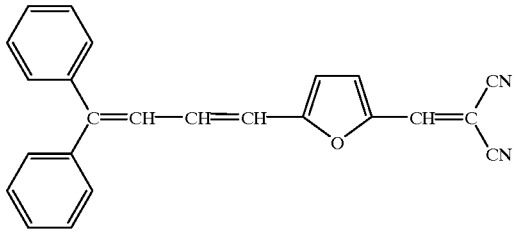
(ET11-18)
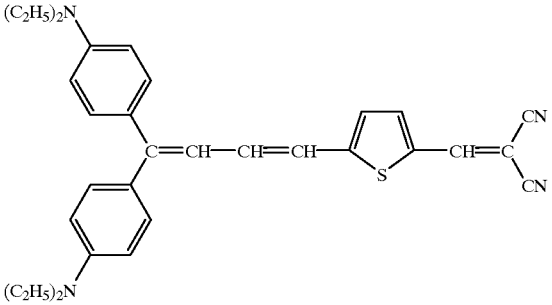
(ET11-19)
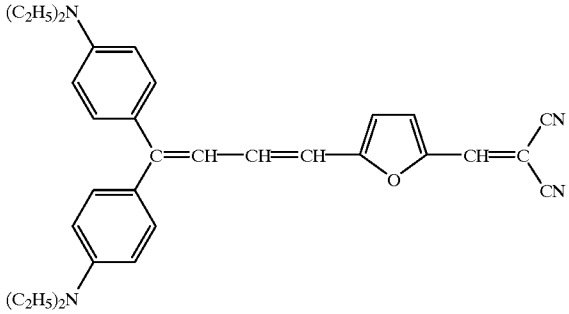
(ET11-20)
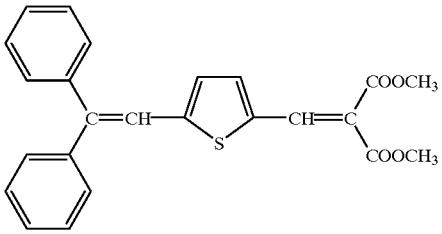
(ET11-21)
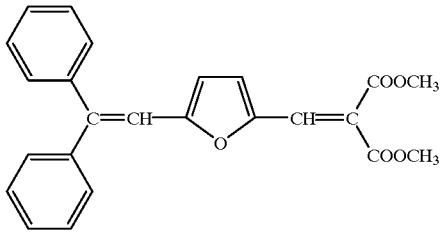
(ET11-22)
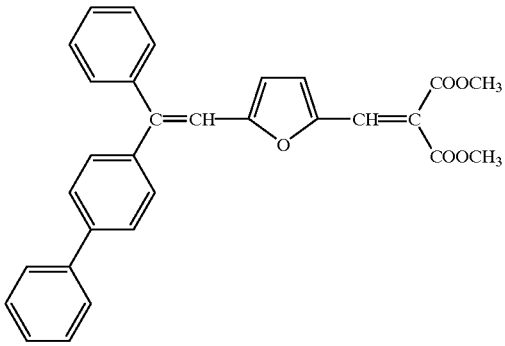
(ET11-23)
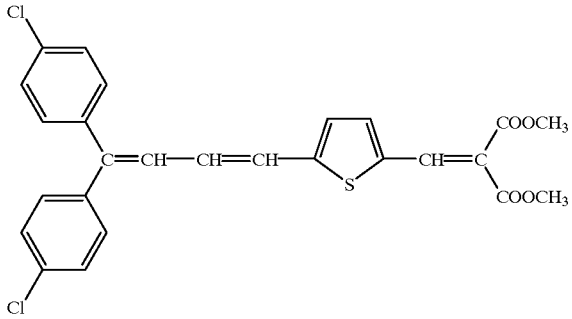
(ET11-24)
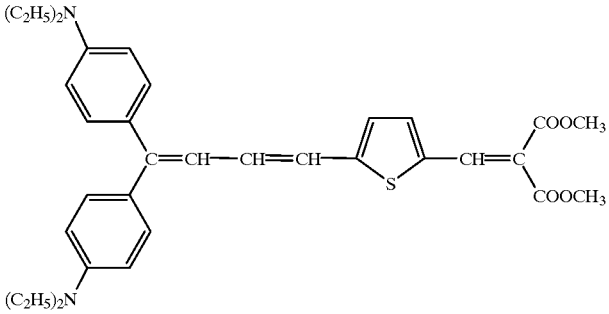
(ET11-25)
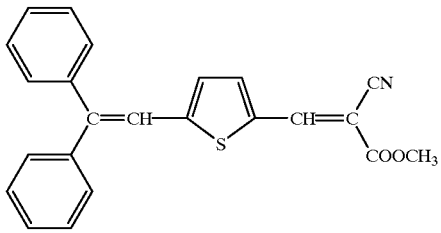

-continued
(ET11-26)
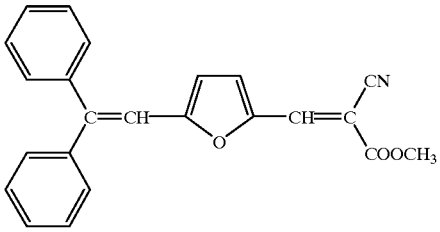
(ET11-27)
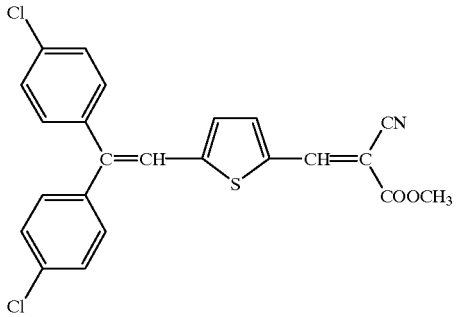
(ET11-28)
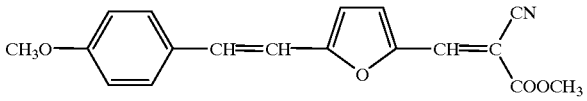
(ET11-29)
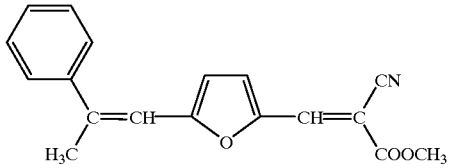
(ET11-30)
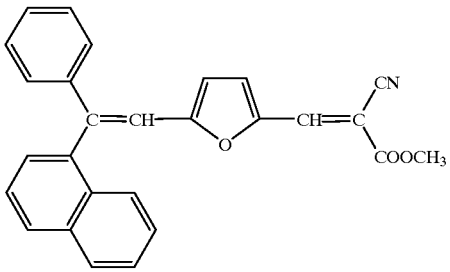
(ET11-31)
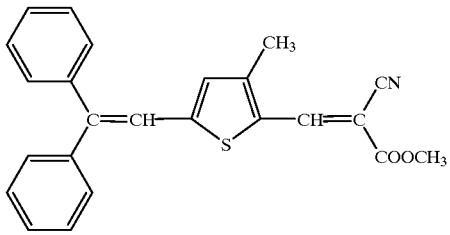
(ET11-32)
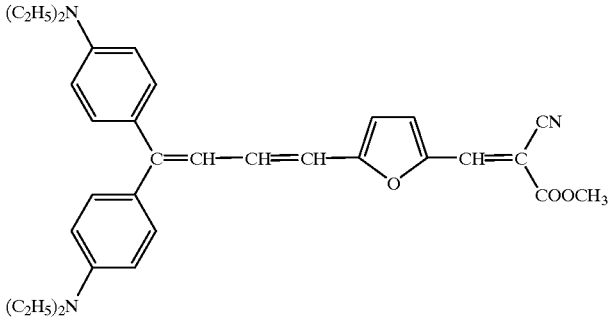
(ET12-1)
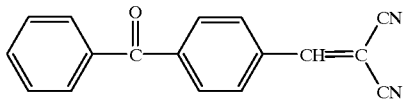
(ET12-2)
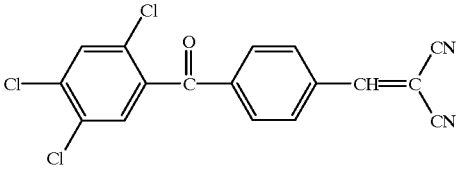
(ET12-3)
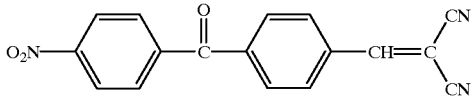
(ET12-4)
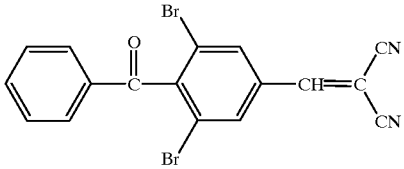
(ET12-5)
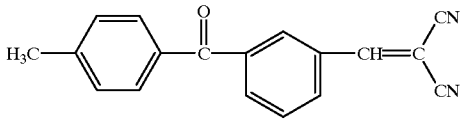

-continued
(ET12-6)
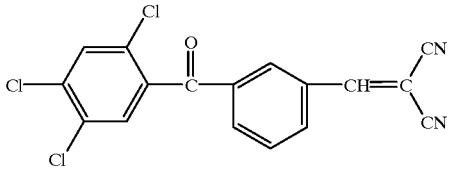
(ET12-7)
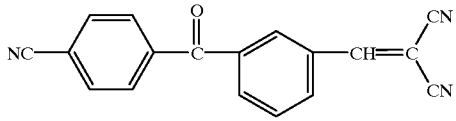
(ET12-8)
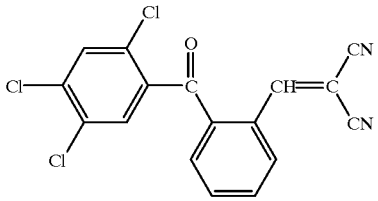
(ET12-9)
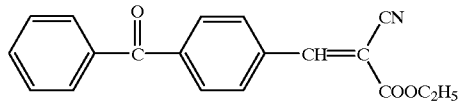
(ET12-10)
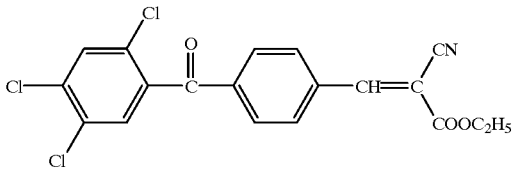
(ET12-11)
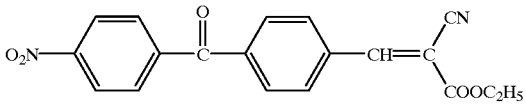
(ET12-12)
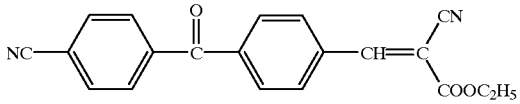
(ET12-13)
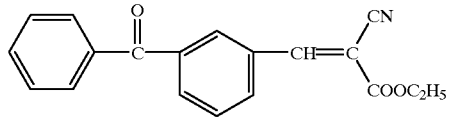
(ET12-14)
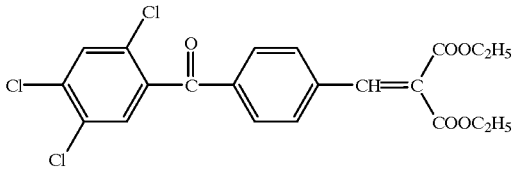
(ET12-15)
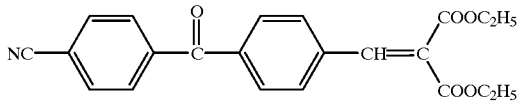
(ET12-16)
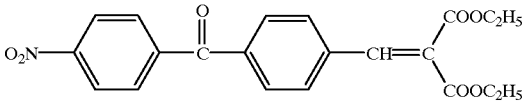
(ET13-1)
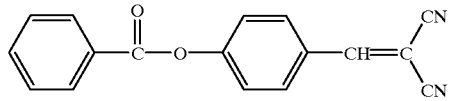
(ET13-2)
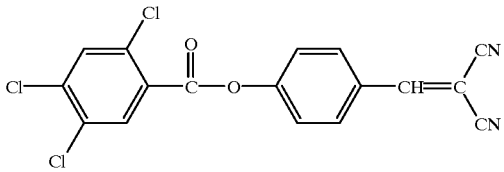
(ET13-3)
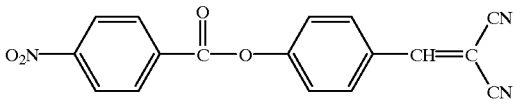
(ET13-4)
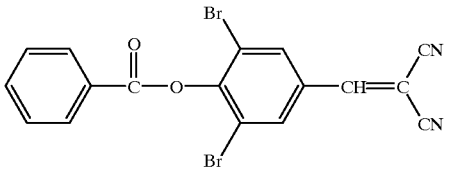
(ET13-5)
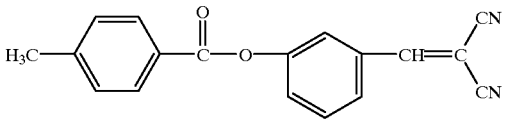

-continued
(ET13-6)
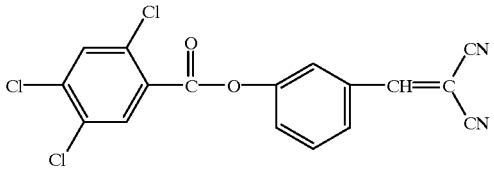
(ET13-7)
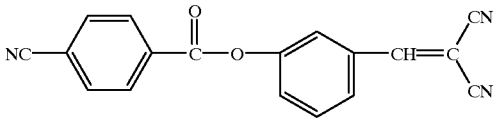
(ET13-8)
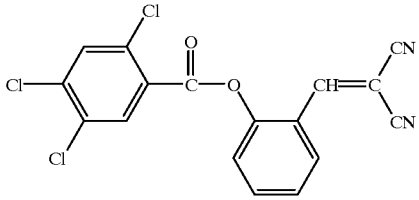
(ET13-9)
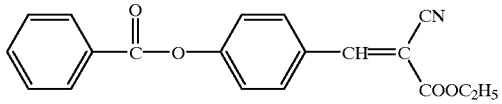
(ET13-10)
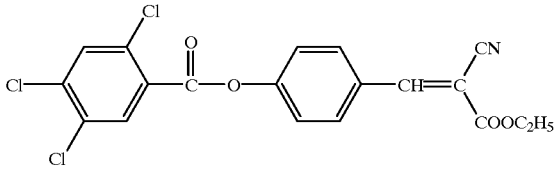
(ET13-11)
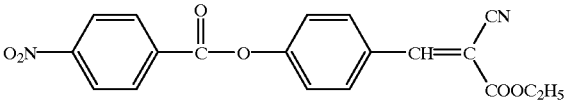
(ET13-12)
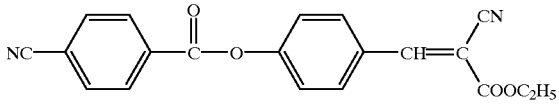
(ET13-13)
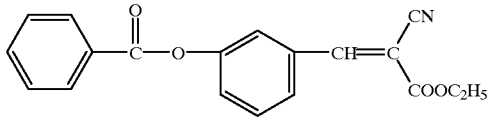
(ET13-14)
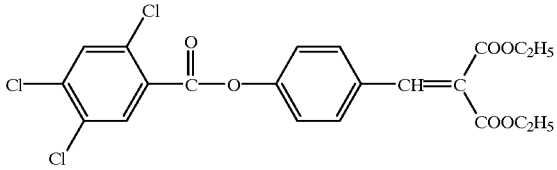
(ET13-15)
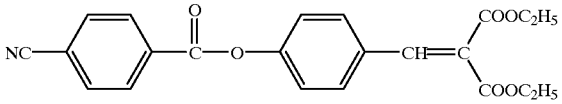
(ET13-16)
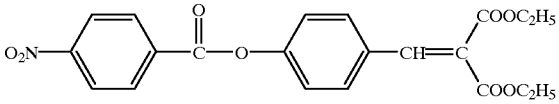
(ET14-1)
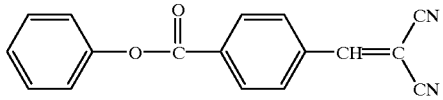
(ET14-2)
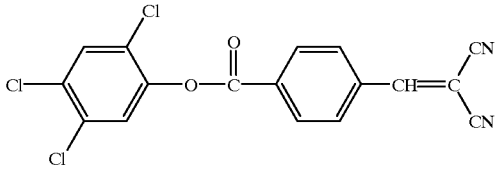
(ET14-3)
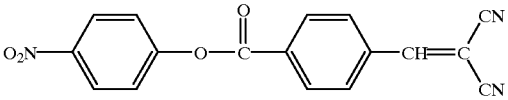
(ET14-4)
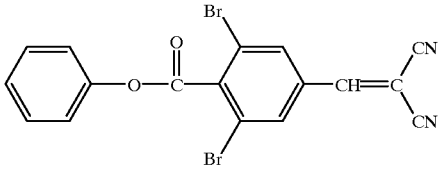
(ET14-5)
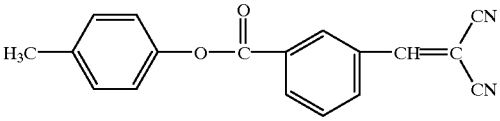

-continued
(ET14-6)
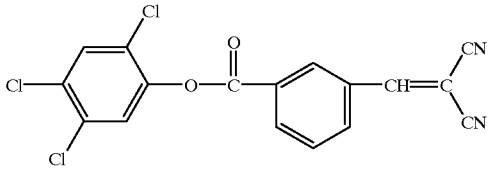
(ET14-7)
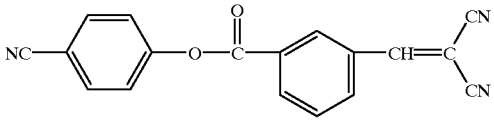
(ET14-8)
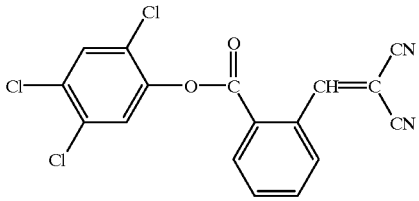
(ET14-9)
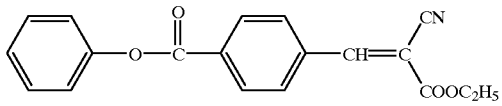
(ET14-10)
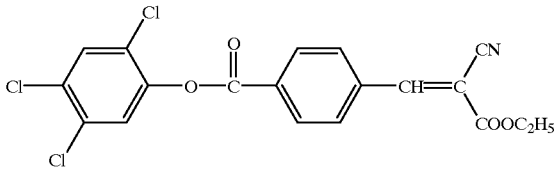
(ET14-11)
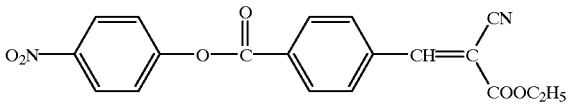
(ET14-12)
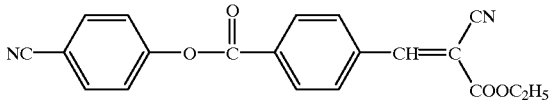
(ET14-13)
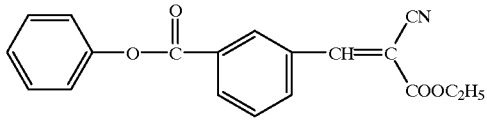
(ET14-14)
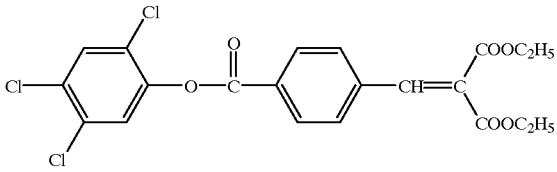
(ET14-15)
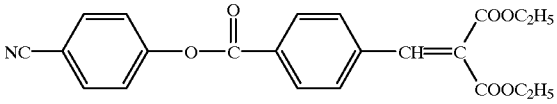
(ET14-16)
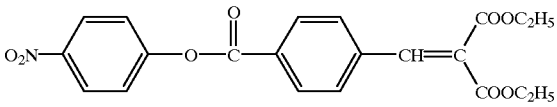
(ET15-1)
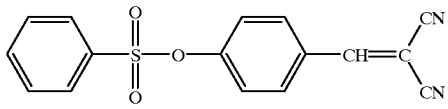
(ET15-2)
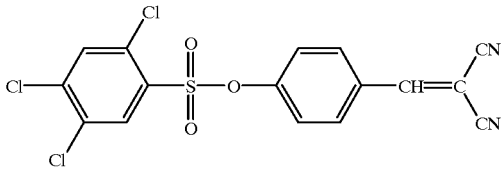
(ET15-3)
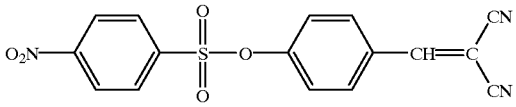
(ET15-4)
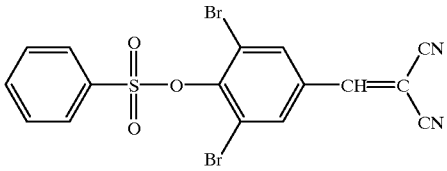
(ET15-5)
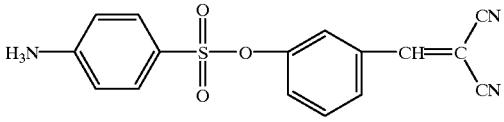

-continued
(ET15-6)
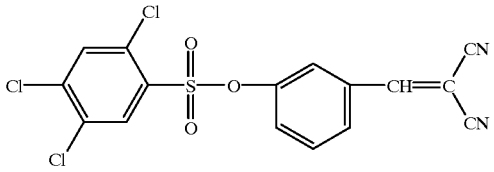
(ET15-7)
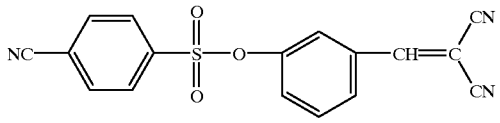
(ET15-8)
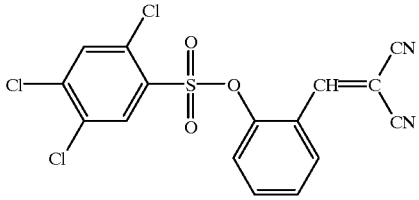
(ET15-3)
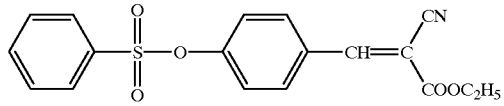
(ET15-10)
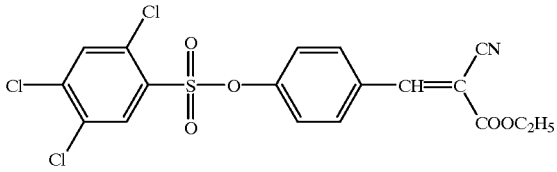
(ET15-11)
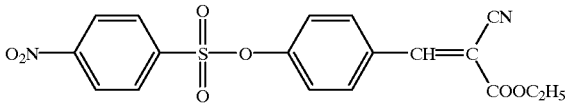
(ET15-12)
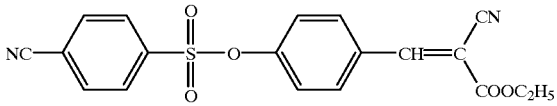
(ET15-13)
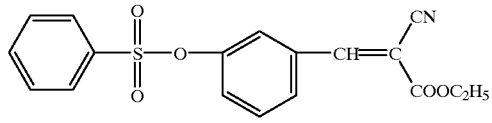
(ET15-14)
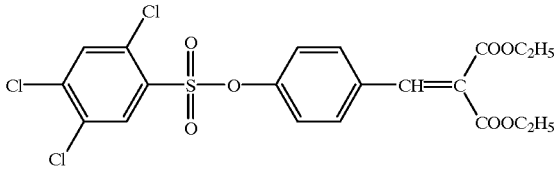
(ET15-15)
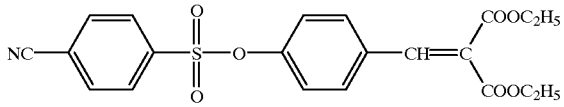
(ET15-16)
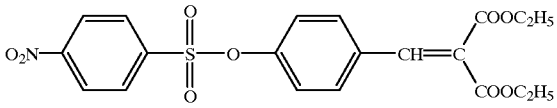
(ET16-1)
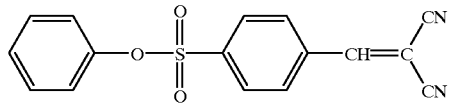
(ET16-2)
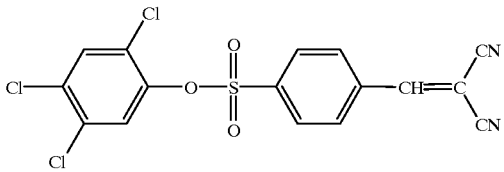
(ET16-3)
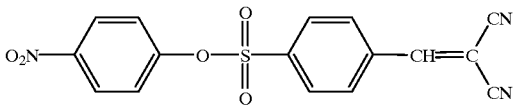
(ET16-4)
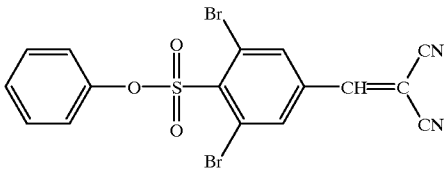
(ET16-5)
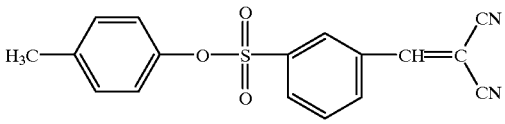

-continued
(ET16-6)
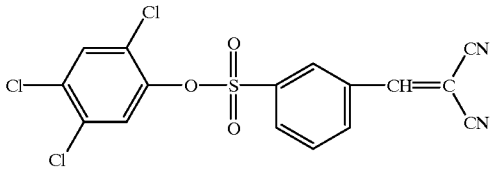
(ET16-7)
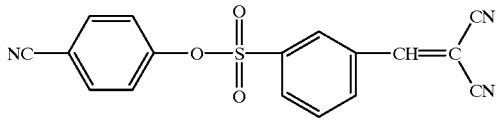
(ET16-8)
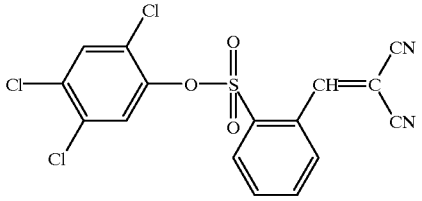
(ET16-9)
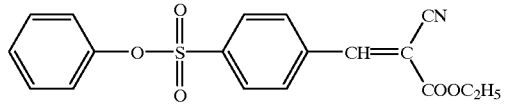
(ET16-10)
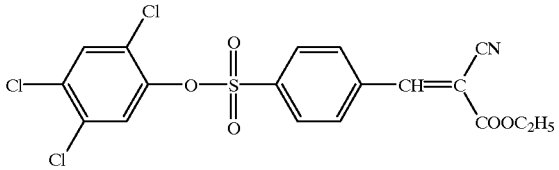
(ET16-11)
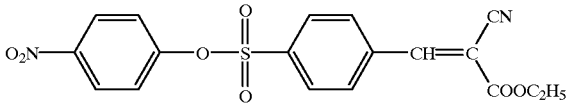
(ET16-12)
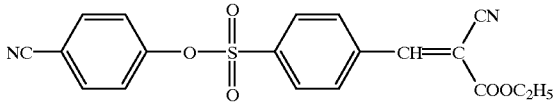
(ET16-13)
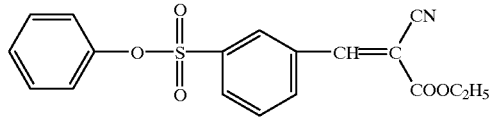
(ET16-14)
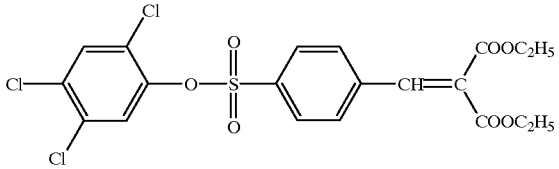
(ET16-15)
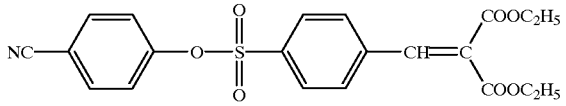
(ET16-16)
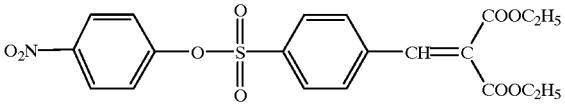
(ET-1)
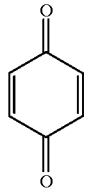
(ET-2)
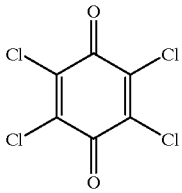
(ET-3)
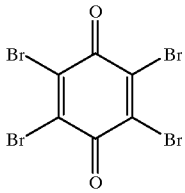
(ET-4)
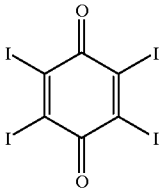
(ET-5)
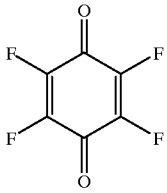

-continued
(ET-6)
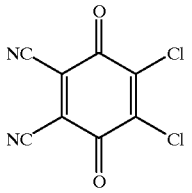
(ET-7)
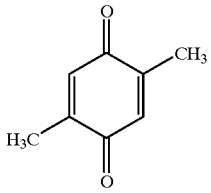
(ET-8)
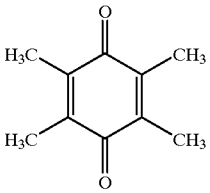
(ET-9)
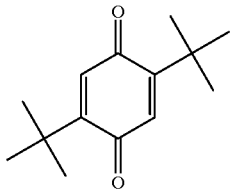
(ET-10)
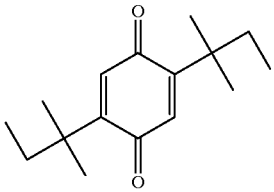
(ET-11)
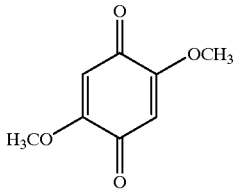
(ET-12)
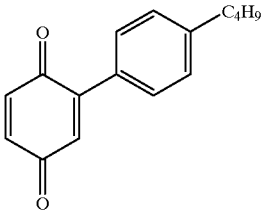
(ET-13)
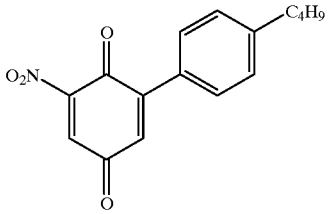
(ET-14)
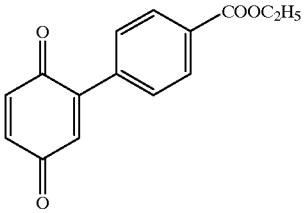
(ET-15)
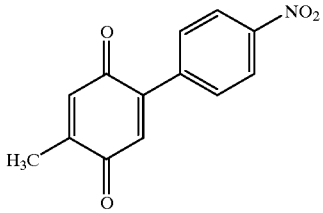
(ET-16)
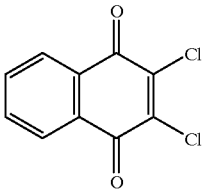
(ET-17)
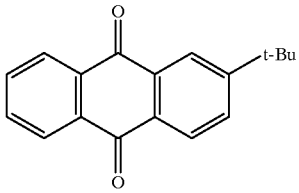
(ET-18)
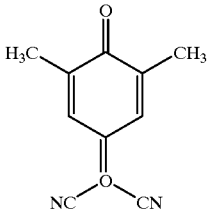
(ET-19)
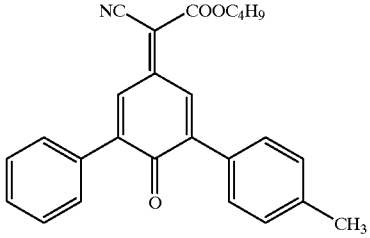

-continued
(ET-20)
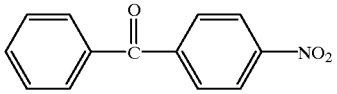
(ET-21)
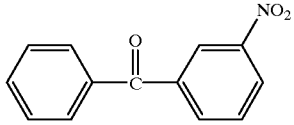
(ET-22)
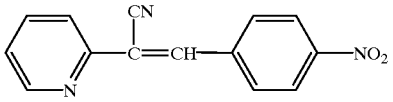
(ET-23)
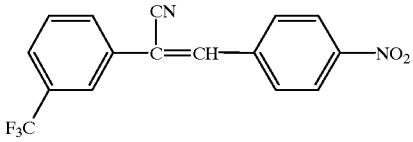
(ET-24)
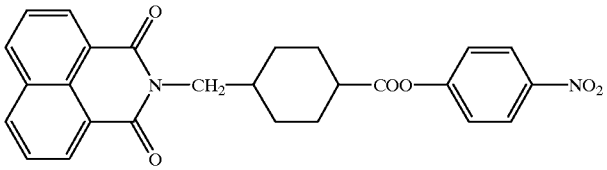
(ET-25)
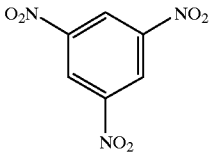
(ET-26)
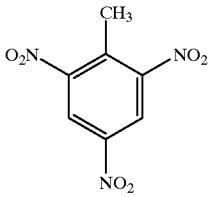
(ET-27)
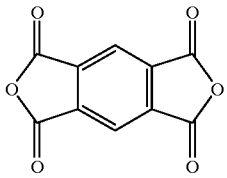
(ET-28)
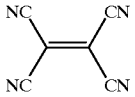
(ET-29)
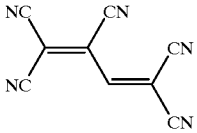
(ET-30)
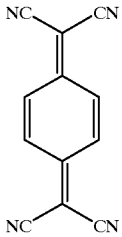
(ET-31)
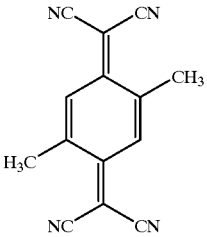
(ET-32)
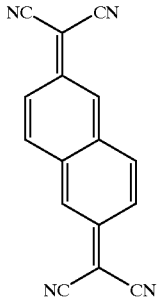
(ET-33)
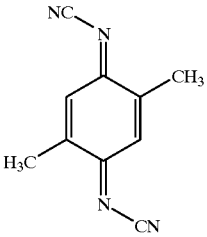

-continued (ET-34)

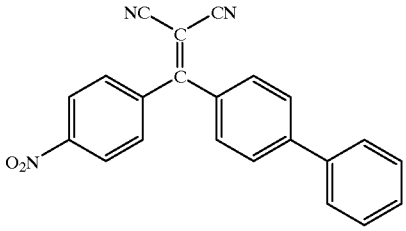

(ET-35)

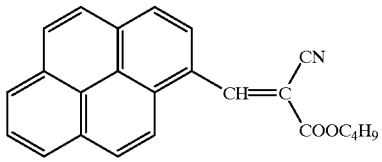

(ET-36)

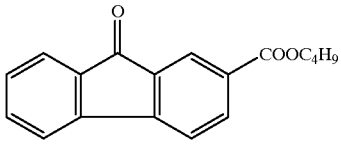

(ET-37)

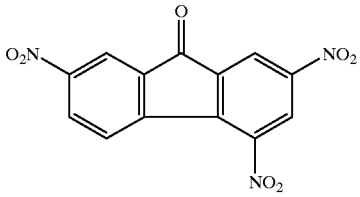

(ET-38)

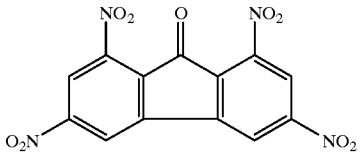

(ET-39)

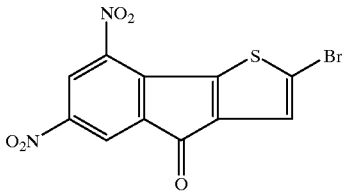

(ET-40)

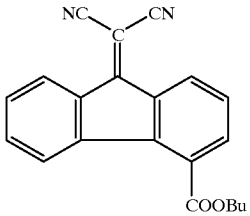

(ET-41)

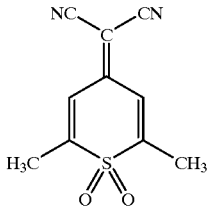

(ET-42)

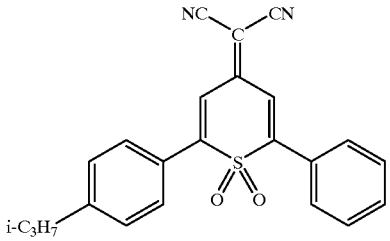

The charge generating substances contained in the photosensitive layer 3 may include phthalocyanine pigments, naphthalocyanine pigments, azo pigments, polycyclic quinone pigments such as anthraquinone and anthanthrone, perylene pigments, perinone pignents, squarilium dyes, azulenium dyes, thiapyrilium dyes, cyanine dyes and quinacridone and the like. Combination of these pigments and dyes may also be used. Especially preferable charge generating substances are disazo pigments and trisazo pigments as azopigments, 3,9-dibromoanthanthrone as an anthanthrone pigment, N,N'-bis(3,5-dimethylphenyl)-3,4,9,10-perylenebis(carboxyimide) as a perylene pigment, and metalless phthalocyanine, copper phthalocyanine and titanyl phthalocyanine as phthalocyanine pigments. More preferable charge generating substances are X type metal-less phthalocyanine, τ type metal-less phthalocyanine, ϵ type copper phthalocyanine, α type titanyl phthalocyanine, β type titanyl phthalocyanine, amorphous titanyl phthalocyanine, Y type titanyl phthalocyanine, I type titanyl phthalocyanine, and the titanyl phthalocyanine with the maximum peak at 9.6° of Bragg angle 2θ in CuKα:X ray diffraction spectrum described in Japanese Patent Application Laid-open No. 1996-209023. Content of these charge generating substances is 0.1–20% by weight, and preferably 0.5–10% by weight, based on solid contents of the photosensitive layer 3.

The resin binders may be used in the photosensitive layer 3, such as polycarbonate resin, polyester resin, polyvinyl acetal resin, polyvinyl butyral resin, polyvinyl alcohol resin, vinyl chloride resin, vinyl acetate resin, polyethylene, polypropylene, polystyrene, acrylic resin, polyurethane resin, epoxy resin, melamine resin, silicon resin, silicone resin, polyamide resin, polystyrene resin, polyacetal resin, polyarylate resin, polysulfone resin, methacrylic acid ester polymer and their copolymers, and suitable combination of them. Especially, polycarbonates having structural units shown by the general formula (BD1) represented by bisphenol Z type polycarbonates as main repeating units are preferable. Particularly polycarbonates having structural units shown by following (BD1-1)–(BD1-16) as main repeating units may be included. Besides, polycarbonate resins and polyester resins having one or more than one of the structural units shown in following (BD-1)–(BD-6) as main repeating units are suitable, but the present invention is not limited by them. Moreover, one or a mixture of more than one of these resins may also be used. Further, a mixture of same group of resins with different molecular weights may also be used. Content of resin binders is 10–90% by weight, and preferably 20–80 t by weight, based on solid contents of the photosensitive layer 3.

(BD1-1)

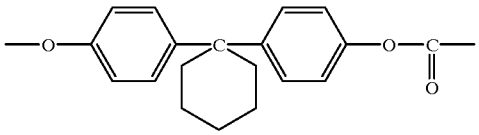

(BD1-2)

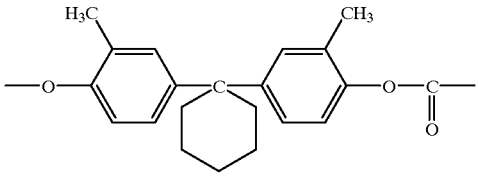

(BD1-3)

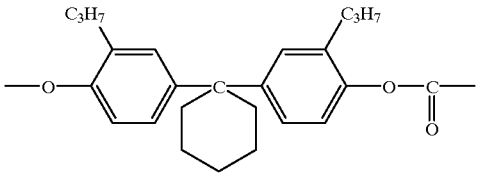

(BD1-4)

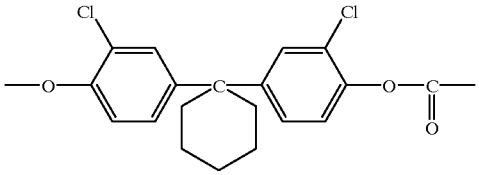

(BD1-5)

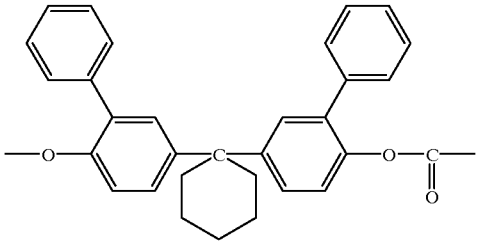

-continued (BD1-6)

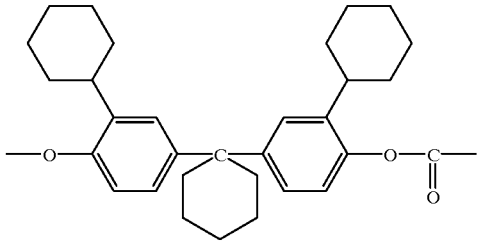

(BD1-7)

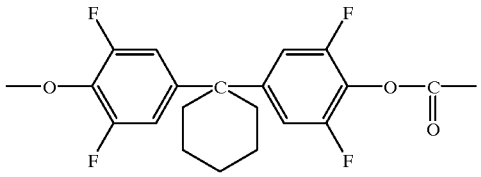

(BD1-8)

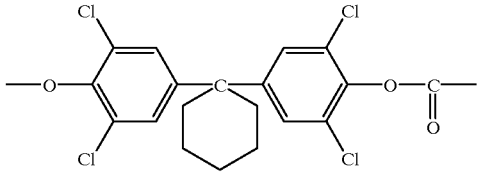

(BD1-9)

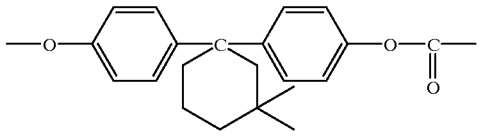

(BD1-10)

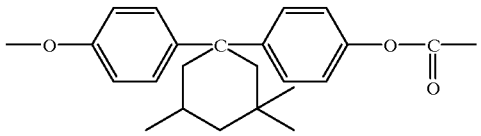

(BD1-11)

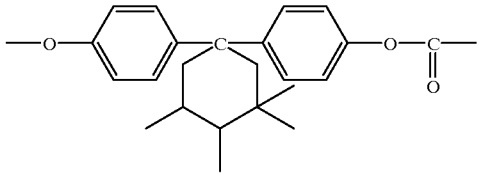

(BD1-12)

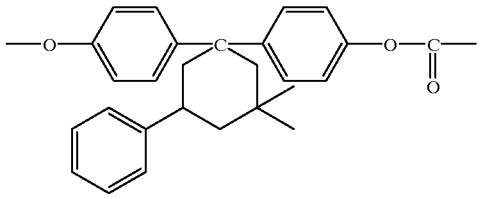

-continued (BD1-13)

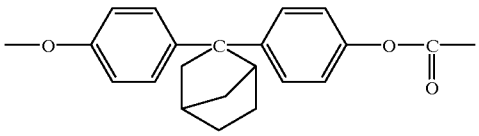

(BD1-14)

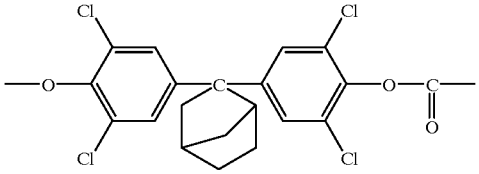

(BD1-15)

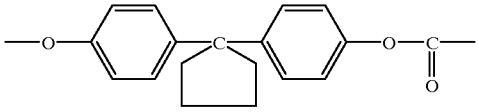

(BD1-16)

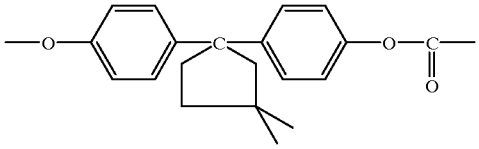

(BD-1)

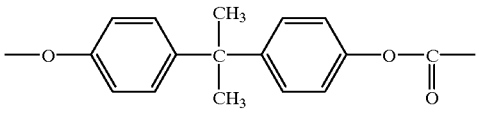

(BD-2)

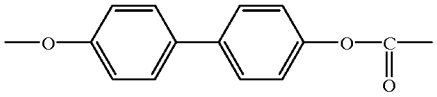

(BD-3)

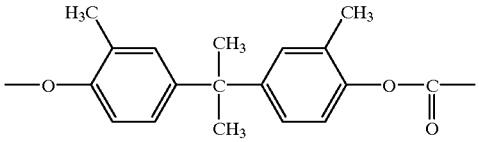

(BD-4)

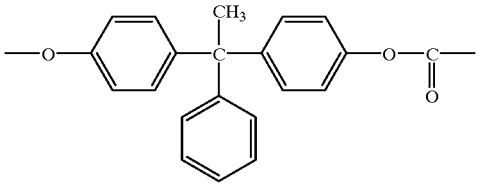

-continued (BD-5)

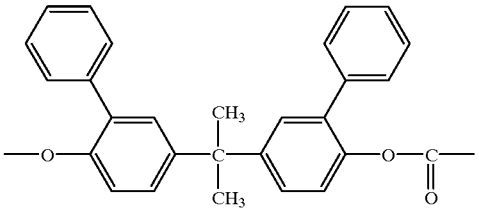

(BD-6)

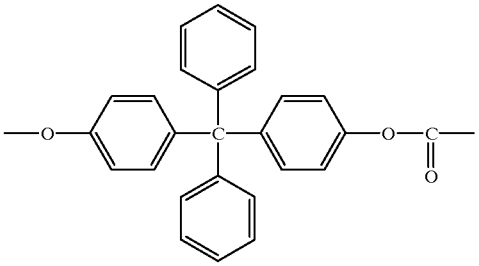

In order to maintain substantially effective surface potential, film thickness of the photosensitive layer 3 is preferably 3–100 $\mu$m, and more preferably 10–50 $\mu$m.

For the purpose of improving environment resistance and stability against harmful light, inhibitors for deterioration such as antioxidants and photostabilizers may be contained in the photosensitive layer 3. The compounds used for this purpose may include chromanol derivatives and ester compounds such as tocopherol, polyarylalkane compounds, hydroquinone derivatives, ether compounds, diether compounds, benzophenone derivatives, benzotriazole derivatives, thioether compounds, phenylenediamine derivatives, phosphonate, phosphate, phenol compounds, hindered phenol compounds, straight chain amine compounds, cyclic amine compounds, hindered amine compounds and the like.

Moreover, leveling agents such as silicone oils and fluorinated oils may be contained in the photosensitive layer 3 for the purpose of improving leveling property and giving lubrication.

Further, metal oxides such as silicon oxide (silica), titanium oxide, zinc oxide, calcium oxide, aluminum oxide (alumina), and zirconium oxide, metal sulfates such as barium sulfate and calcium sulfate, fine particles of metal nitrides such as silicon nitride and aluminum nitride, or particles of fluorinated resins such as tetrafluoroethylene resins and fluorinated comb type grafted resins may be contained in the photosensitive layer 3 for the purpose of reducing friction coefficient and giving lubrication.

Still further, other known additives may be contained optionally as far as electrophotographic characteristics are not significantly damaged. The known additives may include, for example, biphenyl compounds described in Japanese Patent Application Laid-open No. 1991-75754.

Protective Layer 4

The protective layer 4 may be provided optionally for the purpose of improving abrasion resistance, and consisting of layers with resin binders as main ingredients or inorganic thin films such as amorphous carbon. For the purpose of improving electroconductivity, reducing friction coefficient, and giving lubrication, the resin binders may contain metal oxides such as silicon oxide (silica), titanium oxide, zinc oxide, calcium oxide, aluminum oxide (alumina), and zirconium oxide, metal sulfates such as barium sulfate and calcium sulfate, fine particles of metal nitrides such as silicon nitride and aluminum nitride, or particles of fluorinated resins such as tetrafluoroethylene resins and fluorinated comb type grafted resins.

Further, hole transfer substances or electron transfer substances used in the present photosensitive layer 3 may be contained in the protective layer 4 for the purpose of giving charge transfer property. Furthermore leveling agents such as silicone oils or fluorinated oils may be contained in the protective layer 4 for the purpose of improving leveling property of the formed film or giving lubrication. Moreover, other known additives may be contained optionally as far as they do not significantly damage the electrophotographic characteristics.

Method of Formation

In order to form above described undercoat layer 2, photosensitive layer 3, and protective layer 4 in sequence on the electroconductive substrate 1, coating solutions may be prepared by dissolving and dispersing previously described ingredient materials in suitable solvents, coated by suitable methods, and dried.

The solvents used include, for example, mainly alcohols such as methanol, ethanol, n-propanol, i-propanol, n-butanol and benzylalcohol, ketones such as acetone, methylethylketone, methylisobutylketone and cyclehexanone, amides such as dimethylformamide and dimethylacetamide, sulfoxides such as dimethylsulfoxide, cyclic or straight chain ethers such as tetrahydrofurane, dioxane, dioxolane, diethylether, methylcellosolve and ethylcellosolve, esters such as methyl acetate, ethyl acetate and n-butyl acetate, halogenated aliphatic hydrocarbons such as methylene chloride, chloroform, carbon tetrachloride, dichloroethylene and trichloroethylene, mineral oils such as ligroin, aromatic hydrocarbons such as benzene, toluene and xylene, halogenated aromatic hydrocarbons such as chlorobenzene and dichlorobenzene, and mixtures of two or more of them.

The method of dispersion and dissolution of the coating solutions can use known methods, for example, bead mills such as paint shakers, ball mills, and DYNO-MILL (manufactured by WAB CO., Ltd.), and supersonic dispersion. Further, the methods of coating can use known methods such as mainly dip-coating, seal coating, spray coating, bar coating and blade coating.

Drying temperature and time in the drying process may be suitably established depending on solvents used and production cost. Preferably the drying temperature is in the range of between room temperature and 200° C., and the drying time is in the range of between 10 minutes and two hours. More preferably, the drying temperature lies in the range between the boiling point of the solvent and 80° C. above the boiling point. Further, the drying is typically carried out under ambient pressure or reduced pressure with or without ventilation.

Figure 2:
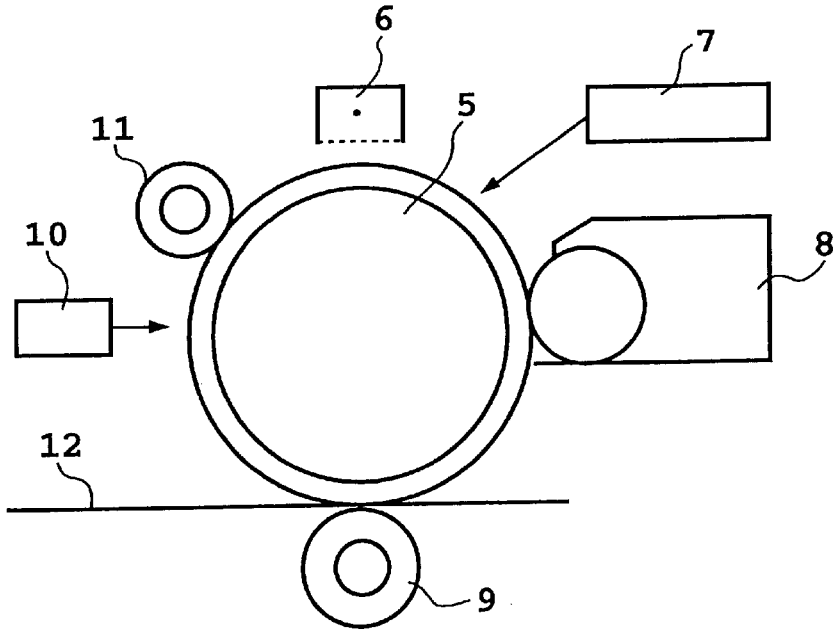
FIG. 2 is a schematic view showing an example of the electrophotographic apparatus of the present invention.

FIG. 2 is a schematic view of an example of the electrophotographic apparatus of the present invention comprising an electrophotographic photoconductor obtained as described above. The charging process of this electrophotographic apparatus is a positive charging process. The electrophotographic apparatus of FIG. 2 comprises an electrophotographic photoconductor cylinder 5 formed to be cylindrical a electrophotographic photoconductor obtained as above mentioned, a Scorotron charging device 6, a laser light source for exposure 7, a developing device 8, a transcribing roller 9, a discharging light source 10, and a cleaning roller 11. The electrophotographic photoconductor cylinder 5 is charged by the Scorotron charging device 6, and exposed by the laser light source for exposure 7 to form a desired charge image on it. Then, the image is developed by the developing device 8. A paper 12 is guided between the electrophotographic photoconductor cylinder 5 and the transcribing roller 9 to transcribe the image on it. The image on the paper 12 is fixed. After transcribing the electrophotographic photoconductor cylinder 5 is discharged on the surface by exposing the discharging light source 10 and cleaned by using the cleaning roller 11. Then, the electrophotographic photoconductor cylinder 5 is uses in cycle process.

EXAMPLES

The present invention is explained in detail based upon examples.

Example 1

A flat photoconductor for evaluation of electric properties and a cylindrical photoconductor (30 mm ϕ) for evaluation of printing were prepared. An aluminum plate and an aluminum cylinder were dip coated with an undercoat layer solution of the following composition and dried at 100° C. for 60 minutes to form undercoat layers having the thickness of 0.3 μm.

| | |
|---|---|
| Vinyl chloride - vinyl acetate copolymer (SOLBIN C: available from Nissin Chemical Industry Co., Ltd.) | 30 parts |
| Methylethylketone | 970 parts |

Next, a dispersion for a single layer type photosensitive layer was prepared by blending materials of the following composition using a DYNO-MILL (manufactured by WAB Co.), and the dispersion dip-coated on the undercoat layers described above and dried at 100° C. for 60 minutes to form single layer type photosensitive layers having the thickness of 25 μm.

Charge generating substance:

| | |
|---|---|
| X type metal-less phthalocyanine | 2 parts |
| Hole transfer substance: The compound of the formula (HT1-17) | 50 parts |
| Electron transfer substance: The compound of the formula (HT1-8) | 30 parts |
| Antioxidant: BHT | 5 parts |
| Silicone oil: KF-50 (Available from Shin-Etsu Chemical Co., Ltd.) | 0.1 part |
| Binder resin: Bisphenol Z type polycarbonate resin [A resin with the formula (BD1-1) as the structural unit] (Panlite TS2020: from Teijin Chemicals Ltd.) | 120 parts |
| Methylene chloride | 800 parts |

An electrophotographic photoconductor was prepared as described above.

Examples 2–22

Electrophotographic photoconductors were prepared as described in Example 1 except for replacing the hole transfer substances and electron transfer substances of the composition of the dispersion for photosensitive layer used in Example 1 with compounds listed in Table 1.

TABLE 1

| example | hole transfer substance | electron transfer substance |
|---|---|---|
| 1 | (HT1-17) | (ET1-8) |
| 2 | (HT1-17) | (ET2-11) |
| 3 | (HT1-17) | (ET3-2) |
| 4 | (HT1-17) | (ET4-5) |
| 5 | (HT1-17) | (ET5-1) |
| 6 | (HT1-17) | (ET6-19) |
| 7 | (HT1-17) | (ET7-6) |
| 8 | (HT1-17) | (ET8-12) |
| 9 | (HT1-17) | (ET9-2) |
| 10 | (HT1-17) | (ET10-1) |
| 11 | (HT1-17) | (ET11-2) |
| 12 | (HT1-17) | (ET13-3) |
| 13 | (HT1-17) | (ET15-2) |
| 14 | (HT1-44) | (ET1-8) |
| 15 | (HT1-44) | (ET2-11) |
| 16 | (HT1-44) | (ET4-5) |
| 17 | (HT1-1) | (ET1-8) |
| 18 | (HT1-1) | (ET2-11) |
| 19 | (HT1-1) | (ET4-5) |
| 20 | (HT1-37) | (ET1-8) |
| 21 | (HT1-37) | (ET2-11) |
| 22 | (HT1-37) | (ET4-5) |

Examples 23–25

Electrophotographic photoconductors were prepared as described in Example 1 except for replacing the hole transfer substances of the composition of the dispersion for photosensitive layer used in Example 1 with compounds listed in Table 2.

TABLE 2

| example | hole transfer substance | | electron transfer substance |
|---|---|---|---|
| 23 | (HT1-1) 20 parts | (HT1-37) 30 parts | (ET1-8) |
| 24 | (HT1-17) 20 parts | (HT1-44) 30 parts | (ET1-8) |
| 25 | (HT1-17) 30 parts | (HT-17) 20 parts | (ET1-8) |

Comparative Examples 1–14

Electrophotographic photoconductors were prepared as described in Example 1 except for replacing the hole transfer substances and electron transfer substances of the composition of the dispersion for photosensitive layer used in Example 1 with compounds listed in Table 3.

TABLE 3

| comparative example | hole transfer substance | electron transfer substance |
|---|---|---|
| 1 | (HT-17) | (ET1-8) |
| 2 | (HT-17) | (ET2-11) |
| 3 | (HT-17) | (ET3-2) |
| 4 | (HT-17) | (ET4-5) |
| 5 | (HT-17) | (ET5-1) |
| 6 | (HT-17) | (ET6-19) |
| 7 | (HT-17) | (ET7-6) |
| 8 | (HT-17) | (ET8-12) |
| 9 | (HT-17) | (ET9-2) |
| 10 | (HT-17) | (ET10-1) |
| 11 | (HT-17) | (ET11-2) |
| 12 | (HT-17) | (ET13-3) |

TABLE 3-continued

| comparative example | hole transfer substance | electron transfer substance |
|---|---|---|
| 13 | (HT-17) | (ET15-2) |
| 14 | (HT1-17) | none |

Evaluation of Examples 1~25 and Comparative Examples 1–14

Flat photoconductors were used for evaluation of electric properties, and evaluation was carried out as follows with the electrostatic copying paper test apparatus EPA-8100 from Kawaguchi Electric Works Co., Ltd.

First, the photoconductor was charged in the dark temperature of 23° C. and 50% RH to give surface out +600 V, and then retentivity of surface potential for 5 seconds until exposure was obtained according to the following equation.

$$\text{Retentivity Vk5 (\%)}=(V5/V0)\times 100$$

V0: surface potential right after charged

V5: surface potential (at the beginning of exposure) after 5 seconds

Next, surface potential was similarly charged to about +600 V, exposure was carried out for 5 seconds with the 780 nm monochromatic light of 1.0 $\mu$W/cm$^2$ obtained by filtration of a halogen lamp light, and the intensity of exposure required to reduce the surface potential to half (+300 V) was determined as the sensitivity E1/2 ($\mu$J/cm$^2$), and the surface potential past 5 seconds after exposure was determined as the residual potential Vr (V).

Also, for the purpose of evaluation of durability by actual printing, a cylindrical photoconductor was installed in a laser printer HL-730 from Brother Co., Ltd. and surface potential Vo (V) and the potential of exposed part VI (V) were determined under an temperature of 24° C. and48% RH, and initial potential was evaluated. Further, after an image with printing ratio of 5% was printed on 5 thousands sheets of paper, the surface potential Vo (V) and the potential of exposed part VI (V) were determined again, and the potential after printing of 5 thousands sheets of paper was similarly evaluated.

These results of evaluation are shown in the following Tables 4 and 5.

TABLE 4

| | electrical properties (EPA-8100) | | | voltage evaluation (HL-730) | | | |
|---|---|---|---|---|---|---|---|
| | | | | initial | | after printing 5000 | |
| example | Vk5 (%) | E½ ($\mu$J/cm$^2$) | Vr (V) | Vo (V) | VI (V) | Vo (V) | VI (V) |
| 1 | 86.9 | 0.43 | 75 | 975 | 450 | 960 | 465 |
| 2 | 85.8 | 0.42 | 68 | 965 | 450 | 955 | 460 |
| 3 | 87.5 | 0.49 | 83 | 985 | 460 | 965 | 455 |
| 4 | 85.7 | 0.46 | 73 | 960 | 455 | 960 | 475 |
| 5 | 80.8 | 0.58 | 101 | 935 | 480 | 945 | 510 |
| 6 | 85.7 | 0.48 | 83 | 965 | 460 | 945 | 485 |
| 7 | 88.1 | 0.54 | 99 | 990 | 475 | 950 | 490 |
| 8 | 84.9 | 0.45 | 77 | 960 | 455 | 950 | 475 |
| 9 | 87.0 | 0.53 | 94 | 970 | 475 | 940 | 490 |
| 10 | 85.0 | 0.50 | 86 | 960 | 460 | 965 | 475 |
| 11 | 90.1 | 0.52 | 90 | 990 | 475 | 970 | 480 |

TABLE 4-continued

| | electrical properties (EPA-8100) | | | voltage evaluation (HL-730) | | | |
|---|---|---|---|---|---|---|---|
| | | | | initial | | after printing 5000 | |
| example | Vk5 (%) | E½ (μJ/cm²) | Vr (V) | Vo (V) | VI (V) | Vo (V) | VI (V) |
| 12 | 86.9 | 0.55 | 98 | 975 | 475 | 980 | 505 |
| 13 | 84.3 | 0.57 | 100 | 955 | 480 | 940 | 500 |
| 14 | 85.2 | 0.45 | 79 | 960 | 455 | 935 | 450 |
| 15 | 86.1 | 0.45 | 74 | 965 | 450 | 940 | 460 |
| 16 | 89.1 | 0.47 | 76 | 980 | 455 | 975 | 470 |
| 17 | 87.2 | 0.45 | 80 | 980 | 460 | 970 | 480 |
| 18 | 86.4 | 0.44 | 73 | 970 | 455 | 965 | 470 |
| 19 | 88.9 | 0.51 | 88 | 995 | 470 | 985 | 500 |
| 20 | 86.0 | 0.48 | 83 | 965 | 465 | 950 | 490 |
| 21 | 86.7 | 0.49 | 76 | 970 | 470 | 950 | 475 |
| 22 | 90.1 | 0.54 | 94 | 1005 | 485 | 1000 | 505 |
| 23 | 86.5 | 0.46 | 82 | 975 | 465 | 950 | 470 |
| 24 | 86.4 | 0.44 | 76 | 970 | 455 | 945 | 465 |
| 25 | 86.1 | 0.48 | 79 | 970 | 455 | 955 | 465 |

TABLE 5

| | electrical properties (EPA-8100) | | | voltage evaluation (HL-730) | | | |
|---|---|---|---|---|---|---|---|
| | | | | initial | | after printing 5000 | |
| example | Vk5 (%) | E½ (μJ/cm²) | Vr (V) | Vo (V) | VI (V) | Vo (V) | VI (V) |
| 1 | 84.9 | 0.44 | 73 | 960 | 455 | 825 | 460 |
| 2 | 83.5 | 0.44 | 70 | 950 | 450 | 845 | 470 |
| 3 | 86.0 | 0.51 | 75 | 965 | 460 | 860 | 465 |
| 4 | 83.5 | 0.46 | 75 | 955 | 455 | 890 | 495 |
| 5 | 78.4 | 0.55 | 99 | 925 | 480 | 795 | 485 |
| 6 | 82.1 | 0.50 | 85 | 945 | 465 | 885 | 505 |
| 7 | 85.0 | 0.56 | 96 | 965 | 480 | 830 | 490 |
| 8 | 80.3 | 0.47 | 80 | 935 | 455 | 845 | 470 |
| 9 | 84.4 | 0.54 | 93 | 955 | 475 | 850 | 500 |
| 10 | 82.7 | 0.52 | 91 | 945 | 470 | 885 | 535 |
| 11 | 87.1 | 0.55 | 93 | 970 | 470 | 820 | 465 |
| 12 | 83.9 | 0.58 | 101 | 960 | 480 | 900 | 550 |
| 13 | 80.8 | 0.59 | 101 | 935 | 485 | 845 | 510 |
| 14 | 89.0 | 1.34 | 157 | 980 | 555 | 775 | 575 |

As shown by the results in Tables 4 and 5 above, the electrophotographic photoconductors of examples 1–22, using the compounds of the structural formula represented by the general formula (HT1) as hole transfer substances, were found to have good stability in repeated use with both the surface potential Vo and the potential of exposed part VI (V) after printing of 5 thousands sheets more stable than the electrophotographic photoconductors of comparative experiments corresponding to the examples.

Also the electrophotographic photoconductors of example 23–25, using the mixture of two or more compounds of the general formula (HT1) as hole transfer substances have similar good property to the photoconductors containing a single compound as hole transfer substances.

As shown above, according to the present invention, a electrophotographic photoconductor that single layer type photosensitive layer containing at least a resin binder, a charge generating substance, a hole transfer substance, and an electron transfer substance (acceptor compound) is laminated directly or through an undercoat layer on an electroconductive substrate can provide good stability in repeated use by using a compound of the structural formula represented by the general formula (HT1) as the hole transfer substance. Moreover, these photoconductors are useful for printers, copying machines, and facsimiles using electrophotography.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An electrophotographic photoconductor comprising:

a single layer type photosensitive layer laminated directly or through an undercoat on an electroconductive substrate, wherein said single layer type photosensitive layer contains at least a resin binder, a charge generating substance, a hole transfer substance and an electron transfer substance, said hole transfer substance containing at least one selected from the group consisting of compounds represented by the following general formula (HT1)

(HT1)

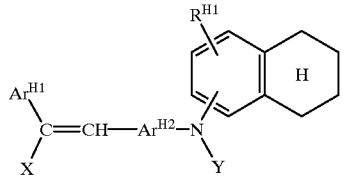

wherein, $Ar^{H1}$ is aryl group optionally having substituents, $Ar^{H2}$ is phenylene group optionally having substituents, naphthylene group, biphenylene group or anthrylene group, $R^{H1}$ is hydrogen atom, lower alkyl group or lower alkoxy group, X is hydrogen atom, alkyl group optionally having substituents, or aryl group optionally having substituents, and Y is aryl group optionally having substituents, the following general formula (HT1a)

(HT1a)

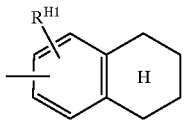

wherein, $R^{H1}$ is the same meaning as the above, or the following general formula (HT1b)

(HT1b)

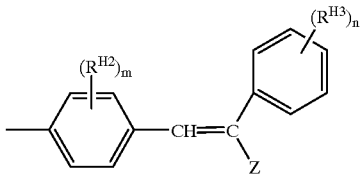

wherein $R^{H2}$ is hydrogen atom, lower alkyl group or lower alkoxy group, $R^{H3}$ is hydrogen atom, halogen atom, or lower alkoxy group or lower alkyl group, Z is hydrogen atom, or aryl group optionally having substituents, and m and n are 0 or integers of 1 to 4.

2. An electrophotographic photoconductor as claimed in claim 1 wherein said electron transfer substance contains at least one selected from the group consisting of compounds represented by the following general formula (ET1)

(ET1)

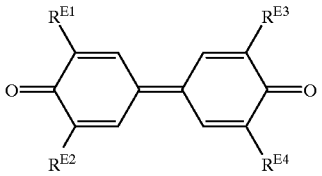

wherein, $R^{E1}$–$R^{E4}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, said substituents being halogen atom, alkyl group having 1 to 6 carbon atoms, alkoxy group having 1 to 6 carbon atoms, hydroxyl group, cyano group, amino group, nitro group, or halogenated alkyl group.

3. An electrophotographic photoconductor as claimed in claim 1 wherein said electron transfer substance contains at least one selected from the group consisting of compounds represented by the following general formula (ET2)

(ET2)

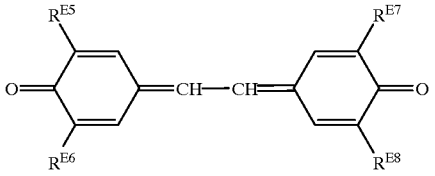

wherein $R^{E5}$–$R^{E8}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, said substituents being halogen atoms, alkyl group having 1 to 6 carbon atoms, alkoxy group having 1 to 6 carbon atoms, hydroxyl group, cyano group, amino group, nitro group, or halogenated alkyl group.

4. An electrophotographic photoconductor as claimed in claim 1 wherein said electron transfer substance contains at least one selected from the group consisting of compounds represented by the following general formula (ET3)

(ET3)

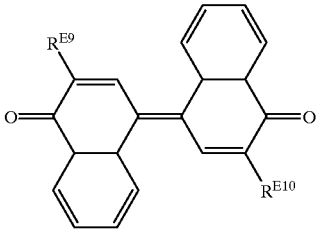

wherein $R^{E9}$ and $R^{E10}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, said substituents being halogen atoms, alkyl group having 1 to 6 carbon atoms, alkoxy group having 1 to 6 carbon atoms, hydroxyl group, cyano group, amino group, nitro group, or halogenated alkyl group.

5. An electrophotographic photoconductor as claimed in claim 1 wherein said electron transfer substance contains at least one selected from the group consisting of compounds represented by the following general formula (ET4)

(ET4)

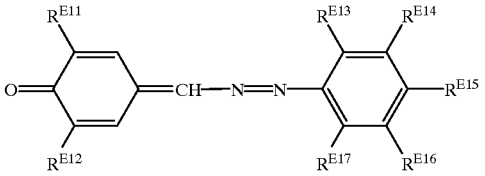

wherein $R^{E11}$ and $R^{E12}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, and $R^{E13}$–$R^{E17}$ are each independently hydrogen atom, halogen atom, alkyl group having 1 to 12 carbon atoms, alkoxy group having 1 to 12 carbon atoms, aryl group optionally having substituents, aralkyl group optionally having substituents, phenoxy group optionally having substituents or halogenated alkyl group, or two or more groups of $R^{E13}$–$R^{E17}$ may combine to form rings, said substituents being halogen atoms, alkyl group having 1 to 6 carbon atoms, alkoxy group having 1 to 6 carbon atoms, hydroxyl group, cyano group, amino group, nitro group, or halogenated alkyl group.

6. An electrophotographic photoconductor as claimed in claim 1 wherein said electron transfer substance contains at least one selected from the group consisting of compounds represented by the following general formula (ET5)

(ET5)

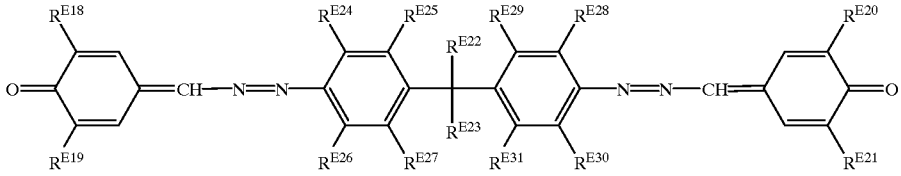

wherein $R^{E18}$–$R^{E21}$ are each independently hydrogen atom, alkyl group having 1 to 12 carbon atoms, alkoxy group having 1 to 12 carbon atoms, aryl group optionally having substituents, cycloalkyl group, aralkyl group optionally having substituents, or halogenated alkyl group, $R^{E22}$ and $R^{E23}$ are each independently hydrogen atom, alkyl group having 1 to 12 carbon atoms or aryl group, and $R^{E24}$–$R^{E31}$ are each independently hydrogen atom, halogen atom, alkyl group having 1 to 12 carbon atoms, alkoxy group having 1 to 12 carbon atoms, aryl group optionally having substituents, or halogenated alkyl group, said substituents being halogen atoms, alkyl group having 1 to 6 carbon atoms, alkoxy group having 1 to 6 carbon atoms, hydroxyl group, cyano group, amino group, nitro group, or halogenated alkyl group.

7. An electrophotographic photoconductor as claimed in claim 1 wherein said electron transfer substance contains at least one selected from the group consisting of compounds represented by the following general formula (ET6)

(ET6)

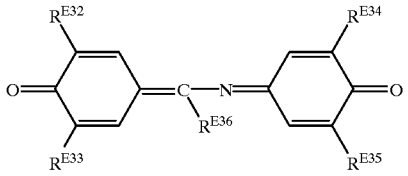

wherein, $R^{E32}$–$R^{E35}$ are each independently hydrogen atom, halogen atoms, cyano group, amino group, nitro group, alkyl group having 1 to 12 carbon atoms, alkoxy group having 1 to 12 carbon atoms, aryl group optionally having substituents, cycloalkyl group, aralkyl group optionally having substituents, or halogenated alkyl group, and $R^{E36}$ is a hydrogen atom, halogen atoms, cyano group, amino group, nitro group, benzoquinoneimine optionally having substituents, alkyl group having 1 to 12 carbon atoms, alkoxy group having 1 to 12 carbon atoms, aryl group optionally having substituents, cycloalkyl group, aralkyl group optionally having substituents, or halogenated alkyl group, said substituents being halogen atoms, alkyl group having 1 to 6 carbon atoms, alkoxy group having 1 to 6 carbon atoms, hydroxyl group, cyano group, amino group, nitro group, or halogenated alkyl group.

8. An electrophotographic photoconductor as claimed in claim 1 wherein said electron transfer substance contains at least one selected from the group consisting of compounds represented by the following general formula (ET7)

(ET7)

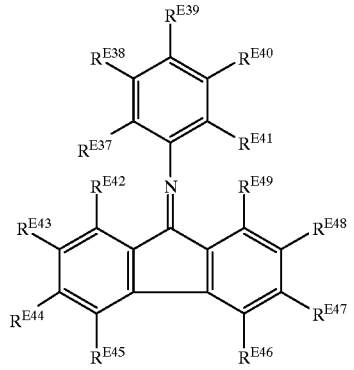

wherein $R^{E37}$–$R^{E41}$ are each independently hydrogen atom, halogen atoms, cyano group, nitro group, alkyl group having 1 to 12 carbon atoms, alkoxy group having 1 to 12 carbon atoms, aryl group optionally having substituents, an aralkyl group optionally having substituents, phenoxy group optionally having substituents, or halogenated alkyl group, and $R^{E42}$–$R^{E49}$ are hydrogen atom or nitro group, and at least three of them are nitro groups, said substituents being halogen atoms, alkyl group having 1 to 6 carbon atoms, alkoxy group having 1 to 6 carbon atoms, hydroxyl group, cyano group, amino group, nitro group, or halogenated alkyl group.

9. A electrophotographic photoconductor as claimed in claim 1 wherein said electron transfer substance contains at least one selected from the group consisting of compounds represented by the following general formula (ET8)

(ET8)

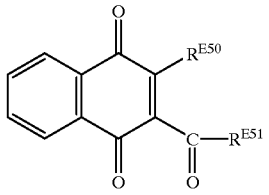

wherein $R^{E50}$ is alkyl group optionally having substituents or aryl group optionally having substituents, and $R^{E51}$ is alkyl group optionally having substituents, aryl group optionally having substituents, or the following formula (ET8a)

$$—O—R^{E52} \quad \text{(ET8a)}$$

wherein $RE^{52}$ is alkyl group optionally having substituents, or aryl group optionally having substituents, said substituents being halogen atoms, alkyl groups having 1 to 6 carbon atoms, alkoxy group having 1 to 6 carbon atoms, hydroxyl group, cyano group, amino group, nitro group, or halogenated alkyl group.

10. An electrophotographic photoconductor as claimed in claim 1 wherein said electron transfer substance contains at least one selected from the group consisting of compounds represented by the following general formula (ET9)

(ET9)

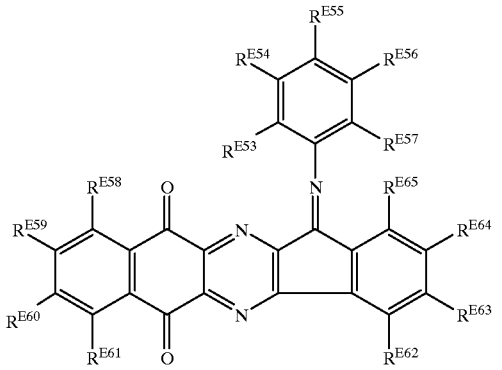

wherein $R^{E53}$–$R^{E65}$ are each independently hydrogen atom, alkyl group having 1 to 6 carbon atoms, alkoxy group having 1 to 6 carbon atoms, aryl group, aralkyl group, halogen atoms, or halogenated alkyl group.

11. An electrophotographic photoconductor as claimed in claim 1 wherein said electron transfer substance contains at least one selected from the group consisting of compounds represented by the following general formula (ET10)

(ET10)

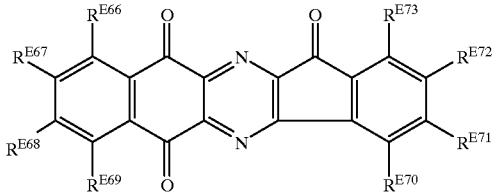

wherein $R^{E66}$–$R^{E73}$ are each independently hydrogen atom, alkyl group having 1 to 6 carbon atoms, alkoxy group having 1 to 6 carbon atoms, aryl group, aralkyl group, halogen atoms, or halogenated alkyl group.

12. An electrophotographic photoconductor as claimed in claim 1 wherein said electron transfer substance contains at least one selected from the group consisting of compounds represented by the following general formula (ET11)

(ET11)

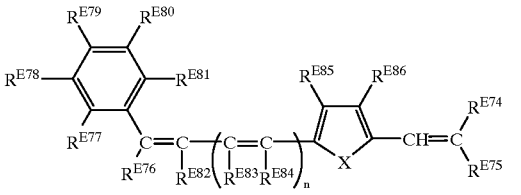

wherein $R^{E74}$ and $R^{E75}$ are each independently cyano group, or alkoxycarbonyl group, $R^{E76}$ is hydrogen atom, alkyl group having 1 to 12 carbon atoms or aryl group optionally having substituents, $R^{E77}$–$R^{E81}$ are each independently hydrogen atom, halogen atoms, alkyl group having 1 to 12 carbon atoms, alkoxy group, aryl group optionally having substituents, halogenated alkyl group, or alkylated amino group, $R^{82}$–$R^{E84}$ are each independently hydrogen atom or alkyl group having 1 to 12 carbon atoms, $R^{E85}$ and $R^{E86}$ are each independently hydrogen atom, halogen atoms, alkyl group having 1 to 12 carbon atoms, or aryl group optionally having substituents, X is sulfur atom or oxygen atom, and n is 0 or 1, said substituents being halogen atoms, alkyl group having 1 to 6 carbon atoms, alkoxy group having 1 to 6 carbon atoms, hydroxyl group, cyano group, amino group, alkylated amino group, nitro group, or halogenated alkyl group.

13. An electrophotographic photoconductor as claimed in claim 1 wherein said electron transfer substance contains at least one selected from the group consisting of compounds represented by the following general formulas (ET12), (ET13) and (ET14)

(ET12)

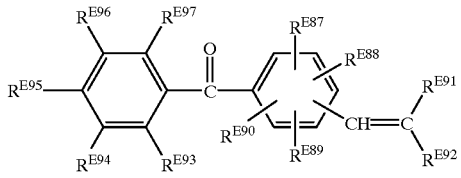

(ET13)

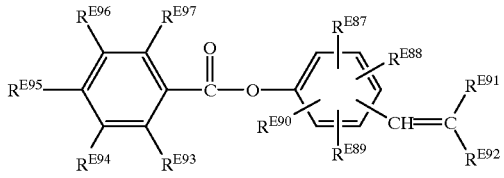

(ET14)

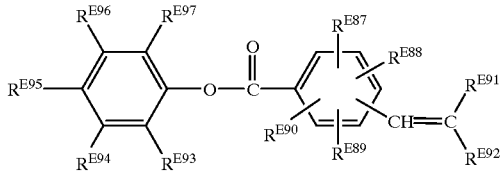

wherein $R^{E87}$–$R^{E90}$ are each independently hydrogen atom or halogen atoms, $R^{E91}$ and $R^{E92}$ are each independently cyano group, or alkoxycarbonyl group, and $R^{E93}$–$R^{E97}$ are each independently hydrogen atom, halogen atoms, alkyl group having 1 to 6 carbon atoms, nitro group, or cyano group.

14. An electrophotographic photoconductor as claimed in claim 1 wherein said electron transfer substance contains at least one selected from the group consisting of compounds represented by the following general formulas (ET15) and (ET16)

(ET15)

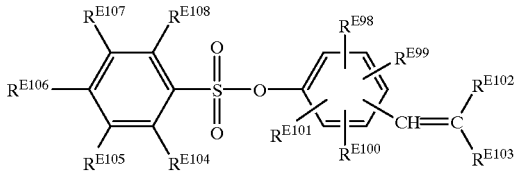

-continued (ET16)

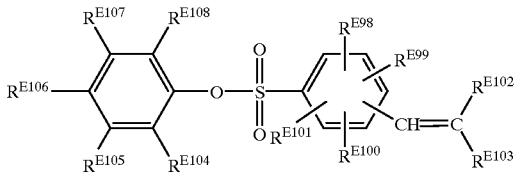

wherein $R^{E98}$–$R^{E101}$ are each independently hydrogen atom or halogen atoms, $R^{E102}$ and $R^{E103}$ are each independently cyano group, or alkoxycarbonyl group, and $R^{104}$–$R^{108}$ are each independently hydrogen atom, halogen atoms, alkyl group having 1 to 6 carbon atoms, nitro group, or cyano group.

15. An electrophotographic photoconductor as claimed in claim 1 wherein said charge generating substance is an X type metal-less phthalocyanine.

16. An electrophotographic photoconductor as claimed in claim 1 wherein said binder resin is polycarbonate containing as a repeating unit at least one selected from a group of consisting of compounds represented by the following general formula (BD1)

(BD1)

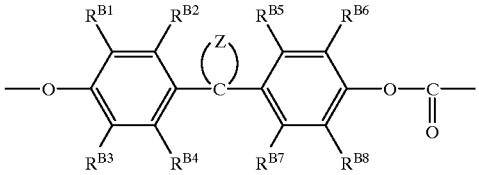

wherein $R^{B1}$–$R^{B8}$ is each independently hydrogen atom, alkyl group having 1 to 6 carbon atoms, aryl group optionally having substituents, cycloalkyl group, or halogen atoms, and Z is group of atoms required to form carbocycles optionally having substituents, said substituents being alkyl group having 1 to 6 carbon atoms, or halogen atoms.

17. An electrophotographic apparatus comprising the electrophotographic photoconductor according to claim 1, wherein said electrophotographic apparatus carries out the charging process by a positive charging process.

18. An electrophotographic photoconductor as claimed in claim 1 wherein being used in an electrophotographic apparatus that carries out the charging process by a positive charging process.

* * * * *